US006238856B1

(12) United States Patent
Uchida et al.

(10) Patent No.: US 6,238,856 B1
(45) Date of Patent: May 29, 2001

(54) SILVER HALIDE COLOR PHOTOGRAPHIC MATERIAL AND IMAGE-FORMING METHOD

(75) Inventors: Osamu Uchida; Yasuhiro Ishiwata; Taiji Katsumata, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/566,003

(22) Filed: May 5, 2000

(30) Foreign Application Priority Data

May 7, 1999 (JP) ..... 11-127299

(51) Int. Cl.[7] ..... G03C 1/42

(52) U.S. Cl. ..... 430/566; 430/203; 430/348; 430/422; 430/448

(58) Field of Search ..... 430/566

(56) References Cited

U.S. PATENT DOCUMENTS

| | | | | |
|---|---|---|---|---|
| 5,695,913 | * | 12/1997 | Nakamura et al. | 430/566 |
| 5,780,210 | * | 7/1998 | Takeuchi et al. | 430/566 |
| 5,817,449 | * | 10/1998 | Nakamura | 430/566 |
| 5,851,749 | * | 12/1998 | Okawa et al. | 430/566 |
| 5,874,203 | * | 2/1999 | Morita et al. | 430/566 |
| 5,976,756 | | 11/1999 | Nakamura et al. | 430/203 |

FOREIGN PATENT DOCUMENTS 8286340 11/1996 (JP) .

* cited by examiner

*Primary Examiner*—Hoa Van Le
(74) *Attorney, Agent, or Firm*—Birch, Stewart, Kolasch & Birch, LLP

(57) ABSTRACT

A silver halide color photographic material comprising a support having provided thereon at least one hydrophilic colloidal layer containing at least one color-developing agent represented by general formula (1) and at least one coupler represented by general formula (2):

(1)

wherein Cα represents a carbon atom, Z represents a carbamoyl group, an acyl group, an alkoxycarbonyl group or an aryloxycarbonyl group, and Q represents an atomic group forming an unsaturated ring together with Cα.

(2)

wherein Cβ represents a carbon atom, EWG represents a cyano group, a carbamoyl group or an alkoxycarbonyl group, LG represents a group which is released by a coupling reaction with an oxidation product of a developing agent, and M represents an atomic group forming a 5-membered aromatic heterocycle together with Cβ.

8 Claims, No Drawings

SILVER HALIDE COLOR PHOTOGRAPHIC MATERIAL AND IMAGE-FORMING METHOD

FIELD OF THE INVENTION

The present invention relates to a novel silver halide color photographic material containing at least one color-developing agent and at least one coupler and an image-forming method, and particularly to a silver halide color photographic material excellent in color generation and good in sharpness and preservability of images and an image-forming method.

BACKGROUND OF THE INVENTION

With respect to color photographic materials, the materials are exposed to light, and then subjected to color development, thereby allowing oxidized color-developing agents to react with couplers to form images.

The color development is achieved by immersing the exposed photographic materials in aqueous alkali solutions (developing solutions) in which the color-developing agents are dissolved. However, many problems are encountered, such as easy deterioration of the developing solutions and waste liquid treatment of the spent developing solutions.

As a method for solving these problems, a method of allowing a hydrophilic colloid to contain an aromatic primary amine developing agent or a precursor thereof is proposed. Further, a method of allowing a hydrophilic colloid to contain a sulfonyl hydrazine type developing agent is also proposed. Examples of such methods include methods described in JP-B-58-14671 (the term "JP-B" as used herein means an "examined Japanese patent publication"), and methods described in EP 545,491 A1 and EP 565,165 A1.

However, these methods also suffer from the problem of insufficient color generation in development or pose a problem in storage stability.

Further, in the field of silver halide photographic materials, the so-called color diffusion transfer process in which diffusible dyes are formed imagewise and fixed to image receiving materials, thereby forming color images is a known art. With respect to this process, many proposals have been made. In this process, compounds obtained by making previously colored image formation dyes (preformed dyes) diffusion-resistant (hereinafter referred to as "coloring materials) are generally used. The addition of the coloring materials to layers having silver halide emulsions causes an undesirable reduction in sensitivity to exposure because of the filter effect due to dye portions. As methods for improving these disadvantages, so-called coupling systems in which dye formation is carried out by the coupling reaction of oxidation products of developing agents with couplers are proposed in U.S. Pat. No. 4,469,773 and JP-B-63-36487. However, with regard to the color-developing agents described in these, the storage stability is difficult to be compatible with the activity of the coupling reaction, or it is difficult to make both the color-developing agents and the couplers diffusion-resistant.

For solving the problems described above, novel color-developing agents are proposed in JP-A-08-286340 (the term "JP-A" as used herein means an "unexamined published Japanese patent application") and JP-A-09-152705. However, in combinations of the color-developing agents and couplers described in these, the color generation of yellow images is insufficient yet, or a problem arises with regard to the hue or color image stability of the yellow images formed.

SUMMARY OF THE INVENTION

An object of the invention is to provide a method for forming a yellow dye from a color-developing agent and a coupler which are both colorless, in which the yellow dye formed therein has excellent sharpness and storage stability.

Another object of the invention is to provide a silver halide color photographic material and an image-forming method, with which sufficient color generation is obtained upon development and color images having excellent image quality are formed.

Other objects and effects of the present invention will become apparent from the following description.

The objects of the invention have been achieved by providing a silver halide color photographic material comprising a support having provided thereon at least one hydrophilic colloidal layer containing at least one color-developing agent represented by general formula (1) and at least one coupler represented by general formula (2):

(1)

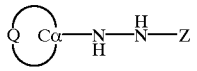

wherein Cα represents a carbon atom, Z represents a carbamoyl group, an acyl group, an alkoxycarbonyl group or an aryloxycarbonyl group, and Q represents an atomic group forming an unsaturated ring together with Cα.

(2)

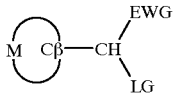

wherein Cβ represents a carbon atom, EWG represents a cyano group, a carbamoyl group or an alkoxycarbonyl group, LG represents a group which is released by a coupling reaction with an oxidation product of a developing agent, and M represents an atomic group forming a 5-membered aromatic heterocycle together with Cβ.

In addition, the objects of the invention have been achieved by providing an image-forming method comprising developing the above-described photographic material, for example, by heat development, by development under alkali generation caused by a slightly soluble metal salt and a complexing agent for the metal salt, or by development with developing an alkali treatment solution.

DETAILED DESCRIPTION OF THE INVENTION

The compounds represented by general formulas (1) and (2), which are used in the invention, are described in detail below First, general formula (1) is described. In general formula (1), Z represents a carbamoyl group, an acyl group, an alkoxycarbonyl group or an aryloxycarbonyl group. Of these, the carbamoyl group is preferred, and the carbamoyl group having a hydrogen atom bonded to its nitrogen atom is particularly preferred.

The carbamoyl group preferably has 1 to 50 carbon atoms, and more preferably 1 to 40 carbon atoms. Specific examples of such groups include carbamoyl, methylcarbamoyl, ethylcarbamoyl, n-propylcarbamoyl, sec-butylcarbamoyl, n-octylcarbamoyl, cyclohexylcarbamoyl, tert-butylcarbamoyl, dodecylcarbamoyl, 3-dodecyloxypropylcarbamoyl, octadecylcarbamoyl, phenylcarbamoyl, 3-(2,4-di-tert-pentylphenoxy)-propylcarbamoyl, 4-dodecyloxyphenylcarbamoyl, 2-chloro-5-dodecyloxycarbonylphenylcarbamoyl, naphthylcarbamoyl, 3-pyridylcarbamoyl, 3,5-bisoctyloxycarbonylphenylcarbamoyl, 3,5-bistetradecyloxyphenylcarbamoyl, benzyloxycarbamoyl and 5-dioxo-1-pyrrolidinylcarbamoyl.

The acyl group preferably has 1 to 50 carbon atoms, and more preferably 1 to 40 carbon atoms. Specific examples of such groups include formyl, acetyl, 2-methylpropanoyl, cyclohexylcarbonyl, n-octanoyl, 2-hexyldecanoyl, dodecanoyl, chloroacetyl, trifluoroacetyl, benzoyl, 4-dodecyloxybenzoyl, 2-hydroxymethylbenzoyl and 3-(N-hydroxy-N-methylaminocarbonyl)propanoyl.

The alkoxycarbonyl group and the aryloxycarbonyl group preferably have 2 to 50 carbon atoms, and more preferably 2 to 40 carbon atoms. Specific examples thereof include methoxycarbonyl, ethoxycarbonyl, isobutyloxycarbonyl, cyclo-hexyloxycarbonyl, dodecyloxycarbonyl, benzyloxycarbonyl, phenoxycarbonyl, 4-octyloxyphenoxycarbonyl, 2-hydroxymethyl-phenoxycarbonyl and 4-dodecyloxyphenoxycarbonyl.

Q represents an atomic group forming an unsaturated ring together with Cα. The unsaturated ring formed is preferably each of 3- to 8-membered rings, and more preferably a 5- or 6-membered ring. Preferred examples of the rings include benzene, pyridine, pyrazine, pyrimidine, pyridazine, 1,2,4-triazine, 1,3,5-triazine, pyrrole, imidazole, pyrazole, 1,2,3-triazole, 1,2,4-triazole, tetrazole, 1,3,4-thiadiazole, 1,2,4-thiadiazole, 1,3,4-oxadiazole, 1,2,4-oxadiazole, thiazole, oxazole, isothizole, isoxazole and thiophene rings. Further, rings obtained by condensing these rings with each other are also preferably used.

Furthermore, these rings may have substituents, and examples of the substituents include straight-chain, branched-chain or cyclic alkyl groups each having 1 to 50 carbon atoms (for example, trifluoromethyl, methyl, ethyl, propyl, heptafluoropropyl, isopropyl, butyl, t-butyl, t-pentyl, cyclopentyl, cyclohexyl, octyl, 2-ethylhexyl and dodecyl), straight-chain, branched-chain or cyclic alkenyl groups each having 2 to 50 carbon atoms (for example, vinyl, 1-methylvinyl and cyclohexene-1-yl), alkynyl groups each having a total carbon number of 2 to 50 (for example, ethynyl and 1-propynyl), aryl groups each having 6 to 50 carbon atoms (for example, phenyl, naphthyl and anthryl), acyloxy groups each having 1 to 50 carbon atoms (for example, acetoxy, tetradecanoyloxy and benzoyloxy), carbamoyloxy groups each having 1 to 50 carbon atoms (for example, N,N-dimethyl-carbamoyloxy), carbonamido groups each having 1 to 50 carbon atoms (for example, formamido, N-methylacetamido, acetamido, N-methylformamido and benzamido), sulfonamido groups each having 1 to 50 carbon atoms (for example, methanesulfonamido, dodecanesulfonamido, benzene-sulfonamido and p-toluenesulfon-amido), carbamoyl groups each having 1 to 50 carbon atoms (for example, N-methylcarbamoyl, N,N-diethylcarbamoyl and N-mesylcarbamoyl, sulfamoyl groups each having 0 to 50 carbon atoms (for example, N-butylsulfamoyl, N,N-diethylsulfamoyl and N-methyl-N-(4-methoxyphenyl) sulfamoyl), alkoxyl groups each having 1 to 50 carbon atoms (for example, methoxy, propoxy, isopropoxy, octyloxy, t-octyloxy, dodecyloxy and 2-(2,4-di-t-pentylphenoxy)ethoxy), aryloxy groups each having 6 to 50 carbon atoms (for example, phenoxy, 4-methoxyphenoxy and naphthoxy), aryloxycarbonyl groups each having 7 to 50 carbon atoms (for example, phenoxycarbonyl and naphthoxycarbonyl), alkoxycarbonyl groups each having 2 to 50 carbon atoms (for example, methoxycarbonyl and t-butoxycarbonyl), N-acylsulfamoyl groups each having 1 to 50 carbon atoms (for example, N-tetradecanoylsulfamoyl and N-benzoylsulfamoyl), alkylsulfonyl groups each having 1 to 50 carbon atoms (for example, methanesulfonyl, octylsulfonyl, 2-methoxyethyl-sulfonyl and 2-hexyldecylsulfonyl), arylsulfonyl groups each having 6 to 50 carbon atoms (for example, benzenesulfonyl, p-toluenesulfonyl, 4-phenylsulfonylphenylsulfonyl), alkoxycarbonylamino groups each having 2 to 50 carbon atoms (for example, ethoxy-carbonylamino), aryloxycarbonylamino groups each having 7 to 50 carbon atoms (for example, phenoxycarbonylamino and naphthoxycarbonylamino), amino groups each having 0 to 50 carbon atoms (for example, amino, methylamino, diethylamino, diisopropylamino, anilino and morpholino), a cyano group, a nitro group, a carboxyl group, a hydroxyl group, a sulfo group, a mercapto group, alkylsulfinyl groups each having 1 to 50 carbon atoms (for example, methane-sulfinyl and octanesulfinyl), arylsulfinyl groups each having 6 to 50 carbon atoms (for example, benzenesulfinyl, 4-chlorophenyl-sulfinyl and p-toluenesulfinyl), alkylthio groups each having 1 to 50 carbon atoms (for example, methylthio, octylthio and cyclohexylthio), arylthio groups each having 6 to 50 carbon atoms (for example, phenylthio and naphthylthio), ureido groups each having 1 to 50 carbon atoms (for example, 3-methylureido, 3,3-dimethylureido and 1,3-diphenylureido), heterocyclic groups each having 2 to 50 carbon atoms (3- to 12-membered monocyclic or condensed rings each containing, for example, at least one atom, preferably 1 to 9 atoms, of nitrogen, oxygen and sulfur atoms as heteroatoms, for example, 2-furyl, 2-pyranyl, 2-pyridyl, 2-thienyl, 2-imidazolyl, morpholino, 2-quinolyl, 2-benzimidazolyl, 2-benzothiazolyl and 2-benzoxazolyl), acyl groups each having 1 to 50 carbon atoms (for example, acetyl, benzoyl and trifluoroacetyl), sulfamoylamino groups each having 0 to 50 carbon atoms (for example, N-butylsulfamoylamino and N-phenylsulfamoylamino), silyl groups each having 3 to 50 carbon atoms (for example, trimethylsilyl, dimethyl-t-butylsilyl and triphenylsilyl), and halogen atoms (for example, fluorine, chlorine and bromine) The above-mentioned substituents may further have substituents, and examples of the substituents include the substituents mentioned above. These substituents may combine with each other to form a condensed ring.

The carbon number of the substituents is preferably 50 or less, more preferably 42 or less, and most preferably 34 or less. Moreover, it is preferably 1 or more.

The total number of carbon atoms of the unsaturated ring formed by Q and Cα and substituents thereof is preferably 30 or less, more preferably 24 or less, and most preferably 18 or less.

For all of the substituents of the ring formed by Q and Cα, when the ring is formed by carbon atoms alone (for example, a benzene ring, a naphthalene ring or an anthracene ring), the total of Hammett substituent constant σ values (when it is in a relation of 1.2, 1.4 . . . with respect to Cα, σp is used, and when it is in a relation of 1.3, 1.5 . . . with respect to Cα, σm is used) is from 0.8 to 3.5, more preferably from 1.2 to 3.0, and most preferably from 1.5 to 3.0.

When the ring formed by Q and Cα is a heterocycle, one having at least one substituent having a positive σp value is preferred.

Hammett substituent constants σp and σm are explained in detail, for example, in Naoki Inamoto "Hammett Rule—Kozo to Hannosei (Structure and Reactivity)—" (Maruzen), "Shin Jikken Kagaku Koza 14, Yuki Kagobutsu no Gosei to Hanno (Synthesis and Reaction of Organic Compounds) V", page 2605 (edited by Nippon Kagakukai (The Chemical Society of Japan)), Tadao Nakaya, "Riron Yuki Kagaku Kaisetsu (Explanation of Theoretical Organic Chemistry)" page 217 (Tokyo Kagaku Dojin) and Chemical Review (vol. 91), pages 165 to 195 (1991).

Specific examples of the color-developing agents represented by general formula (1) are shown below, but the scope of the invention is not limited to these specific examples.

D-(1)

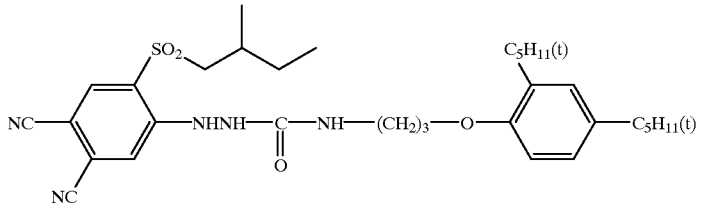

D-(2)

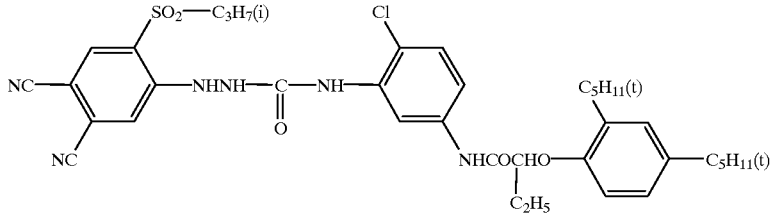

D-(3)

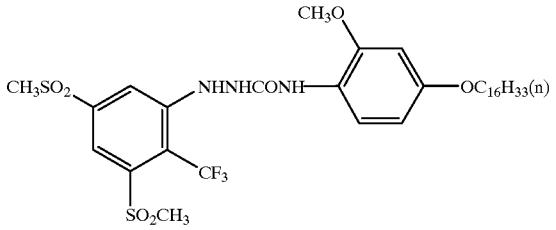

D-(4)

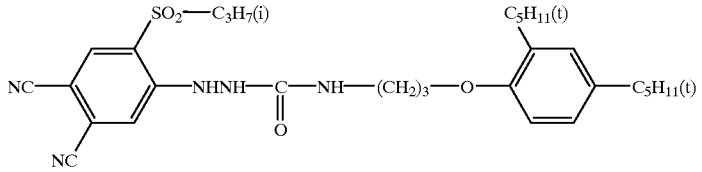

D-(5)

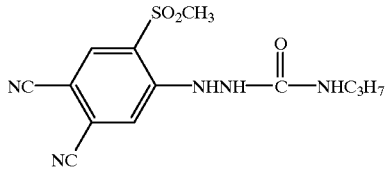

D-(6)

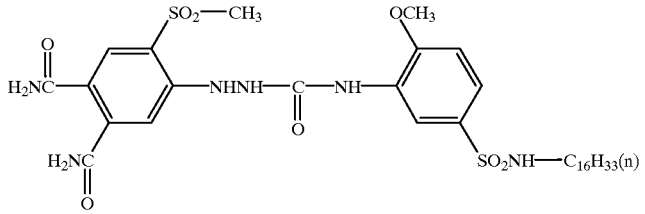

-continued
D-(7)
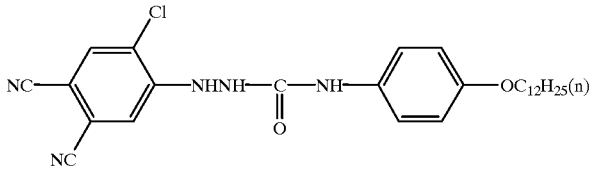
D-(8)
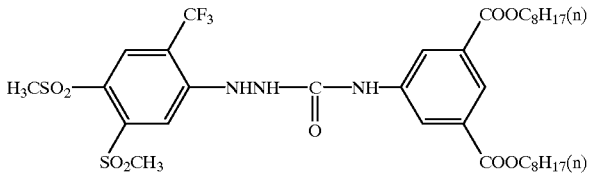
D-(9)
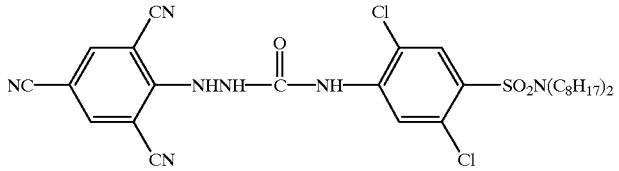
D-(10)
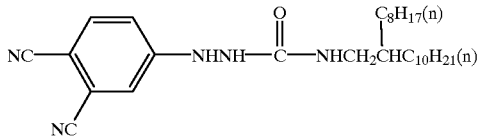
D-(11)
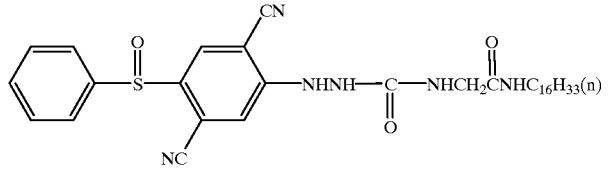
D-(12)
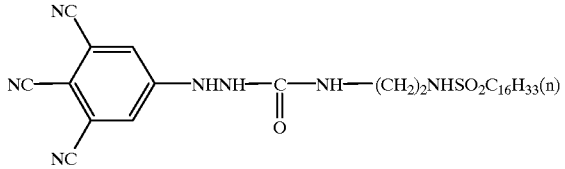
D-(13)
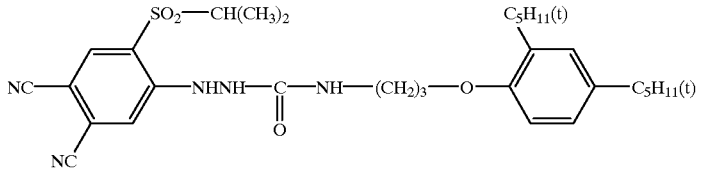
D-(14)
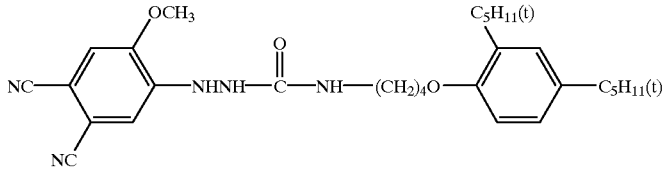

-continued
D-(15)
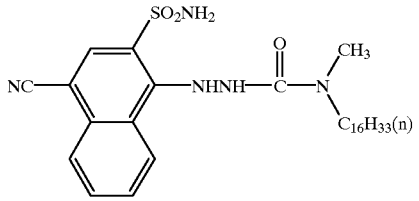
D-(16)
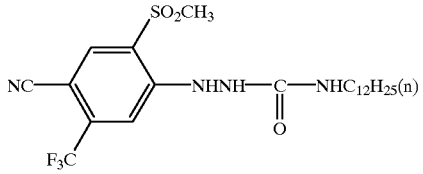
D-(17)
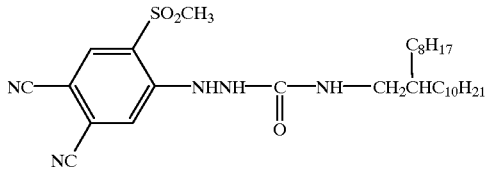
D-(18)
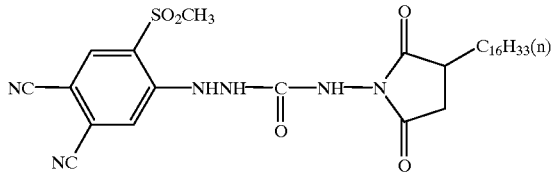
D-(19)
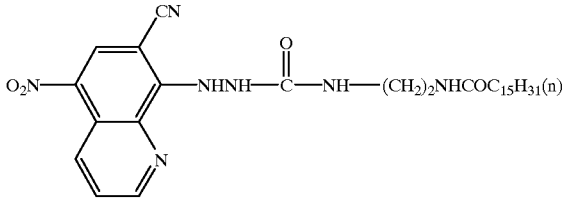
D-(20)
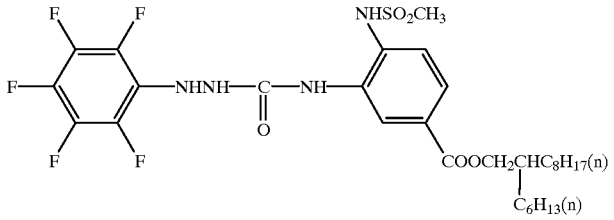
D-(21)
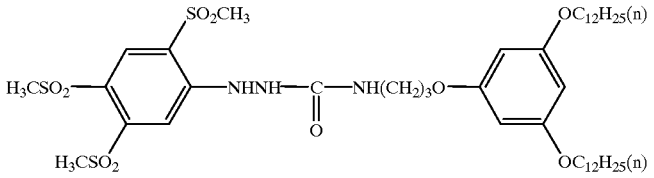

-continued
D-(22)
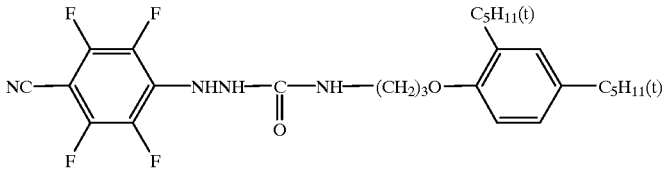
D-(23)
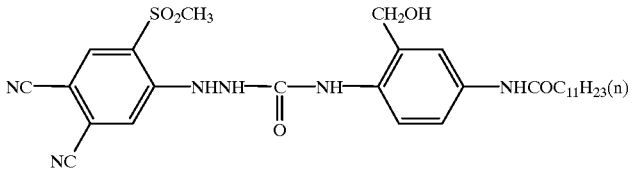
D-(24)
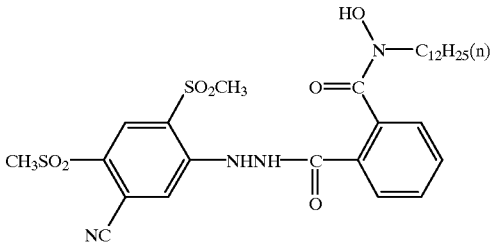
D-(25)
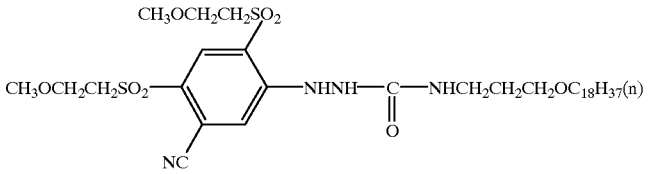
D-(26)
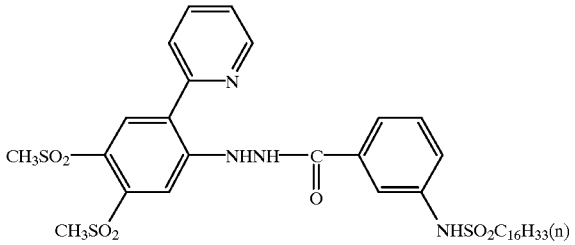
D-(27)
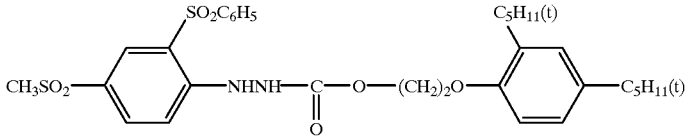
D-(28)
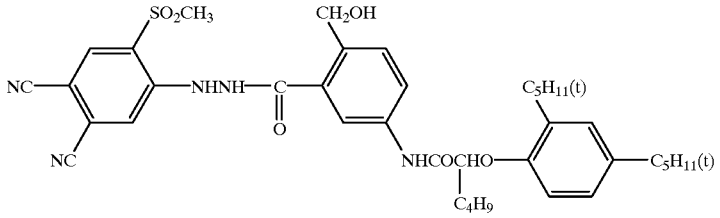

-continued
D-(29)
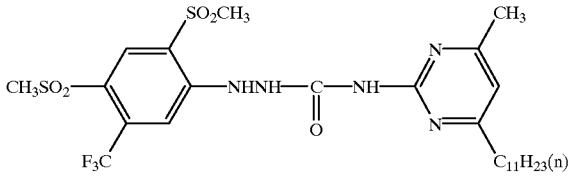
D-(30)
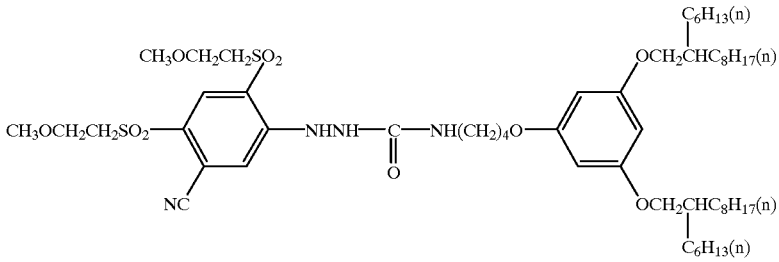
D-(31)
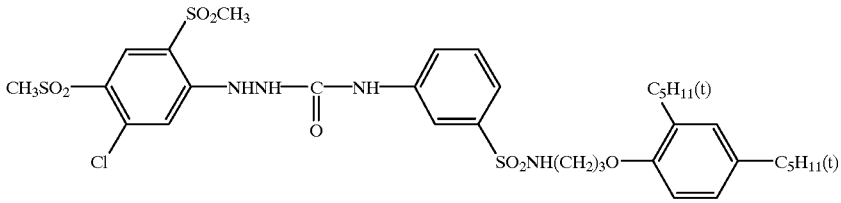
D-(32)
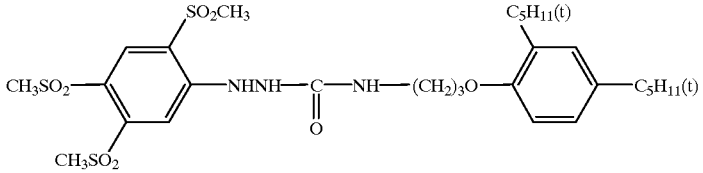
D-(33)
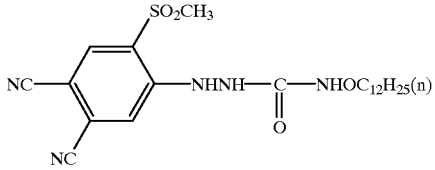
D-(34)
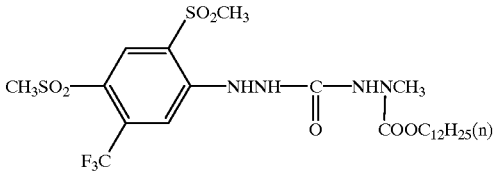
D-(35)
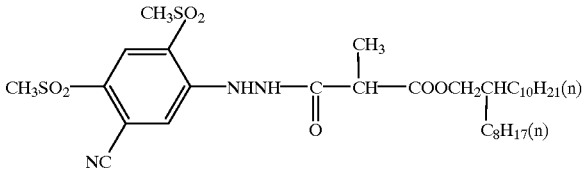

-continued
D-(36)
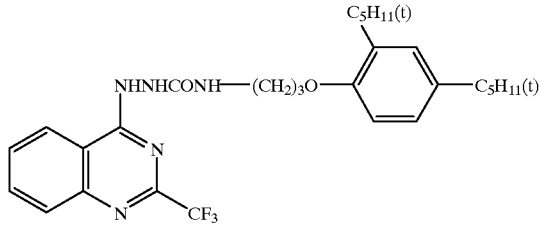
D-(37)
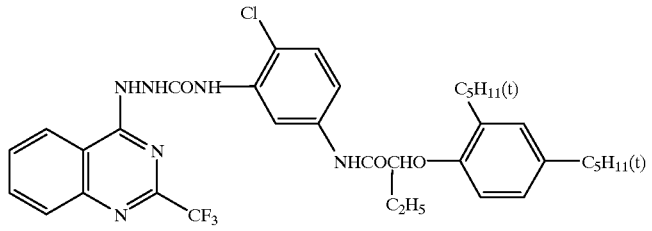
D-(38)
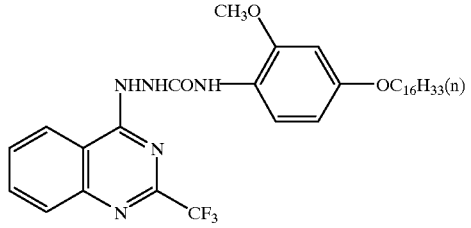
D-(39)
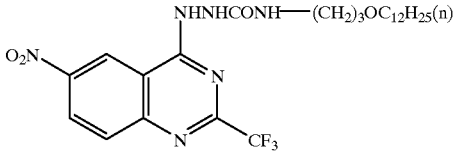
D-(40)
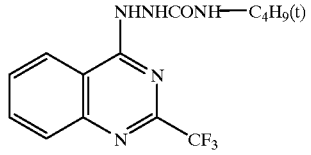
D-(41)
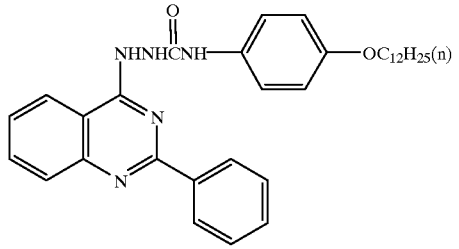
D-(42)
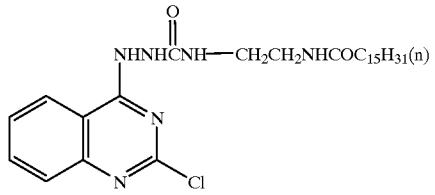

-continued
D-(43)
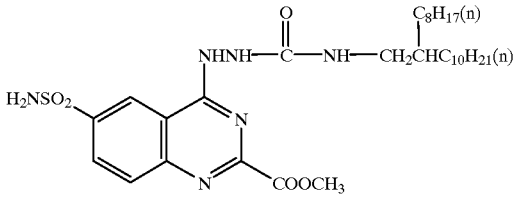
D-(44)
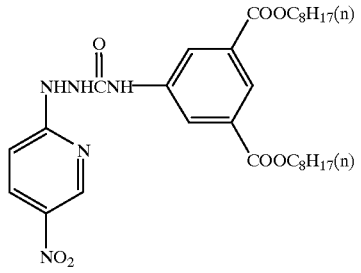
D-(45)
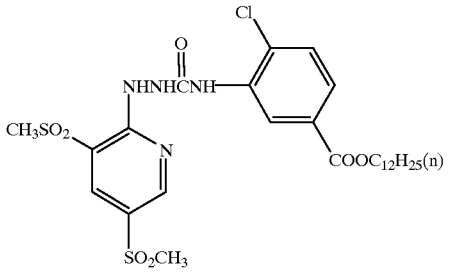
D-(46)
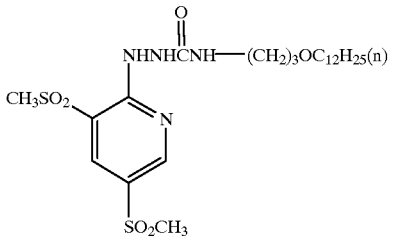
D-(47)
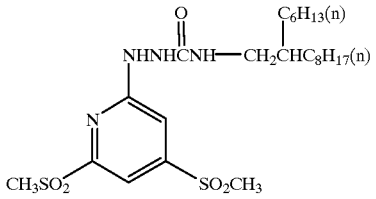
D-(48)
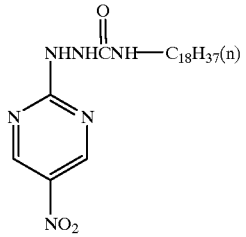

-continued
D-(49)
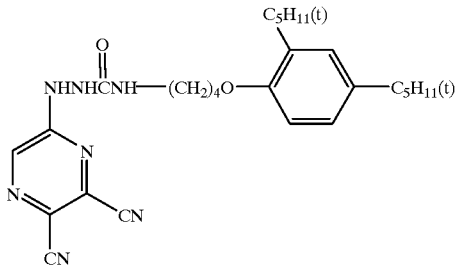
D-(50)
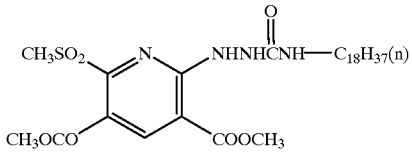
D-(51)
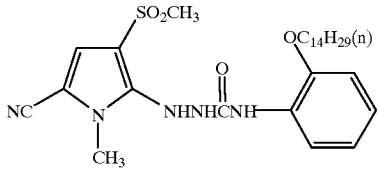
D-(52)
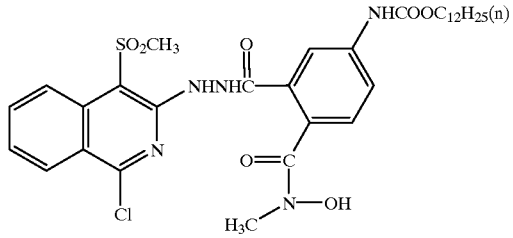
D-(53)
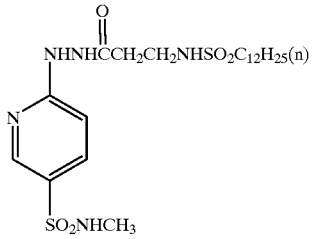
D-(54)
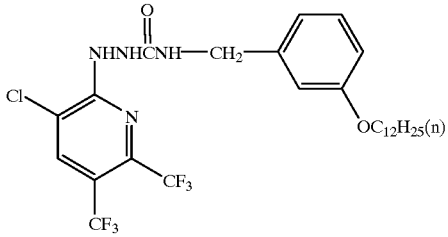
D-(55)
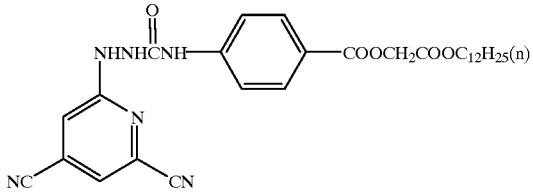

-continued
D-(56)
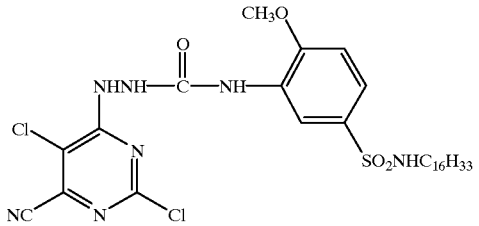
D-(57)
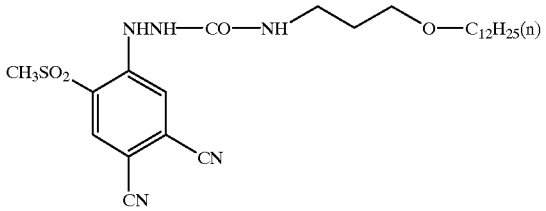
D-(58)
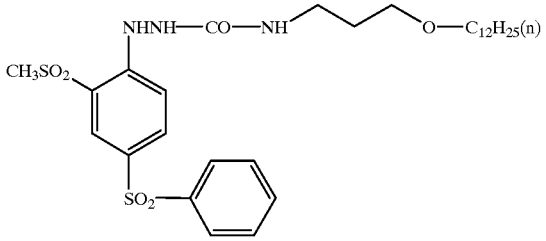
D-(59)
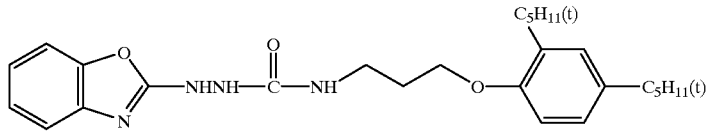
D-(60)
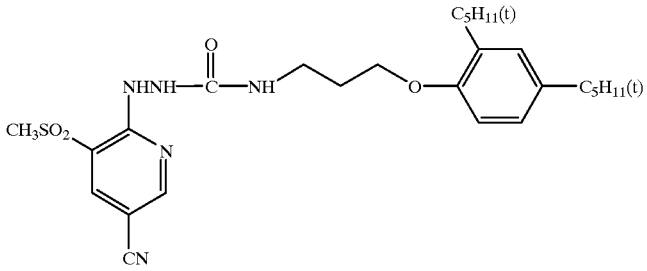
D-(61)
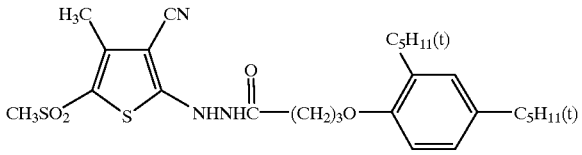
D-(62)
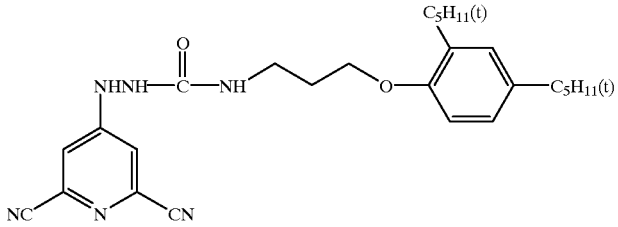

-continued
D-(63)
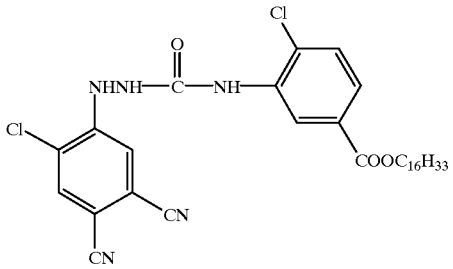
D-(64)
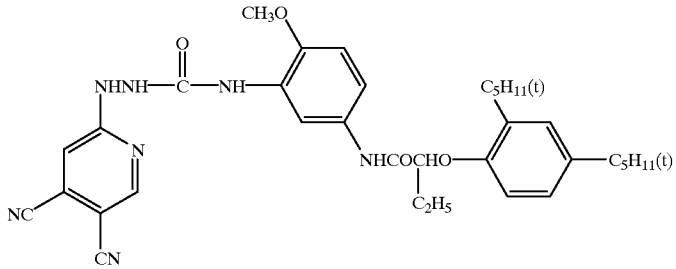
D-(65)
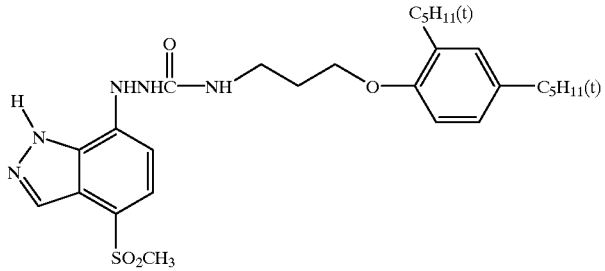
D-(66)
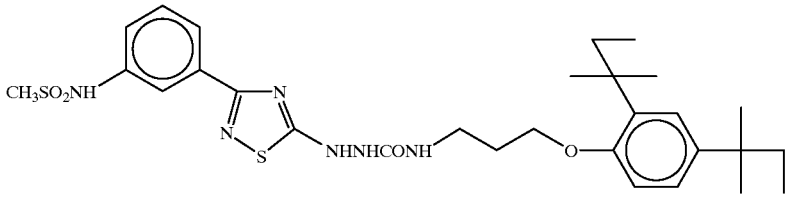
D-(67)
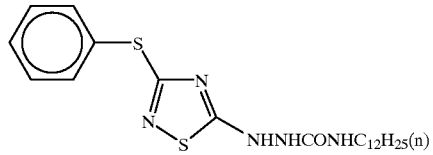
D-(68)
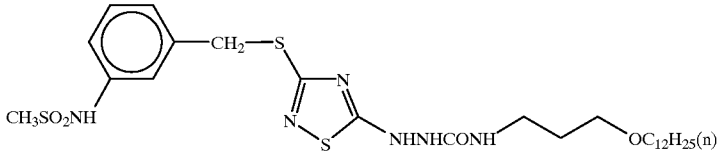
D-(69)
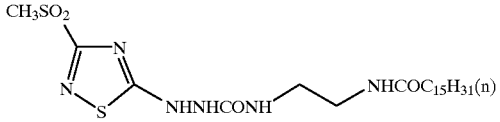

-continued

D-(70)

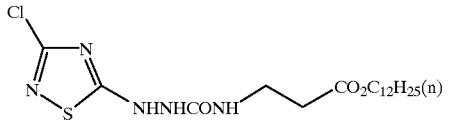

For synthesizing the compounds represented by general formula (1) of the invention, synthesis methods described in JP-A-8-286340 can be used.

Then, general formula (2) is described. In general formula (2), Cβ represents a carbon atom.

EWG represents a cyano group, a carbamoyl group or an alkoxycarbonyl group. Preferred examples of such groups are the same as those described for these groups in general formula (1). Of these, the cyano group is more preferred.

LG represents a group which is released by a coupling reaction with an oxidation product of the developing agent. Preferred examples of the released groups are saturated or unsaturated 5- to 7-membered monocyclic or condensed rings each containing at least one atom of nitrogen, oxygen and sulfur atoms as heteroatoms. Examples thereof include succinimide, maleinimide, phthalimide, diglycollimide, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, 2-imino-1,3,4-thiazolidine-4-one, halogen atoms (for example, chlorine and bromine), aryloxy groups (for example, phenoxy and 1-naphthoxy), heterocyclic oxy groups (for example, pyridyloxy and pyrazolyloxy), acyloxy groups (for example, cyclohexylcarbonyloxy and benzoyloxy), alkoxyl groups (for example, methoxy and ethoxy), carbamoyloxy groups (for example, N,N-didodecylcarbamoyloxy and morpholinocarbonyloxy), aryloxycarbonyloxy groups (for example, phenoxycarbonyloxy), alkoxycarbonyloxy groups, arylthio groups (for example, phenylthio and naphthylthio), heterocyclic thio groups (for example, tetrazolylthio, 1,3,4-thiadiazolylthio, 1,3,4-oxadiazolylthio and benzimidazolylthio), alkylthio groups (for example, methylthio, octylthio and hexadecylthio), alkylsulfonyloxy groups, arylsulfonyloxy groups (for example, benzenesulfonyloxy and toluenesulfonyl-oxy), carbonamido groups (for example, undecylcarbonylamino and phenylcarbonylamino), sulfonamido groups (for example, dodecylsulfonamido and benzenesulfonamido), alkylsulfonyl groups, arylslufonyl groups (for example, benzenesulfonyl), alkylsulfinyl groups (for example, octylsulfinyl), arylsulfinyl groups (for example, benzenesulfinyl) and carbamoyl-amino groups (for example, N-hexadecylcarbamoylamino).

Of these, the aryloxy groups, the heterocyclic oxy groups, the carbamoyloxy groups, the arylthio groups, the heterocyclic thio groups, the alkylsulfonyloxy groups and the arylsulfonyloxy groups are preferred as released groups. Further, the aryloxy groups, the heterocyclic groups and the arylthio groups are more preferred, and the arylthio groups are most preferred.

M represents an atomic group forming a 5-membered aromatic heterocycle together with Cβ. Preferred examples of the atomic groups include pyrrole, imidazole, pyrazole, 1,2,3-triazole, 1,2,4-triazole, tetrazole, 1,3,4-thiadiazole, 1,2,4-thiadiazole, 1,3,4-oxadiazole, 1,2,4-oxadiazole, thiazole, oxazole, isothizole, isoxazole, thiophene, benzoxazole, benzimidazole, benzothiazole and benzoisothiazole rings.

Then, specific examples of the couplers represented by general formula (2) are shown below, but the scope of the invention is not limited to these specific examples.

C-1

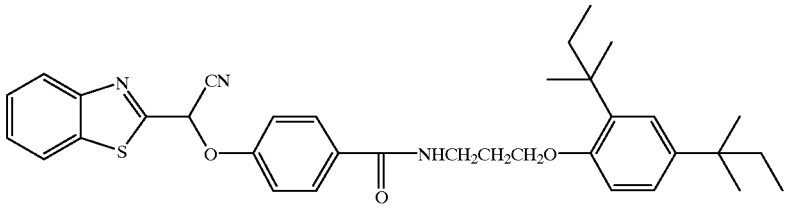

-continued
C-2
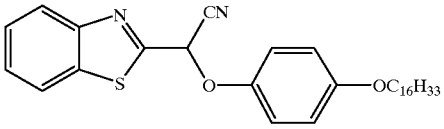
C-3
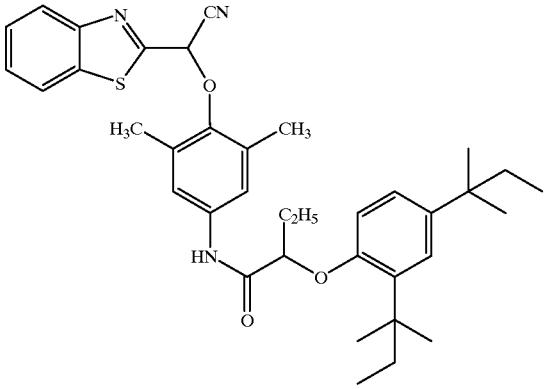
C-4
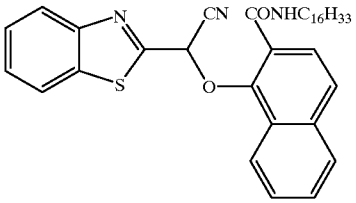
C-5
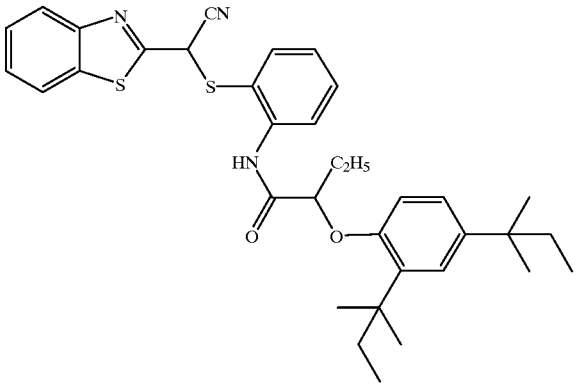
C-6
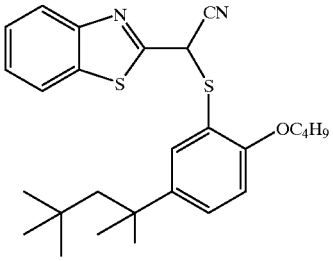
C-7
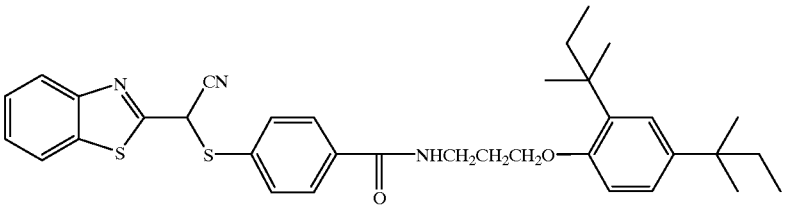
C-8
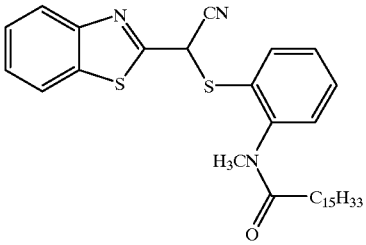
C-9
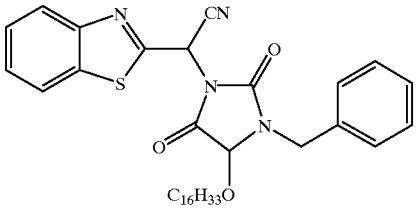

-continued
C-10
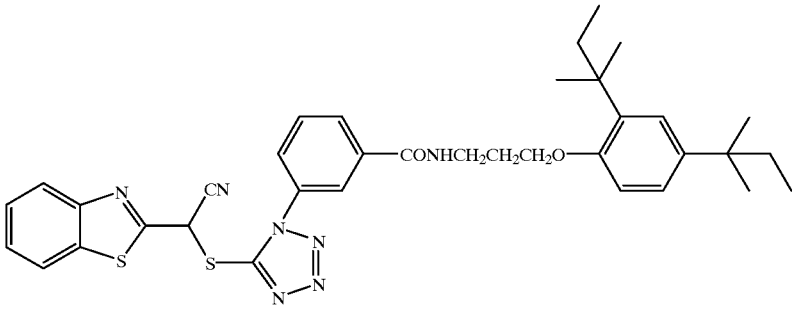
C-11
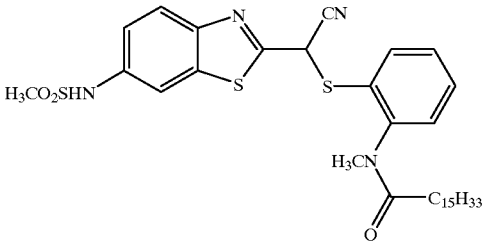
C-12
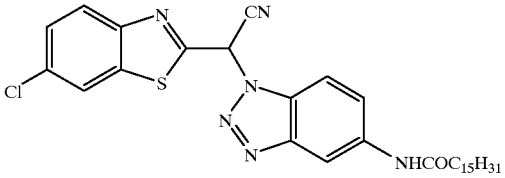
C-13
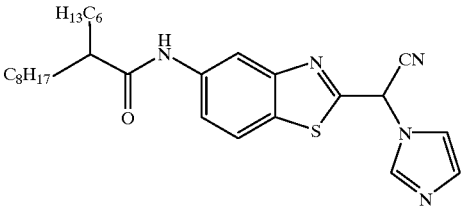
C-14
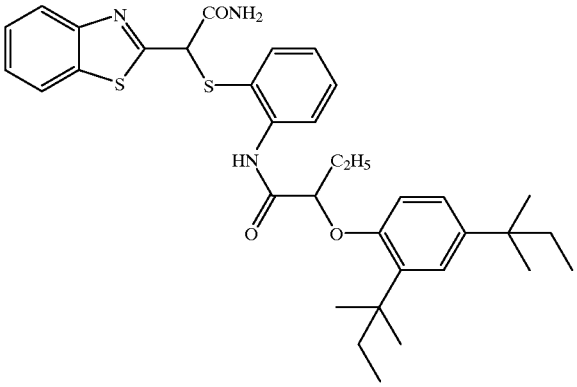
C-15
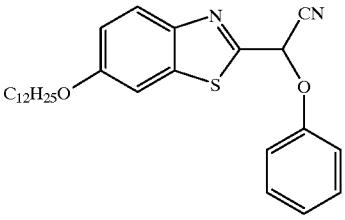
C-16
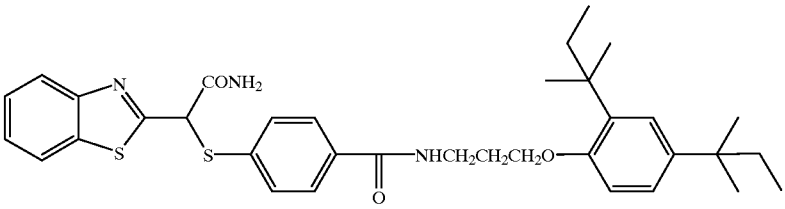

-continued
C-17
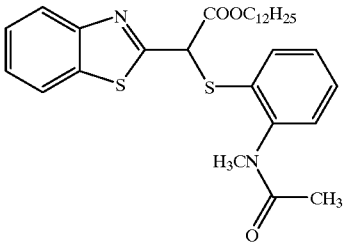
C-18
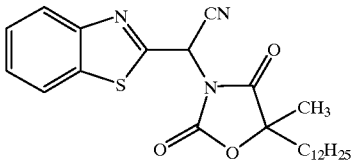
C-19
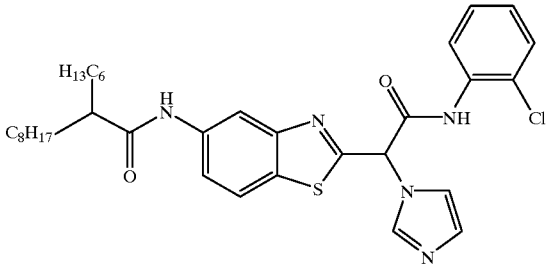
C-20
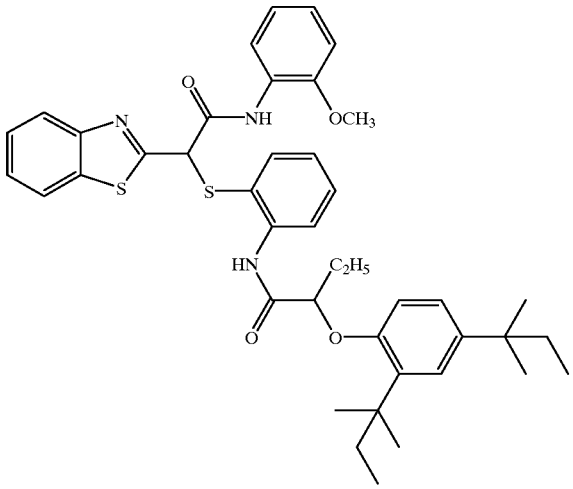
C-21
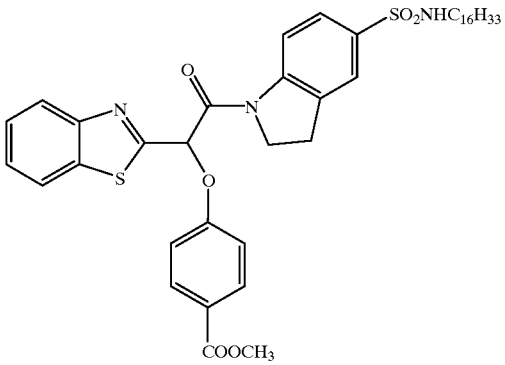
C-22
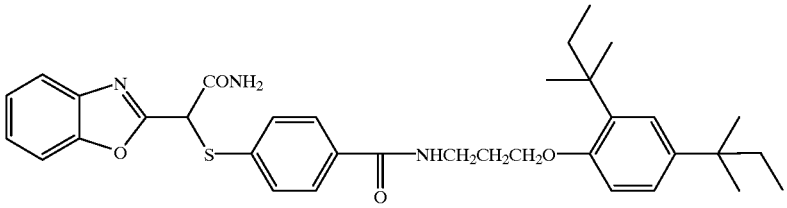

-continued
C-23
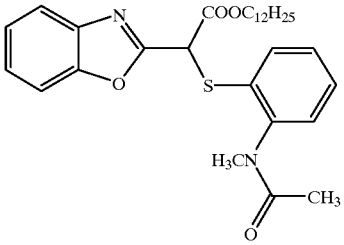
C-24
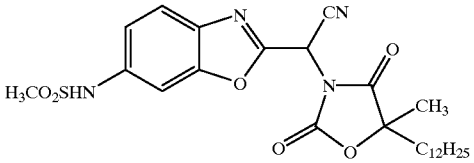
C-25
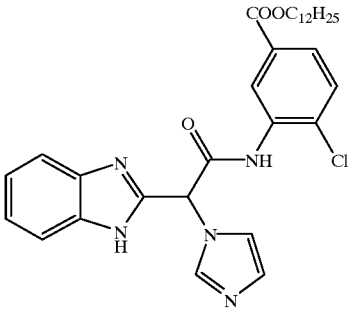
C-26
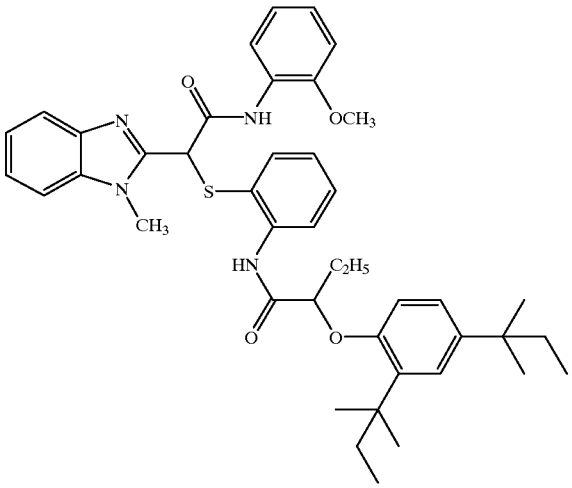
C-27
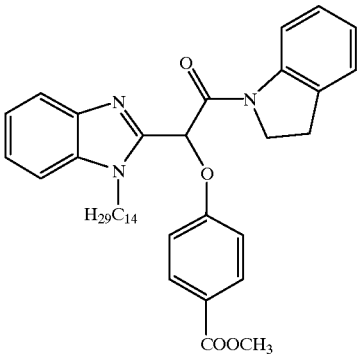
C-28
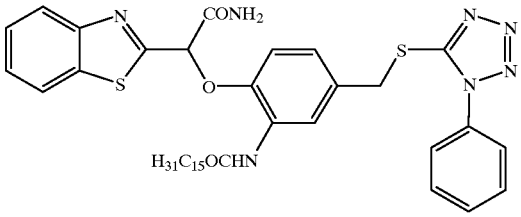
C-29
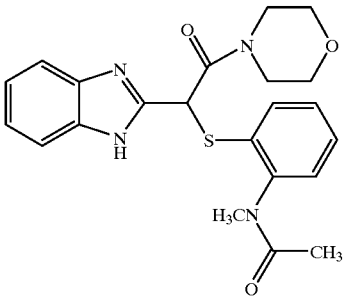
C-30
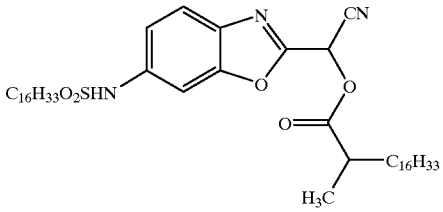

-continued
C-31
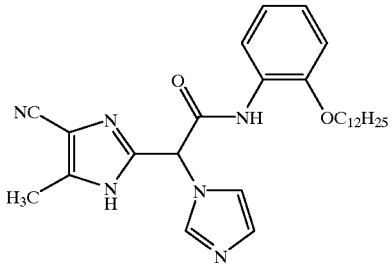
C-32
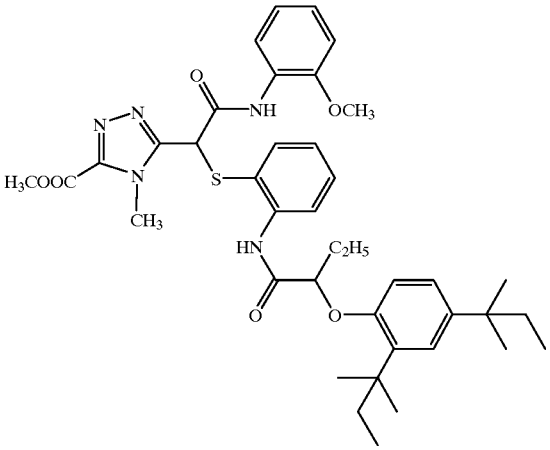
C-33
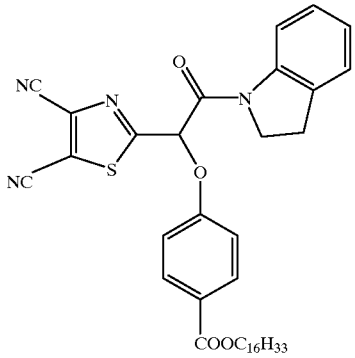
C-34
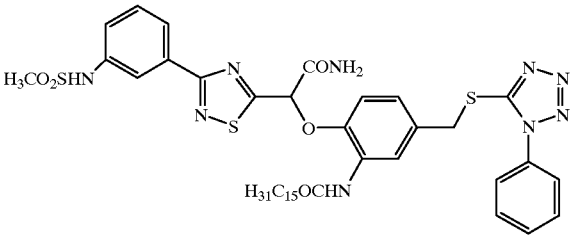
C-35
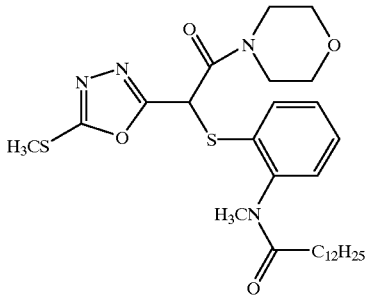
C-36
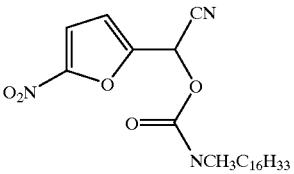

-continued
C-37
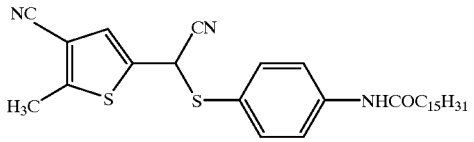
C-38
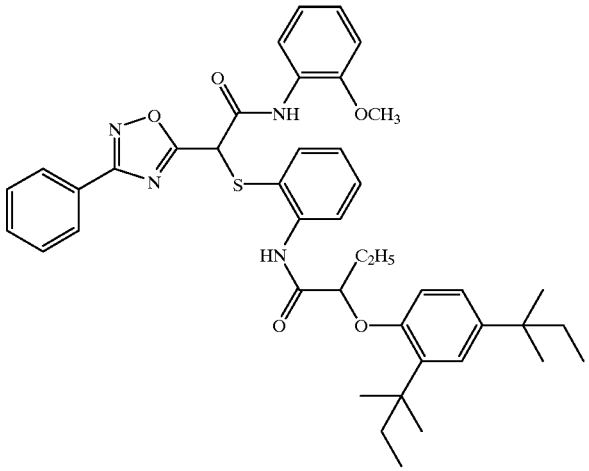
C-39
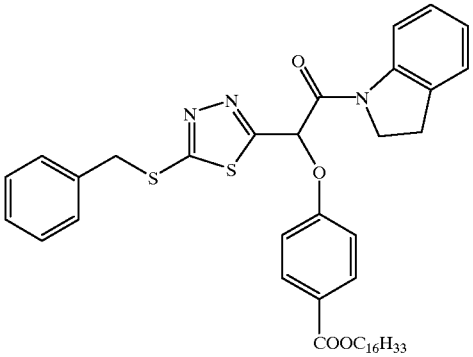
C-40
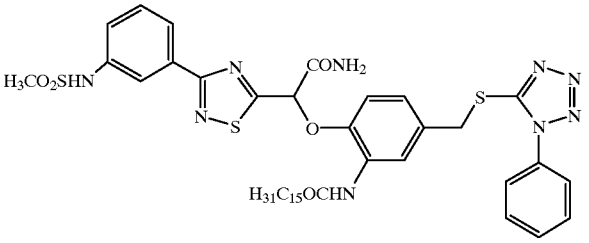
C-41
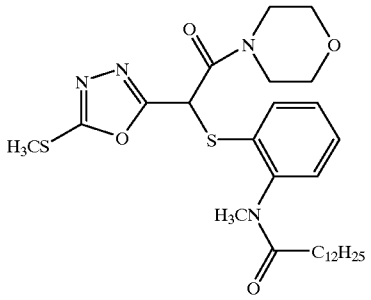
C-42
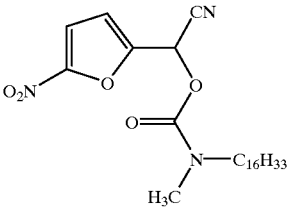

-continued
C-43
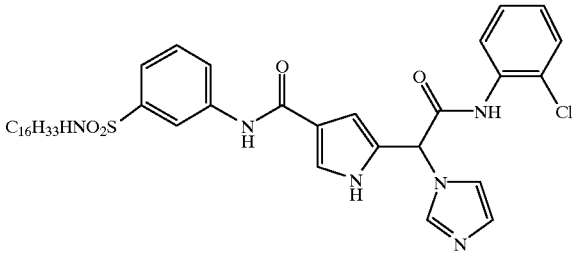
C-44
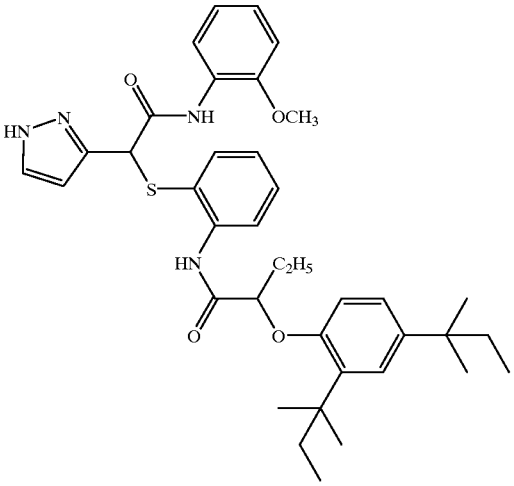
C-45
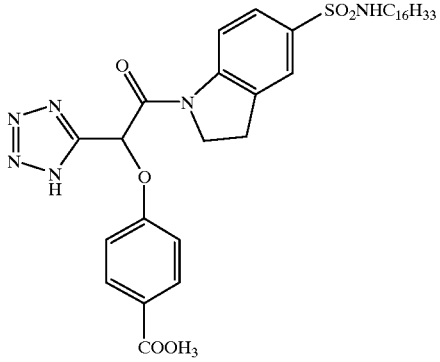
C-46
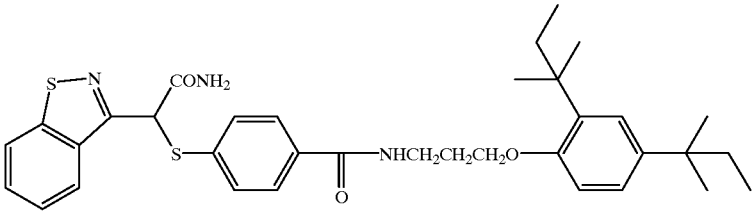

-continued

C-47

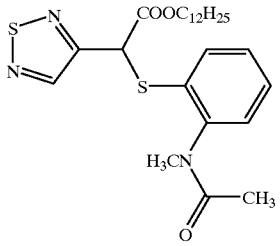

C-48

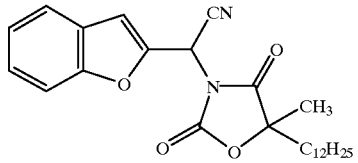

General methods for synthesizing the compounds of the invention are shown below.

Synthesis Example 1

Synthesis of Exemplified Compound D-(66)

Exemplified compound D-(66) can be synthesized with reference to a method described in JP-A-09-152702, and was synthesized based on this method by the following synthesis route.

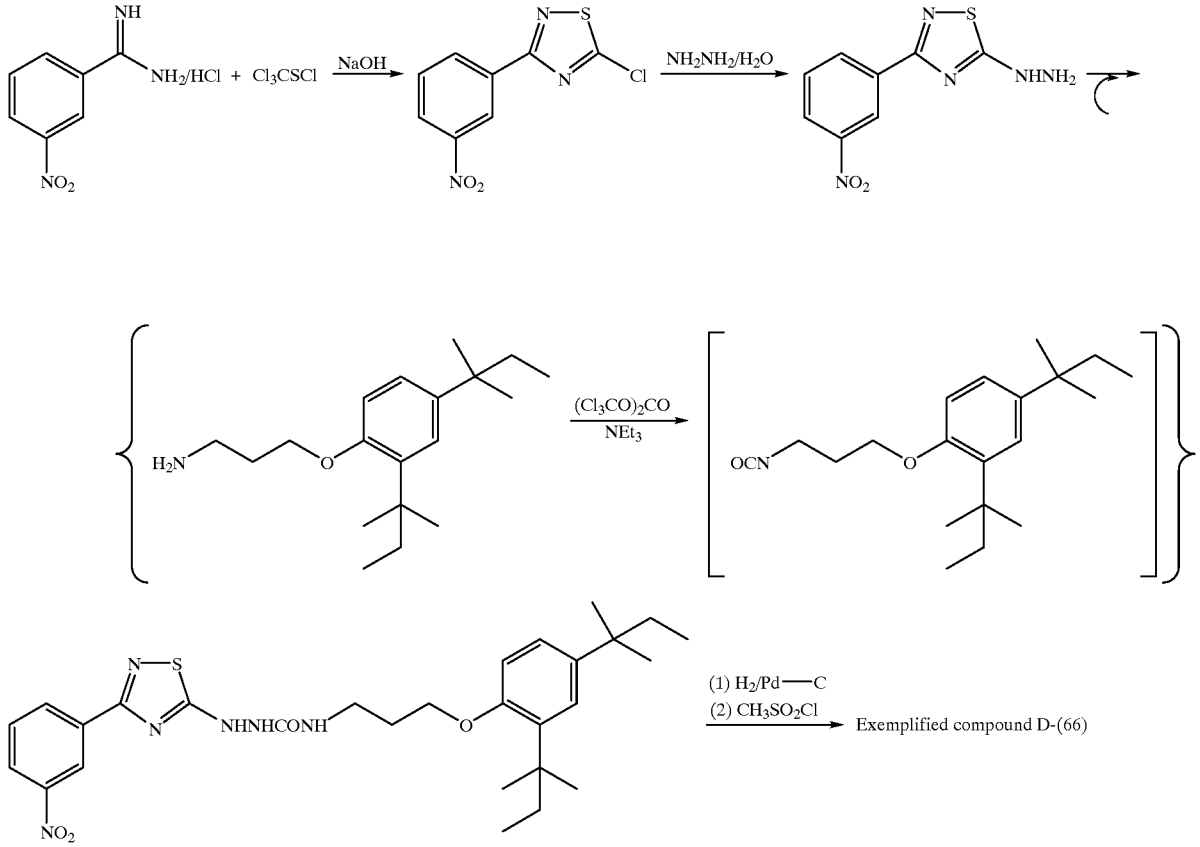

Other compounds can also be synthesized in a manner similar to the method described above.

Synthesis Example 2

Synthesis of Exemplified Compound C-5

Exemplified compound C-5 was synthesized by the following synthesis route.

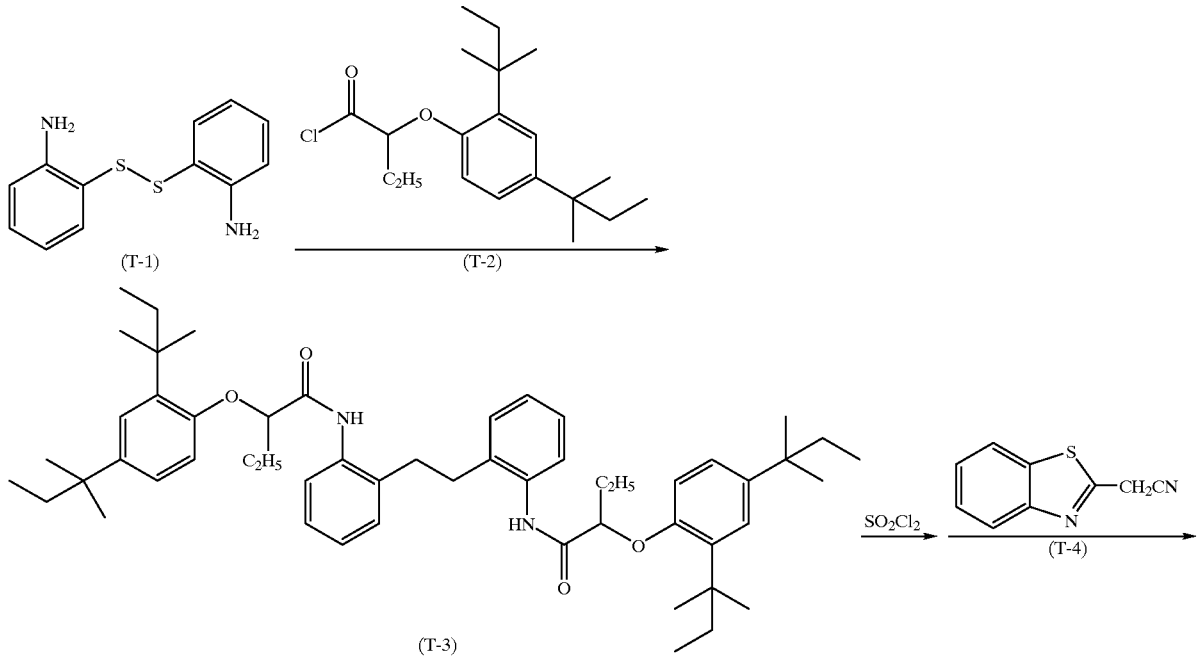

Exemplified compound C-5

Synthesis of Compound (T-3)

In 800 ml of acetonitrile, 49.7 g of compound (T-1) and 150 g of compound (T-2) were suspended, and the resulting suspension was refluxed with heating. After the reaction, the reaction product was cooled to room temperature, and crystals were taken by filtration, followed by washing with 200 ml of acetonitrile and drying. Thus, 156 g (91.4%) of compound (T-3) was obtained as white crystals.

Synthesis of Exemplified Compound C-5

In 300 ml of methylene chloride, 28.2 g of compound (T-3) was dissolved, and 3.6 ml of sulfuryl chloride was further added thereto. After the reaction was conducted for 2 hours, the solvent was removed by distillation under reduced pressure. Then, the residue was dissolved in 50 ml of methylene chloride. Separately, a solution-in which 10.45 g of compound (T-4) was dissolved in 100 ml of dimethylformamide was prepared. The methylene chloride solution was added dropwise thereto at room temperature so as not to allow the internal temperature to exceed 30° C. After the dropping, the reaction was further continued for 1 hour, and the reaction mixture was poured on 500 ml of 1 N hydrochloric acid. An extraction operation with methylene chloride was carried out, followed by recrystallization from acetonitrile. Thus, 39.96 g (82.0%) of exemplified compound C-5 was obtained as light yellow crystals.

The couplers for use in the invention may be used in combination with other couplers. These couplers may be either so-called "4-equivalent couplers" or "2-equivalent couplers" called in the conventional system using developing agents of the p-phenylenediamine family. Specific examples of the couplers are described in detail in *Theory of the Photographic Process,* 4th ed., edited by T. H. James, pages 291 to 334 and 354 to 361, Macmillan, 1977, JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Examples of the couplers for use in the invention and the couplers for use in combination therewith include but are not limited to compounds C-1 to C-80 described in JP-A-08-286340 and compounds C-1 to C-50 described in JP-A-09-152705.

The addition amount of the couplers which are used in the invention depends upon the molar absorption coefficient ($\epsilon$) thereof. However, in order to obtain an image density of 1.0 or more in reflection density, it is suitably from 0.01 to 10 mmol/m$^2$, and more preferably from 0.05 to 5 mmol/m$^2$ as the amount of the couplers coated, when the couplers produce dyes having a molar absorption coefficient ($\epsilon$) of about 5,000 to about 500,000 by coupling.

When the color-developing agent for use in the invention is added to the photographic material, it may be added to any layer (e.g., an emulsion layer, an intermediate layer, etc.). Preferably, it is added to the emulsion layer. When the photographic material has a plurality of emulsion layers, the color-developing agent is preferably added to all of the emulsion layers.

The addition amount of the color-developing agents which are used in the invention is from 0.01 to 10.0 times, preferably from 0.2 to 5 times, the amount of the coupler in terms of the coupler.

In the invention, auxiliary developing agents can be used. The term "auxiliary developing agent" as used herein means a substance which functions as accelerating electron transfer from a color-developing agent to a silver halide in the course of silver halide development. The auxiliary developing agents for use in the invention are-preferably compounds represented by general formulas (B-1) and (B-2) described in JP-A-08-286340. Examples thereof include ETA-1 to ETA-36 described in JP-A-08-286340. Further, compounds represented by general formula (1) described in JP-A-09-146248 are also preferably used. Examples thereof include compound examples D-1 to D-35 described in JP-A-09-146248.

In the invention, blocked photographic reagents which release photographically useful groups in processing can be used. They are described in detail in JP-A-09-152704, pages 41 and 42.

The photographic material of the invention comprises a support basically having thereon a light-sensitive silver halide, a color-developing agent, a coupler and a binder, and may further contain an organic metal salt-oxidizing agent as needed. These components are added to the same single layer in many cases, but can be separately added to different layers as long as they can react with one another.

Hydrophilic additives such as the couplers and the color-developing agents for use in the invention can be introduced into layers of the photographic materials by known methods such as a method described in U.S. Pat. No. 2,322,027. In this case, high boiling organic solvents as described in U.S. Pat. Nos. 4,555,470, 4,536,466, 4,536,467, 4,587,206, 4,555,476 and 4,599,296, and JP-B-3-62256 can be used in combination with low boiling organic solvents having a boiling point of 50° C. to 160° C. if necessary. Two or more of these dye-donating compounds, diffusion-resistant reducing agents and high boiling organic solvents can be used in combination.

The amount of the high boiling organic solvents is 10 g or less, preferably 5 g or less, and more preferably from 1 g to 0.1 g, per gram of compound for color image formation used. Further, it is suitably 1 cc or less, more suitably 0.5 cc or less, and particularly suitably 0.3 cc or less, per gram of binder.

Furthermore, dispersing methods by polymerized products described in JP-B-51-39853 and JP-A-51-59943 and addition methods as fine-grain dispersions described in JP-A-62-30242 and JP-A-63-271339 can also be used.

In the case of compounds substantially insoluble in water, they can be dispersed as fine grains in binders, in addition to the above-mentioned methods.

When the hydrophobic compounds are dispersed in hydrophilic colloids, various surfactants can be used. For example, surfactants described in JP-A-59-157636, pages 37 and 38, and *Research Disclosures* shown in a list given later can be used In the photographic materials of the invention, compounds for attaining stabilization of images as well as activation of development. Specific examples of the compounds preferably used are described in U.S. Pat. No. 4,500,626, columns 51 and 52.

In order-to obtain a wide range of colors on the chromaticity diagram using the three primary colors of yellow, magenta and cyan, at least three silver halide emulsion layers each having light sensitivity in different spectrum regions are used in combination. For example, a combination of the three layers of a blue-sensitive layer, a green-sensitive layer and a red-sensitive layer, or a combination of a green-sensitive layer, a red-sensitive layer and an infrared-sensitive layer is used. The respective layers can be variously disposed in order as known in the usual color photographic materials. Further, each of these respective light-sensitive layers may be divided into two or more layers as needed.

The photographic materials can be provided with various supplementary layers such as protective layers, undercoat layers, intermediate layers, antihalation layers and back layers. Further, in order to improve color separation, various filter dyes can also be added.

Silver halide grains for use in the invention are silver bromide, silver chloride, silver chlorobromide, silver chloroiodide, silver iodobromide and silver chloroiodobromide. Other silver salts such as silver rhodanide, silver sulfide, silver selenide, silver carbonate, silver phosphate and silver salts of organic acids may be contained as additional grains, or as part of each silver halide grain. When it is desired to expedite development-desilverization (bleaching, fixing and bleaching-fixing) processes, silver halide grains having a high silver chloride content are desirable. Further, when development is properly inhibited, it is preferred to use silver halide grains containing silver iodide. The preferred silver iodide content varies depending on the intended photographic material. For example, the silver iodide content is preferably from 0.1 mol % to 15 mol % for X-ray photographic materials, and from 0.1 mol % to 5 mol % for photographic materials for graphic arts and micro photographic materials. In the case of taking photographic materials represented by color negatives, the silver iodide content is preferably from 1 mol % to 30 mol %, more preferably from 5 mol % to 20 mol %, and especially preferably from 8 mol % to 15 mol %. Allowing silver chloride to be contained in silver iodide grains is preferred for relaxing lattice strains.

The silver halide emulsions for use in the invention have distributions or structures in their grains with respect to halogen composition. Typical examples thereof are core-shell type or double-structure grains in each of which the inside differs from the surface in halogen composition, as disclosed in JP-B-43-13162, JP-A-61-215540, JP-A-60-222845 and JP-A-61-75337. Further, a triple structure as described in JP-A-60-222844, or multi-layer structures having more layers than that, not a mere double structure, are available. Furthermore, thin layers of a silver halide different in composition can be attached to the surfaces of the core-shell type or double-structure grains.

For giving the structure into the grains, grains having not only the encapsulated structure as described above, but also a so-called junction structure can be produced. Examples thereof are disclosed in JP-A-59-133540, JP-A-58-108526, EP 199,290 A2, JP-B-58-24772 and JP-A-59-16254. Crystals to be joined are different from host crystals in composition, and can be generated with joining to edges, corners or faces of the host crystals to form the junction structure. Such joined crystals can be formed, even though the host crystals are uniform with respect to halogen composition, or have the core-shell type structure.

In the case of the junction structure, silver salts having no rock salt structure such as silver rhodanide and silver carbonate can be combined with silver halides to form the junction structure, although silver halides can naturally be combined with each other. In addition, nonsilver compounds such as lead oxide may also be used, when they can form the junction structure.

In the case of silver iodobromide grains having these structures, it is preferred that the silver iodide content of core portions is higher than that of shell portions. Conversely, grains in which the silver iodide content of the core portions is low and that of the shell portions is high are preferably used in some cases. Similarly, the grains having the junction structure may be either grains in which the silver iodide content of host crystals is high and that of joined crystals is relatively low, or grains in which the silver iodide content of the host crystals and that of the joined crystals are inversely related. Further, boundaries of the grains having these structures at which the halogen composition varies may be either clear or unclear. Furthermore, grains are also preferred in which the composition is positively continuously changed.

In the case of silver halide grains in which two or more silver halides exist as mixed crystals or with a structure, it is important to control the halogen composition distribution between the grains. A method for measuring the halogen composition distribution between the grains is described in JP-A-60-254032. In particular, a highly uniform emulsion having a coefficient of variation of 20% or less is preferred. Another preferred embodiment is an emulsion in which the grain size and the halogen composition correlate. An example thereof is the case that grains larger in size have a higher iodine content, whereas grains smaller in size have a lower iodine content. The reverse correlation or a correlation in different halogen composition can be selected depending on the purpose. For this purpose, it is preferred that two or more emulsions different in composition are mixed.

It is important to control the silver halide composition in the vicinity of the surface of the grain. The increased content of silver iodide or silver chloride in the vicinity of the surface changes the adsorption of a dye and the rate of development, so that this can be selected according to its purpose. When the halogen composition in the vicinity of the surface is changed, both the structures of encapsulating the entire grain and joining to only part of the grain can be selected. For example, only one face of a tetradecahedral grain comprising (100) and (111) faces is changed in halogen composition, or one of a main plane and a side plane of a tabular grain is changed in halogen composition, in some cases.

The silver halide grains for use in the invention may be either normal crystals free from twin planes or crystals as explained in *Shashin Kogyo no Kiso* (*The Basis of Photographic Industry*), *Ginen Shashin Hen* (*Silver Salt Photography*), page 163, edited by Nippon Shashin Gakkai (Corona Co.) such as single twins each containing one twin plane, parallel multiple twins containing two or more parallel twin planes and non-parallel multiple twins containing two or more non-parallel twin planes. These crystals can be selected for use according to their purpose. Further, U.S. Pat. No. 4,865,964 discloses an example in which grains different in form are mixed, and this method can be selected as needed. In the case of normal crystals, the grains having the cubic form comprising a (100) face, the octahedral form comprising a (111) face and the dodecahedral form comprising a (110) face disclosed in JP-B-55-42737 and JP-A-60-222842 can be used. Furthermore, as reported in *Journal of Imaging Science,* 30, 247 (1986), (h11) face grains represented by (211) face grains, (hh1) face grains represented by (331) face grains, (hk0) face grains represented by (210) face grains and (hk1) face grains represented by (321) face grains can also be selected for use according to their purpose, although it is necessary to contrive methods for preparing them. Grains in each of which two or a number of faces coexist, such as tetradecahedral grains in each of which the (100) and (111) faces coexist, grains in each of which the (100) and (110) faces coexist and grains in each of which the (111) and (110) faces coexist, can also be selected for use according to their purpose.

The value obtained by dividing the diameter of a circle equivalent to a projected area by the grain thickness is called the aspect ratio, which specifies the form of a tabular grain. Tabular grains having an aspect ratio of 1 or more can be used in the invention. The tabular grains can be prepared by methods described in Cleave, *Photography Theory and Practice,* page 131 (1930), Gutoff, *Photographic Science and Engineering,* 14, 248–257 (1970), U.S. Pat. Nos. 4,434,226, 4,414,310, 4,433,048 and 4,439,520, and British Patent 2,112,157. The use of the tabular grains provides the advantages of improved covering power and increased color-sensitizing efficiency with sensitizing dyes, which is described in detail in U.S. Pat. No. 4,434,226 cited above. The mean aspect ratio of 80% or more of the total projected areas of the grains is preferably from 1 to less than 100, more preferably from 2 to less than 20, and most preferably from 3 to less than 10. As the form of the average grain, triangular, hexagonal, circular and quadrilateral forms can be selected. A regular hexagon with six sides approximately equal to one another, as described in U.S. Pat. No. 4,798,354, is a preferred form.

In many cases, the diameter of a circle equivalent to a projected area is used as the grain size of the average grain. Grains having a mean grain size of 0.6 μm or less as described in U.S. Pat. No. 4,748,106 are preferred for enhanced image quality. An emulsion having a narrow grain size distribution as described in U.S. Pat. No. 4,775,617 is also preferred. The limitation of the grain thickness to 0.5 μm or less is preferred in respect to enhanced sharpness, and the limitation to 0.3 μm or less is more preferred. An emulsion highly uniform in thickness, in which the grain thickness has a coefficient of variation of 30% or less, is also preferably used. Furthermore, grains described in JP-A-63-163451, in which the thickness of the grains and the distance between twin planes are specified, are also preferred.

In the case of the tabular grains, observation of dislocation lines under a-transmission type electron microscope is possible. It is preferred that grains each containing no dislocation line at all, grains each containing several dislocation lines, or grains each containing many dislocation lines are selected according to their purpose. Further, grains can be selected in each of which a dislocation line is linearly introduced to a specified direction of crystal orientation of the grain or curvedly introduced. Furthermore, grains can be selected in each of which dislocation is introduced over the entire grain or into only a specified site of the grain, for example, a fringe portion of the grain. The introduction of the dislocation lines is preferred not only in the case of the tabular grains, but also in the case of indeterminate grains represented by normal crystal grains and potato grains. Also in this case, it is preferred that the introduction is limited to specified portions such as vertexes and ridges of the grains.

The silver halide emulsions for use in the invention may be subjected to treatment for rounding the grains as disclosed in European Patent 96,412 B1, or surface modification as described in West German Patent 2,306,447 C2 and JP-A-60-221320.

Although surfaces of the grains are generally flat, it is preferred. depending on the circumstances that unevenness is intentionally formed thereon. Examples thereof include a method of piercing a hole in part of a crystal, for example, a vertex or a center portion of a plane thereof, as described in JP-A-58-106532 and JP-A-60-221320, and ruffle grains described in U.S. Pat. No. 4,643,966.

The grain size of the emulsions for use in the invention can be evaluated by the diameter of a circle equivalent to a projected area determined under an electron microscope, the diameter of a sphere equivalent to a grain volume calculated from the projected area and a grain thickness, or the diameter of a sphere equivalent to a volume determined by the coulter counter method. The grains are selected for use from ultra-fine grains having a grain size of 0.05 μm or less to coarse grains having a grain size of more than 10 μm, calculated as the diameter of a sphere. Grains of 0.1 μm to 3 μm are preferably used as the light-sensitive silver halide grains.

In the invention, either so-called multidisperse emulsions having a wider grain size distribution or monodisperse emulsions having a narrower grain size distribution can be selectively used according to their purpose. In some cases, the coefficient of variation of the diameter of a circle equivalent to a projected area of a grain or that of the diameter of a sphere equivalent to a grain volume is used as a measure of the size distribution. When the monodisperse emulsions are used, the coefficient of variation thereof is preferably 25% or less, more preferably 20% or less, and still more preferably 15% or less.

As to the monodisperse emulsions, the mean-grain size distribution is sometimes specified in terms of the number of grains or the weight. For satisfying the desired gradation of the photographic material, for emulsion layers having substantially identical color sensitivity, two or more kinds of monodisperse silver halide emulsions different in grain size can be mixed in the same layers or separately applied in multiple layers. Further, two or more kinds of multidisperse silver halide emulsions or a monodisperse emulsion and a multidisperse emulsion can also be mixed or applied in multilayers to use them in combination.

In the invention, emulsions containing the above-mentioned grains are used. Here, as one embodiment for carrying out the invention, an embodiment can be employed in which the developing agent of the invention is not used in combination with an emulsion comprising tabular grains having a silver chloride content of 50 mol % or more.

In the photographic emulsions for use in the invention, any of the silver halide emulsions prepared by using methods described in P. Glafkides, *Chimie et Phisigue Photographiaue* (Paul Montel, 1967), G. F. Duffin, *Photographic Emulsion Chemistry* (Focal Press, 1966) and V. L. Zelikman et al., *Making and Coating Photographic Emulsion* (Focal Press, 1964) That is to say, any of an acid process, a neutral process and an ammonia process may be used. A soluble silver salt and a soluble halogen salt may be reacted with each other by using any of a single jet process, a double jet process or a combination thereof. A process in which grains are formed in the presence of excess silver ions (so-called reverse mixing process) can also be used. As a type of double jet process, a process of maintaining the pAg in a liquid phase constant in which a silver halide is formed, that is to say, a so-called controlled double jet process, can also be used. According to this process, a silver halide emulsion having a regular crystal form and an approximately uniform grain size is obtained.

Methods of adding silver halide grains previously precipitated to a reaction vessel for emulsion preparation (U.S. Pat. Nos. 4,334,012, 4,301,241 and 4,150,994) are preferred depending on the circumstances. These grains are used as seed crystals, and are also effectively provided as silver halides for growth. In the latter case, an emulsion having a small grain size is preferably added. An addition method can be selected from addition of the total amount at once, addition of several divided portions and continuous addition. Further, in order to modify the surfaces of the grains, it is also effective to add grains of various silver halides depending on the circumstances.

Methods for converting most or just a part of the halogen composition of silver halide grains by the halogen conversion process are disclosed in U.S. Pat. Nos. 3,477,852 and 4,142,900, European Patents 273,429 and 273,430, and West German Patent Application (OLS) No. 3,819,241, and are effective grain formation methods. A solution of soluble halogen or silver halide grains can be added for conversion to a more insoluble silver salt. These methods can be selected from conversion at once, several divided conversion and continuous conversion.

In addition to methods for allowing grains to grow by adding a soluble silver salt and a halogen salt at a constant concentration at a constant flow rate, methods for forming grains at varied concentrations or at varied flow rates as described in British Patent 1,469,480, U.S. Pat. Nos. 3,650,757 and 4,242,445 are preferred. The amount of the silver halide to be supplied can be varied as a linear function, a secondary function or a more complicated function of addition time by changing the concentration or increasing the flow rate. Depending on the circumstances, it is also preferred that the amount of the silver halide is decreased if necessary. Furthermore, when a plurality of soluble silver salts or a plurality of soluble halogen salts different in solution composition are added, they are also effectively added in such a manner that one is increased and the other is decreased.

A mixer used when a solution of the soluble silver salt and that of a soluble halogen salt are reacted with each other can be. selected from ones described in U.S. Pat. Nos. 2,996,287, 3,342,605, 3,415,650 and 3,785,777, West German Patent Application (OLS) Nos. 2,556,885 and 2,555,364.

For promoting ripening, solvents for silver halides are useful. For example, the presence of an excess amount of halogen ions in a reaction vessel is known to promote ripening. Further, other ripening agents can also be used. The ripening agent can be added in the whole amount to a dispersion medium in a reaction vessel before addition of the halide and silver salts, or can also be introduced into the reaction vessel together with addition of the silver and halide salts or a deflocculant. As another modified embodiment, the ripening agent can also be independently introduced in the stage of addition of the halide and silver salts.

The ripening agents include ammonia, thiocyanates (such as potassium rhodanide and ammonium rhodanide), organic thioether compounds (for example, compounds described in U.S. Pat. Nos. 3,574,628, 3,021,215, 3,057,724, 3,038,805, 4,276,374, 4,297,439, 3,704,130 and 4,782,013 and JP-A-57-104926), thione compounds (for example, 4-substituted thiourea compounds described in JP-A-53-82408, JP-A-55-77737 and U.S. Pat. No. 4,221,863, and compounds described in JP-A-53-144319), mercapto compounds which can accelerate growth of silver halide grains, described in JP-A-57-202531, and amine compounds (for example, compounds described in JP-A-54-100717).

As protective colloids for use in preparing the emulsions of the invention, and as binders for other hydrophilic colloidal layers, gelatin is advantageously used, but other hydrophilic colloids can also be used. Examples of the hydrophilic colloids which can be used include proteins such as gelatin derivatives, graft polymers of gelatin with other polymers, albumin and casein; cellulose derivatives such as hydroxyethyl cellulose, carboxymethyl cellulose and cellulose sulfates; saccharide derivatives of natural compounds such as polysaccharides such as sodium alginate, starch derivatives, gum arabic, dextran and pullulan; and various kinds of synthetic hydrophilic polymers such as homopolymers and copolymers of polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole. Further, high water-absorptive polymers described in U.S. Pat. No. 4,960,681 and JP-A-62-245260, that is to say, copolymers with vinyl monomers having —COOM or —$SO_3M$ (wherein M represents a hydrogen atom or an alkali metal), or copolymers of these vinyl monomers with each other or with other monomers (for example, sodium methacrylate, ammonium methacrylate and Sumikagel L-5H manufactured by Sumitomo Chemical Co, Ltd.), can also be used. These binders can also be used as a combination of two or more of them. Combinations of gelatin and the above-mentioned binders are also preferred.

Gelatin is selected from lime-treated gelatin, acid-treated gelatin and so-called delimed gelatin reduced in content of calcium, and they are also preferably used in combination. Enzyme-treated gelatin as described in *Bull. Soc. Sci. Photo. Japan,* 1, 30 (1966) may be used, and a hydrolyzed or enzymatically decomposed product of gelatin can also be used. The use of low molecular weight gelatin described in JP-A-1-158426 is preferred for the preparation of tabular grains.

In the case of heat developable photographic materials, organic silver salt-oxidizing agents may be used together with the light-sensitive silver halide emulsions. Organic compounds which can be used for formation thereof include benzotriazole compounds, fatty acids and other compounds described in U.S. Pat. No. 4,500,626, columns 52 and 53. Silver acetylide described in U.S. Pat. No. 4,775,613 is also useful. The organic silver salts may be used as a combination of two or more of them.

The organic silver salts described above can be used in combination with the light-sensitive silver halides in an amount of 0.01 mol to 10 mol, preferably 0.01 to 1 mol. per mol of photosensitive silver halide. The total coating amount of the organic silver salts and the photosensitive silver halides coated is from 0.05 $g/m^2$ to 10 $g/m^2$, and preferably from 0.1 $g/m^2$ to 4 $g/m^2$, in terms of silver.

It is preferred that the emulsions for use in the invention are washed with water for desalination and dispersed with freshly prepared protective colloids. The temperature of washing can be selected according to the purpose, but preferably selected within the range of 5° C. to 20° C. The pH in washing can also be selected depending on the purpose, but preferably selected within the range of 2 to 10, more preferably 3 to 8. The pAg in washing can also be selected according to the purpose, but preferably selected within the range of 5 to 10. A method for washing can be selected for use from water washing with noodle, dialysis using semipermeable membranes, centrifugation, coagulation precipitation and ion exchange. The coagulation precipitation can be selected from processes using sulfates, processes using organic solvents, processes using water-soluble polymers and processes using gelatin derivatives.

In the preparation of the emulsions in the invention, for example, in grain formation, in salt removal, in chemical sensitization or before coating, the presence of salts of metal ions are preferred depending on the purpose. When the grains are doped with the metal salts, the metal salts are preferably added in the grain formation. When the metal salts are used for modification of surfaces of the grains or as chemical sensitizers, the metal salts are preferably added after the grain formation and before termination of the chemical sensitization. A method of doping the entire grain and a method of doping only a core portion, a shell portion, an epitaxial portion or a base portion of the grain can be selectively used. Examples of the metals which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals can be added as long as they are in salt forms in which they can be dissolved in forming the grains, such as ammonium salts, acetates, nitrates, sulfates, phosphates, hydroxides, six-coordinate complexes and four-coordinate complexes. Examples of such salts include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. A ligand of the coordination compound can be selected from halo, aquo, cyano, cyanate, thiocyanate, nitrosyl, thionitrosyl, oxo and carbonyl. These metal compounds may be used either alone or a combination of two or more of them.

A method of adding chalcogen compounds during preparation of emulsions as described in U.S. Pat. No. 3,772,031 is sometimes useful. Cyanates, thiocyanates, selenocyanates, carbonates, phosphates and acetates may be allowed to exist, in addition to S, Se and Te.

The silver halide grains according to the invention can be subjected to at least one of sulfur sensitization, selenium sensitization and tellurium sensitization (these three kinds of sensitization processes are generally named "chalcogen sensitization") at any manufacturing stages of the silver halide emulsions. It is preferred to combine two or more kinds of sensitization processes. Various types of emulsions can be prepared depending on the stage at which the grains are subjected to chemical sensitization. There are a type of embedding a chemical sensitizing nucleus in the inside of the grain, a type of embedding the nucleus in a shallow position from a surface of the grain and a type of preparing the nuclei on the surface of the grain. For the emulsions for use in the invention, the place at which the chemical sensitizing nucleus is located can be selected depending upon their purpose. However, it is generally preferred that at least one kind of chemical sensitizing nucleus is formed in the vicinity of the surface of the grain.

Chemical sensitization which can be preferably carried out in the invention is chalcogen sensitization, noble metal sensitization or a combination thereof. It can be conducted using active gelatin as described in T. H. James, *The Photoaraphic Process,* 4th ed., pages 67 to 76, Macmillan (1977) Further, sulfur, selenium, tellurium, gold, platinum, palladium, iridium or a combination of these plural sensitizers can be used at a pAg of 5 to 10 at a pH of 5 to 8 at a temperature of 30° C. to 80° C. as described in *Research Disclosure,* Item 12008 (April, 1974), ibid., Item 13452 (June, 1975), ibid., Item 307105 (November, 1989), U.S. Pat. Nos. 2,642,361, 3,297,446, 3,772,031, 3,857,711, 3,901,714, 4,266,018 and 3,904,415, and British Patent 1,315,755.

In sulfur sensitization, unstable sulfur compounds are used. Specific examples of the unstable sulfur compounds which can be used in the invention include thiosulfates (for example, hypo), thiourea derivatives (for example, diphenylthiourea, triethylthiourea and allylthiourea), rhodanine derivatives, mercapto derivatives, thioamide derivatives, thiohydantoin derivatives, 4-oxooxazolidine-2-thione derivatives, polysulfides, polythionates, elementary sulfur and known sulfur-containing compounds described in U.S. Pat. Nos. 3,857,711, 4,266,018 and 4,054,457. In many cases, sulfur sensitization is used in combination with noble metal sensitization.

The amount of the sulfur sensitizers used for the silver halide grains in the invention is preferably from $1\times10^{-7}$ mol to $1\times10^{-3}$ mol, and more preferably from $5\times10^{-7}$ mol to $1\times10^{-4}$ mol, per mol of silver halide.

In selenium sensitization, known unstable selenium compounds are used. For example, compounds described in U.S. Pat. Nos. 3,297,446 and 3,297,447 can be used. Specific examples thereof include selenium compounds such as colloidal metallic selenium, selenourea derivatives (for example, N,N-dimethylselenourea and tetramethylselenourea), selenoketones (for example, selenoacetone), selenoamides (for example, selenoacetamide), selenocarboxylic acids and esters thereof, isoselenocyanates, selenides (for example, diethyl selenide and triphenylphosphine selenide) and selenophosphates (for example, tri-p-tolyl selenophosphate). In some cases, selenium sensitization is preferably used in combination with sulfur sensitization, noble metal sensitization or both of them.

The amount of the selenium sensitizers used is generally from $1\times10^{-8}$ mol to $1\times10^{-4}$ mol, and preferably from about $1\times10^{-7}$ mol to about $1\times10^{-5}$ mol, per mol of silver halide, although it varies depending on the selenium compound, silver halide grain and chemical ripening conditions used.

As tellurium sensitizers for use in the invention, compounds described in Canadian Patent 800,958, British Patents 1,295,462 and 1,396,696, Japanese Patent Application Nos. 2-333819 and 3-131598 can be used. Specific examples of the tellurium sensitizers include colloidal tellurium, telluro-urea derivatives (for example, tetramethyltellurourea, N-carboxyethyl-N',N'-dimethyltellurourea and N,N'-dimethylethylenetellurourea), isotellurocyanates, telluroketones, telluroamides, tellurohydrazides, telluroesters, phosphine tellurides (for example, tributylphosphine telluride and butyldiisopropylphosphine telluride) and other tellurium compounds (for example, potassium tellurocyanate and telluropentathionate sodium salt).

The amount of the tellurium sensitizers used is from $1\times10^{-7}$ mol to $5\times10^{-2}$ mol, and preferably from about $5\times10^{-7}$ mol to about $1\times10^{-3}$ mol, per mol of silver halide.

In noble metal sensitization, salts of noble metals such as platinum, gold, palladium and iridium can be used. In particular, gold sensitization, palladium sensitization and both of them are preferably used among others. In the case of gold sensitization, known compounds such as chloroauric acid, potassium chloroaurate, potassium aurithiocyanate, gold sulfide and gold selenide can be used. The palladium salts mean divalent or tetravalent palladium salts. Preferred examples of the palladium compounds are represented by $R_2PdX_6$ or $R_2PdX_4$, wherein R represents a hydrogen atom, an alkali metal atom or an ammonium group, and X represents a halogen atom such as chlorine, bromine or iodine.

Specifically, $K_2PdCl_4$, $(NH_4)_2PdCl_6$, $NaPdCl_4$, $(NH_4)_2PdCl_4$, $Li_2PdCl_4$, $Na_2PdCl_6$ or $K_2PdBr_4$ is preferred. The gold compounds and the palladium compounds are preferably used in combination with thiocyanates or selenocyanates.

The emulsions for use in the invention are preferably subjected to gold sensitization. The amount of the gold sensitizers is preferably from $1\times10^{-7}$ mol to $1\times10^{-3}$ mol, and more preferably from $5\times10^{-7}$ mol to $1\times10^{-3}$ mol, per mol of silver halide. The amount of the palladium compounds is preferably within the range of $5\times10^{-7}$ mol to $1\times10^{-3}$ mol per mol of silver halide. The amount of the thiocyanate or the selenocyanates is preferably within the range of $1\times10^{-6}$ mol to $5\times10^{-2}$ mol per mol of silver halide.

It is preferred that the silver halide emulsions used in the invention are subjected to reduction sensitization during grain formation, after grain formation and before or during chemical sensitization, or after chemical sensitization.

For reduction sensitization as used herein, any of methods of adding reduction sensitizers to the silver halide emulsions, methods of conducting growth or ripening in an atmosphere of a low pAg of 1 to 7 which is called silver ripening, and methods of conducting growth or ripening in an atmosphere of a high pH of 8 to 11 which is called high pH ripening can be selected. Further, two or more of them can also be used in combination.

The methods of adding the reduction sensitizers are preferred, because the level of reduction sensitization can be precisely controlled.

As the reduction sensitizers, known reduction sensitizers such as stannous salts, ascorbic acid and derivatives thereof, amines and polyamines, hydrazine and derivatives thereof, formaminedisulfinic acids, silane compounds and borane compounds can be selectively used. Further, two or more of the compounds can also be used in combination. Stannous chloride, aminoiminomethanesulfinic acid (commonly called thiourea dioxide), dimethylamine borane, ascorbic acid and derivatives thereof are preferred as the reduction sensitizers. The amount of the reduction sensitizers added is required to be selected because it depends on the emulsion manufacturing conditions. However, it is suitably within the range of $1\times10^{-7}$ mol to $1\times10^{-3}$ mol per mol of silver halide.

The chemical sensitization can also be carried out in the presence of so-called chemical sensitizing assistants. As the useful chemical sensitizing assistants, compounds are used which are known to inhibit fogging and to enhance the sensitivity in the course of chemical sensitization, such as azaindene, azapyridazine and azapyrimidine. Examples of the chemical sensitizing assistants are described in U.S. Pat. Nos. 2,131,038, 3,411,914 and 3,554,757, JP-A-58-126526 and G. F. Duffin, *Photographic Emulsion Chemistry,* pages 138 to 143, described above.

Oxidizing agents to silver are preferably used in the production of the emulsions for use in the invention. The oxidizing agents to silver mean compounds having the function of reacting with metallic silver to convert it to a silver ion. In particular, compounds are effective which convert to silver ions extremely fine silver grains produced as a by-product in the course of formation of the silver halide grains and chemical sensitization. The silver ions produced here may form either silver salts slightly soluble in water such as silver halides, silver sulfide and silver selenide, or silver salts easily soluble in water such as silver nitrate. The oxidizing agents to silver may be inorganic compounds or organic compounds. Examples of the inorganic oxidizing agents include ozone; hydrogen peroxide and adducts thereof (for example, $NaBO_2.H_2O_2.H_2O$, $2NaCO_3.H_2O_2$, $Na_4P_2O_7.H_2O_2$ and $2Na_2SO_4.H_2O_2.2H_2O$); oxygen acid salts such as peroxy acid salts (for example, $K_2S_2O_8$, $K_2C_2O_6$ and $K_2P_2O_8$), peroxy complex compounds (for example, $K_2[Ti(O_2)C_2O_4].3H_2O$, $4K_2SO_4.Ti(O_2)OH.SO_4.2H_2O$ and $Na_3[VO(O_2)(C_2O_4)_2].6H_2O$), permanganates (for example, $KMnO_4$) and chromates (for example, $K_2CrO_7$); halogen elements such as iodine and bromine; perhalogenates (for example, potassium periodate); salts of high valent metals (for example, potassium hexacyanoferrate (II)); and thiosulfonates.

Further, examples of the organic oxidizing agents include quinones such as p-quinone; organic peroxides such as peracetic acid and perbenzoic acid; and compounds releasing active halogen (for example, N-bromsuccinimide, chloramine T and chloramine B).

The oxidizing agents for use in the invention are preferably ozone, hydrogen peroxide and adducts thereof, halogen atoms, inorganic oxidizing agents of thiosulfonates and organic oxidizing agents of quinones. The oxidizing agents to silver are preferably used in combination with the above-mentioned reduction sensitization. A method of applying the reduction sensitization after the use of the oxidizing agents, a method of using the oxidizing agents after the reduction sensitization, or a method of allowing both the oxidizing agents and the reduction sensitizers to coexist at the same time can be selectively used. These methods can be selectively used either in the grain formation stage, or in the chemical sensitization stage.

Various compounds can be added to the photographic emulsions for use in the invention for preventing fog in the production stage of the photographic materials, or during storage or photographic processing thereof, or for stabilizing photographic characteristics. That is to say, many compounds known as the antifoggants and stabilizers can be added, such as thiazoles, for example, benzothiazolium salts, nitroimidazoles, nitrobenzimidazoles, chlorobenzimidazoles, bromobenzimidazoles, mercaptothiazoles, mercapto-benzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), mercaptopyrimidines, mercaptotriazines, thioketo compounds such as oxazolinethione, and azaindene compounds, for example, triazaindenes, tetraazaindenes (particularly, 4-hydroxy-6-methyl-1,3,3a,7-tetraazaindene) and pentaaza-indenes. For example, compounds described in U.S. Pat. Nos. 3,954,474 and 3,982,947 and JP-B-52-28660 can be used. One of the preferred compounds is described in Japanese Patent Application No. 62-47225. The antifoggants and stabilizers can be added at various times, for example, before, during or after grain formation, during washing, in dispersing after washing, before, during or after chemical sensitization, or before coating, according to their purpose. They can be used for many purposes of controlling crystal habit of the grains, decreasing the grain size, reducing the solubility of the grains, controlling chemical sensitization and controlling the arrangement of dyes, besides exhibiting the original antifogging and stabilizing effects by addition of them during the preparation of the emulsions.

When the color sensitivities, the green sensitivity, the red sensitivity and the infrared sensitivity, are given to the light-sensitive silver halides for use in the invention, the light-sensitive silver halide emulsions are spectrally sensitized with methine dyes and the like. Further, blue-sensitive emulsions may be spectrally sensitized in a blue region as needed.

The dyes include cyanine dyes, merocyanine dyes, complex cyanine dyes, complex merocyanine dyes, holopolar cyanine dyes, hemicyanine dyes, styryl dyes and hemioxanol dyes. Particularly useful dyes are dyes belonging to the cyanine dyes, the merocyanine dyes and the complex merocyanine dyes. Any nuclei usually utilized in cyanine dyes as basic heterocyclic ring nuclei can be applied to these dyes. That is to say, pyrroline, oxazoline, thiazoline, pyrrole, oxazole, thiazole, selenazole, imidazole, tetrazole and pyridine nuclei, nuclei in which alicyclic hydrocarbon rings are fused together with these nuclei, and nuclei in which aromatic hydrocarbon rings are fused together with these nuclei, namely, 5- to 64-hydroxy-6-methyl-heterocyclic ring nuclei such as indolenine, benzoindolenine, indole, benzoxazole, naphthoxazole, benzothiazole, naphthothiazole, benzoselenazole and benzimidazole, rhodanine and thiobarbituric acid nuclei, can be applied. These nuclei may be substituted on carbon atoms. Specific examples thereof include sensitizing dyes described in U.S. Pat. No. 4,617,257, JP-A-59-180550, JP-A-64-13546, JP-A-5-45828 and JP-A-5-45834.

To the merocyanine dyes and the complex merocyanine dyes, 5- and 6-membered heterocyclic ring nuclei such as pyrazoline-5-one, thiohydantoin, 2-thiooxazolidine-2,4-dione, thiazolidine-2,4-dione, rhodanine and thiobarubituric acid nuclei can be applied as nuclei having the keto-methylene structure.

These dyes may be used either alone or in combination. The combinations of the sensitizing dyes are often used, particularly for supersensitization and wavelength adjustment of spectral sensitivity. Typical examples thereof are described in U.S. Pat. Nos. 2,688,545, 3,397,060, 2,977,229, 3,522,052, 3,617,293, 3,628,964, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-109925.

The emulsions may contain dyes having no spectral sensitizing action themselves or compounds which do not substantially absorb visible light and exhibit supersensitization (for example, ones described in U.S. Pat. No. 3,615,641 and JP-A-63-23145), together with the sensitizing dyes.

These sensitizing dyes may be added to the emulsions at any stage of the emulsion preparation which has hitherto been known to be useful.

Most usually, the sensitizing dyes are added after completion of chemical sensitization and before coating. However, the sensitizing dyes and chemical sensitizers can be concurrently added to conduct spectral sensitization and chemical sensitization at the same time, as described in U.S. Pat. Nos. 3,628,969 and 4,225,66. Further, the sensitizing dyes can be added prior to chemical sensitization, as described in JP-A-58-113928, and they can also be added before completion of precipitation formation of the silver halide grains to initiate spectral sensitization. Further, according to U.S. Pat. Nos. 4,183,756 and 4,225,666, they may be added before or after nucleus formation of the silver halide grains, and it is also possible to add the divided composition so as to add part of the compound prior to chemical sensitization and the remainder thereof after chemical sensitization.

These sensitizing dyes and supersensitizers may be added as solutions in organic solvents such as methanol, dispersions in gelatin or surfactant solutions.

The sensitizing dyes can be added in an amount of about $4\times10^{-6}$ mol to about $8\times10^{-3}$ mol per mol of silver halide. However, when the size of the silver halide grains ranges from 0.2 to 1.2 $\mu$m, which is more preferred, the sensitizing dyes are effectively added in an amount of about $5\times10^{-5}$ mol to about $2\times10^{-3}$ mol per mol of silver halide.

Although the above-mentioned various additives are used in the photographic materials in respect to this technique, various additives other than these can be used according to their purpose.

These additives are described in *Research Disclosure,* Item 17643 (December, 1978), ibid., Item 18716 (November, 1979) and ibid., Item 307105 (November, 1989) in greater detail, and corresponding portions thereof are summarized in the following table.

| | Kind of Additive 307105 | RD 17643 | RD 18716 | RD |
|---|---|---|---|---|
| 1. | Chemical Sensitizers | p. 23 | p. 648, right column | p. 996 |
| 2. | Sensitivity Increasing Agents | | p. 648, right column | |
| 3. | Spectral Sensitizers, Supersensitizers | pp. 23–24 | p. 648, right column to p. 649, right column | p. 996 to p. 998 |
| 4. | Brightening Agents | p. 24 | p. 647, right column | p. 998 |
| 5. | Light Absorbers, Filter dyes, UV Absorbers | pp. 25–26 | p. 649, right column to p. 650, left column | p. 1003 |
| 6. | Binders | p. 26 | p. 651 | p. 1003 to p. 1004 |
| 7. | Plasticizers, Lubricants | p. 27 | p. 650 | p. 1006 |
| 8. | Coating Aids, Surfactants | pp. 26–27 | p. 650 | p. 1005, left to p. 1006, right |
| 9. | Antistatic Agents | p. 27 | p. 650 right column | p. 1006 to p. 1007 |

-continued

| Kind of Additive 307105 | RD 17643 | RD 18716 | RD |
|---|---|---|---|
| 10. Antifoggants, Stabilizers column | pp. 24–25 | p. 649 | p. 998 to p. 1000 |
| 11. Stain Inhibitors | p. 25, right column | p. 650, left to right | |
| 12. Dye Image Stabilizers | p. 25 | | |
| 13. Hardeners | p. 26 | p. 651, left column | p. 1004, right to p. 1005, left |

The hardeners include hardeners described in U.S. Pat. No. 4,678,739, column 41, U.S. Pat. No. 4,791,042, JP-A-59-116655, JP-A-62-245261, JP-A-61-18942 and JP-A-4-218044, as well as the above one. More specifically, examples thereof include aldehyde hardeners (such as formaldehyde), aziridine hardeners, epoxy hardeners, vinylsulfone hardeners (such as N,N'-ethylene-bis (vinylsulfonylacetamido)ethane), N-methylol hardeners (dimethylolurea) and polymer hardeners (compounds described 2in JP-A-62-234157).

These hardeners are used in an amount of 0.001 g to 1 g, and preferably in an amount of 0.005 g to 0.5 g, per gram of gelatin coated. They may be added to any of the layers constituting the photographic materials and dye-fixing materials, and each of them may be divided into two or more parts, which are added to two or more layers, respectively.

Matte agents may be used in the photographic materials of the invention for preventing adhesion, improving slipperiness and delustering surfaces of the materials. The matte agents include compounds described in JP-A-63-274944 and JP-A-63-274952, such as benzoguanamine resin beads, polycarbonate resin beads and AS resin beads, as well as compounds described in JP-A-61-88256, page 29, such as silicon dioxide, polyolefins and polymethacrylates. In addition, compounds described in *Research Disclosures* stated above can be used. These matte agents can be added not only to the uppermost layers (protective layers), but also to lower layers as needed.

Besides, the layers constituting the photographic materials of the invention may contain heat solvents, defoaming agents, bactericides, antifungal agents and colloidal silica. Specific examples of these additives are described in JP-A-61-88256, pages 26 to 32, JP-A-3-11338 and JP-B-2-51496.

In the layers constituting the photographic materials of the invention, various surfactants can be used for assisting coating, improving separation, improving slipperiness, preventing electric charge, and accelerating development. Specific examples of the surfactants are described in *Reseach Disclosures* stated above, JP-A-62-173463 and JP-A-62-183457. In the case of the heat developable photographic materials, organic fluoro compounds are also preferably contained for improving slipperiness, preventing electric charge and improving separation. Typical examples of the organic fluoro compounds include fluorine surfactants described in JP-B-57-9053, columns 8 to 17, JP-A-61-20944 and JP-A-62-135826, and hydrophobic fluorine compounds such as oily fluorine compounds (for example, fluorine oil) and solid fluorine compounds (for example, ethylene tetrafluoride resins).

In the photographic materials of the invention, known antifading agents can be used. Typical examples of organic antifading agents include hindered phenols such as hydroquinones, 5-hydroxychromans, 5-hydroxycoumarans, p-alkoxyphenols and bisphenols, gallic acid derivatives, methylenedioxybenzenes, aminophenols, hindered amines, and ether or ester derivatives obtained by silylating or alkylating phenolic hydroxyl groups of these compounds. Further, metal complexes represented by (bissalicylaldoximato)nickel complexes and (bis-N,N-dialkyldithiocarbamato)nickel complexes can also be used.

For preventing deterioration of yellow dye images caused by heat, humidity and light, compounds each having both moiety structures of a hindered amine and a hindered phenol in the same molecule as described in U.S. Pat. No. 4,268,593 give good results. Further, for preventing deterioration of magenta dye images, particularly deterioration caused by light, spiroindans described in JP-A-56-159644 and chromans substituted by hydroquinone diethers or monoethers described in JP-A-55-89835 provide good results.

In the layers constituting the photographic materials of the invention, various antifoggants or photographic stabilizers and precursors thereof can be used. Specific examples thereof include compounds described in *Research Disclosures* stated above, U.S. Pat. Nos. 5,089,378, 4,500,627 and 4,614,702, JP-A-64-13546, pages 7 to 9, 57 to 71 and 81 to 97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650 and *Research Disclosure,* No. 17643 (1978), pages 24 and 25.

These compounds are preferably used in an amount of $5\times10^{-6}$ mol to $1\times10^{-1}$ mol, more preferably $1\times10^{-5}$ mol to $1\times10^{-2}$ mol, per mol of silver.

Suitable supports which can be used in the invention include synthetic plastic films of polyolefins such as polyethylene and polypropylene, polycarbonates, cellulose acetate, polyethylene terephthalate, polyethylene naphthalate and polyvinyl chloride, paper supports such as photographic raw paper, printing paper, baryta paper and resin-coated paper, supports in which the above-mentioned plastic films are provided with reflective layers, and supports described in JP-A-62-253159, pages 29 to 31.

Supports described in *Research Disclosure,* No. 17643, page 28, ibid., No. 18716, page 647, right column to page 648, left column, and ibid., No. 307105, page 879, which are stated above, can also be preferably used. These supports can be subjected to heat treatment at a temperature of Tg or lower, thereby making it difficult to have the habit of curling. Further, surfaces of these supports may be subjected to surface treatment for improving adhesion between the supports and emulsion undercoat layers. In the invention, glow discharge treatment, corona treatment or flame treatment can be used as the surface treatment.

Further, supports described in *Kochi Gilutsu,* No. 5, pages 44 to 149, published by Azutech Co., Ltd. (Mar. 22, 1991) can also be used.

Transparent supports such as polyethylene naphthalenedicarboxylate supports and supports in which these supports are coated with transparent magnetic substances can also be used.

In the heat developable photographic materials, various development stoppers can be used for obtaining always constant images against fluctuations in processing temperature and processing time on development. The development stopper as used herein is a compound which, after normal development, rapidly neutralizes or reacts with a base to reduce the concentration of the base contained in a film, thereby stopping development, or a compound which interacts with silver and a silver salt to inhibit development. Specific examples thereof include acid precursors releasing acids by heating, electrophilic compounds which conduct the replacement reaction with coexisting bases by heating, nitrogen-containing heterocyclic compounds, mercapto compounds and precursors thereof. More specifically, they are described in JP-A-62-253159, pages 31 and 32.

When the photographic materials of the invention are used as the heat developable photographic materials, methods of generating bases from base precursors are preferred as methods for supplying the bases.

As the base precursors used in the invention, compounds undergoing some reaction by heating to release bases, such as salts of organic acids and bases which are decarboxylated by heat and compounds releasing amines by the intramolecular nucleophilic displacement reaction, the Lossen rearrangement or the Beckmann rearrangement, and compounds generating bases by electrolysis or the complex formation reaction are preferably used. The former base precursors generating the bases by heating include salts of trichloroacetic acid described in British Patent 998,959. The precursors further improved in their stability include salts of $\alpha$-sulfonylacetic acid described in U.S. Pat. No. 4,060,420, salts of propiolic acid described in Japanese Patent Application No. 58-55700, 2-carboxycarboamide derivatives described in U.S. Pat. No. 4,088,496, salts of bases with heat decomposable acids, using alkali metals or alkali earth metals, as well as organic salts, as the base components (Japanese Patent Application No. 58-69597), hydroxamcarbamates obtained by utilizing the Lossen rearrangement described in Japanese Patent Application No. 58-43860, and aldoximecarbamates generating nitrites by heating described in Japanese Patent Application No 58-31614.

Besides, base precursors described in British Patents 998,945 and 2,079,480, JP-A-50-226225, U.S. Pat. Nos. 3,220,846, 4,514,493 and 4,657,848 and *Kochi Gijutsu,* No. 5, pages 55 to 86, published by Azutech Co., Ltd. (Mar. 22, 1991) are also useful.

Methods for exposing the photographic materials of the invention to record images include, for example, methods of directly taking landscape photographs or human subject photographs by use of cameras, methods of exposing the photographic materials through reversal films or negative films by use of printers or enlargers, methods of subjecting original pictures to scanning exposure through slits by use of exposing devices of copying apparatus, methods of allowing light emitting diodes or various lasers (such as laser diodes and gas lasers) to emit light through image information and electric signals to subject the photographic materials to scanning exposure (methods described in JP-A-2-129625, Japanese Patent Application Nos. 3-338182, 4-9388 and 4-281442), and methods of supplying image information to image displays such as CRTs, liquid crystal displays, electroluminescence displays and plasma displays to expose the photographic materials directly or through optical systems.

As described above, light sources and exposing methods such as natural light, tungsten lamps, light emitting diodes, laser sources and CRT light sources described in U.S. Pat. No. 4,500,626, column 56, JP-A-2-53378 and JP-A-2-54672 can be used to record images on the heat development photographic materials.

Further, images can also be exposed using wavelength converting elements in which non-linear optical materials and coherent light sources such as laser beams are combined. Here, the non-linear optical material is a material which can express non-linearity between an electrical field and polarization appearing when a strong optical electrical field such as a laser beam is given. Examples of such materials preferably used include inorganic compounds represented by lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. As the forms of the wavelength converting elements, the single crystal optical waveguide path type and the fiber type are known, and both are useful.

Further, in the above-mentioned image information, image signals obtained from video cameras and electronic still cameras, television signals represented by the Nippon Television Signal Criteria (NTSC), image signals obtained by dividing original pictures into many picture elements with scanners, etc. and images produced by use of computers represented by CGs and CADs can be utilized.

The color-developing agents for use in the invention can be used for all silver halide photographic materials such as color negatives, color paper, color instant photographs, color reversal or color image forming X-ray photographic materials and photographic materials for platemaking. Further, the color-developing agents for use in the invention can be added to the silver halide photographic materials, and also to processing solutions.

When the color-developing agents for use in the invention are added to the silver halide photographic materials, development can be conducted by heat treatment or activator treatment.

The heat treatment of-photographic materials is known in the art, and heat developable photographic materials and processes therefor are described, for example, in *Shashin Kogaku no Kiso* (*The Basis of Photographic Engineering*), pages 553 to 555, published by Corona Co (1979), Nebletts Handbook of Photography and Reprography, 7th Ed. (Van Nostrand and Reinhold Company), pages 32 and 33, U.S. Pat. Nos. 3,152,904, 3,301,678, 3,392,020 and 3,457,075, British Patents 1,131,108 and 1,167,777, and *Research Disclosure,* June, 1978 (RD-17029), pages 9 to 15.

The term "activator treatment" means a treating process of allowing the color-developing agents to be contained in the photographic materials and developing them with processing solutions containing no color-developing agents. The processing solutions for use in this case are characterized by that they have no color-developing agents which are contained in usual developing solution components, and may contain other components (for example, alkalis and auxiliary developing agents. The activator treatment is illustrated in known literatures such as EP 545,491 A1 and EP 565165 A1.

The term "developing solution" as used in the invention means a processing solution containing a color-developing agent, or a processing solution containing no agent (for the activator treatment).

Treating materials and treating methods for use in the activator treatment in the invention are described in detail below. In the invention, the photographic materials are developed (silver development/cross oxidation of the contained color-developing agents), desilverized, and washed with water or stabilized. Further, after washing with water or stabilization, treatment for enhancement of color generation such as addition of alkalis (alkali treatment) are carried out in some cases.

When the photographic materials are developed by using the developing solutions, compounds (auxiliary developing agents) which function as developing agents for silver halides, and/or have the function that oxidation products of the developing agents produced by silver development cross oxidize the color-developing agents contained in the photographic materials are preferably used in the developing solutions. Preferably, pyrazolidones, dihydroxybenzenes, reductones and aminophenols are used, and particularly preferably, pyrazolidones are used.

The pyrazolidones are preferably 1-phenyl-3-pyrazolidones, which include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, 1-phenyl-2-hydroxymethyl-5-phenyl-3-pyrazolidone and 1-(2-chlorophenyl)-4-hydroxymethyl-4-methyl-3-pyrazolidone.

The hydroxybenzenes include hydroquinone, chlorohydroquinone, bromohydroquinane, isopropylhydroquinone, methylhydroquinone, 2,3-dichlorohydroquinone, 2,5-dichlorohydroquinone, 2,5-dimethylhydroquinone and potassium hydroquinonemonosulfonate.

The reductones include ascorbic acid and erythorbic acid.

The aminophenols include N-methyl-p-aminophenol, N-(β-hydroxyethyl)-p-aminophenol, N-(4-hydroxyphenyl) glycine and 2-methyl-p-aminophenol.

These compounds are usually used alone, but also preferably used as a combination of two or more of them for enhancing development and cross oxidation activity.

The amount of these compounds used in the developing solutions is from $2.5\times10^{-4}$ mol/liter to 0.2 mol/liter, preferably from 0.0025 mol/liter to 0.1 mol/liter, and more preferably from 0.001 mol/liter to 0.05 mol/liter.

Preservatives for use in the developing solutions of the invention include sodium sulfite, potassium sulfite, lithium sulfite, formaldehyde sodium bisulfite and hydroxylamine sulfate. The amount thereof used is 0.1 mol/liter or less, and preferably ranges from 0.001 mol/liter to 0.02 mol/liter in some cases. When high silver chloride emulsions are used in the photographic materials, the above-mentioned compounds are contained in an amount of 0.001 mol/liter or less, and preferably, they are not contained at all in some cases.

In the present invention,-organic preservatives are preferably contained in place of the above-mentioned hydroxylamine and sulfite ions.

The term "organic preservative" as used herein means an organic compound which reduces the deterioration rate of the above-mentioned developing agent by addition thereof to the developing solution, that is to say, an organic compound having the function of preventing oxidation of the developing agent by air or the like. Hydroxylamine derivatives (excluding hydroxylamine), hydroxamic acids, hydrazines, phenols, α-hydroxyketones, α-aminoketones, saccharides, monoamines, diamines, polyamines, quaternary ammonium compounds, nitroxy radicals, alcohols, oximes, diamide compounds and cyclocondensation type amines are particularly preferred preservatives among others. These are described in JP-A-63-4235, JP-A-63-5341, JP-A-63-30845, JP-A-63-21647, JP-A-63-44655, JP-A-63-46454, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903 and JP-B-48-30496. As other preservatives, various metals described in JP-A-57-44148 and JP-A-57-53749, salicylic acid derivatives described in JP-A-59-180588, alkanolamines described in JP-A-54-3532, polyethyleneimines described in JP-A-56-94349 and aromatic polyhydroxy compounds described in U.S. Pat. No. 3,746,544 may be contained as needed. In particular, it is preferred to contain alkanolamines described in JP-A-4-97355, pages 631 and 632 and dialkylhydroylamines described in the same patent, pages 627 to 630. Further, it is also preferred to use dialkylhydroxylamines and/or hydrazine derivatives in combination with alkanolamines, or dialkylhydroxylamines described in EP 530921 A1 in combination with α-amino acids represented by glycine.

The amount of these compounds used is preferably from $1\times10^{-3}$ mol to $5\times10^{-1}$ mol, and more preferably from $1\times10^{-2}$ mol to $2\times10^{-1}$ mol, per liter of developing solution.

In the invention, halogen ions such as chlorine ions, bromine ions and iodine ions are contained in the developing solutions. In particular, when high silver chloride emulsions are used, chlorine ions are preferably contained in an amount of $3.5\times10^{-3}$ mol/liter to $3.0\times10^{-1}$ mol/liter, more preferably $1\times10^{-2}$ mol/liter to $2\times10^{-1}$ mol/liter, and/or bromine ions are preferably contained in an amount of $0.5\times10^{-5}$ mol/liter to $1.0\times10^{-3}$ mol/liter, more preferably $3.0\times10^{-5}$ mol/liter to $5\times10^{-4}$ mol/liter.

Here, the halides may be directly added to the developing solutions, and may be eluted from the photographic materials to the developing solutions during development processing.

When they are added to the developing solutions, supplying materials include sodium halides, potassium halides, ammonium halides, lithium halides and magnesium halides.

When they are eluted from the photographic materials, they are mainly supplied from the silver halide emulsions, but they may be supplied from other than the emulsions.

The pH of the developing solutions for use in the invention is preferably from 8 to 13, and more preferably from 9 to 12.

Various buffers are preferably used to maintain the above-mentioned pH. The buffers available in the invention include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxylaminomethane salts and lysine salts. In particular, carbonates, phosphates, tetraborates and hydroxybenzoates are excellent in solubility and in buffering ability in the pH region of 9.0 or more, and exert no adverse effect on photographic properties even by addition to the developing solutions. It is therefore preferable to use these buffers.

Specific examples of these buffers include lithium carbonate, sodium carbonate, potassium carbonate, potassium bicarbonate, tripotassium phosphate, trisodium phosphate, dipotassium phosphate, disodium phosphate, potassium borate, sodium borate, sodium tetraborate, potassium tetraborate, sodium o-hydroxybenzoate (sodium salicylate) and potassium 5-sulfo-2-hydroxybenzoate (potassium 5-sulfosalicylate).

The buffers are added to the developing solutions preferably in an amount of 0.05 mol/liter or more, and particularly preferably in an amount of 0.1 mol/liter to 0.4 mol/liter.

In addition, various chelating agents can be used in the developing solutions as suspending agents for calcium or magnesium, or for improving the stability of the developing solutions. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, 1,2-diaminopropanetetraacetic acid, glycoletherdiaminetetra-acetic acid, ethylenediamine-o-hydroxyphenylacetic acid, 2-phosphonobutane-1,2,4-tricarboxylic acid, 1-hydroxyethylidene-1,1-diphosphonic acid, 1,2-dihydroxybenzene-4,6-disulfonic acid and alkali metal salts thereof. These chelating agents may be used as a combination of two or more of them, as needed.

These chelating agents may be added in any amount as long as the amount is enough to block metal ions in the developing solutions. For example, they are added in an amount of about 0.1 g/liter to about 10 g/liter.

In the invention, any antifoggants can be added as needed. The antifoggants which can be used include alkali metal halides such as sodium chloride, potassium bromide and potassium iodide, and nitrogen-containing heterocyclic compounds. Typical examples of the nitrogen-containing heterocyclic compounds include benzotriazole, 5-nitrobenzotriazole, 5-methylbenzotriazole, 5-nitrobenzimidazole, 5-nitroindazole, 2-thiazolylbenzimidazole, indazole, hydroxyazaindolizine, adenine, 1-phenyl-5-mercaptotetrazole and derivatives thereof.

The amount of the nitrogen-containing heterocyclic compounds added is from $1\times10^{-5}$ mol/liter to $1\times10^{-2}$ mol/liter, and preferably from $2.5\times10^{-5}$ mol/liter to $1\times10^{-3}$ mol/liter.

Any development accelerators may be added to the developing solutions as needed. Such development accelerators include thioether compounds described in JP-B-37-16088, JP-B-37-5987, JP-B-38-7826, JP-B-44-12380, JP-B-45-9019 and U.S. Pat. No. 3,813,247, p-phenylenediamine compounds described in JP-A-52-49829 and JP-A-50-15554, quaternary ammonium salts described in JP-A-50-137726, JP-B-44-30074, JP-A-56-156826 and JP-A-52-43429, amine compounds described in U.S. Pat. Nos. 2,494,903, 3,128,182, 4,230,796 and 3,253,919, JP-B-41-11431, U.S. Pat. Nos. 2,482,546, 2,596,926 and 3,582,346, polyalkylene oxides described in. JP-B-37-16088, JP-B-42-25201 and U.S. Pat. No. 3,532,501, and imidazole compounds.

The developing solutions preferably contain fluorescent brighteners. In particular, 4,4-diamino-2,2'-disulfostilbene compounds are preferably used. Specifically, commercial fluorescent brighteners, for example, compounds described in *Senshoku Note* (*Dying Note*), 19th Ed., pages 165 to 168 and compounds described in JP-A-4-242943, pages 3 to 7, can be used. The amount thereof added is from 0.1 g/liter to 10 g/liter, and preferably from 0.5 g/liter to 5 g/liter.

The processing temperature of the developing solutions applied in the invention is from 20° C. to 50° C., and preferably from 30° C. to 45° C. The processing time is from 5 seconds to 2 minutes, and preferably 10 seconds to 1 minute. Although the replenishment rate of the developing solutions is preferably minimized, it is from 15 ml to 600 ml, preferably from 25 ml to 200 ml, and more preferably from 35 ml to 100 ml, per square meter of photographic material.

The photographic materials of the invention may have conductive exothermic layers as heating means for heat development. In this case, heating elements described in JP-A-61-145544 can be utilized.

The heating temperature in the heat development stage is from about 65° C. to about 180° C., preferably from about 70° C. to about 180° C., more preferably from about 75° C. to about 180° C., still more preferably from about 80° C. to about 150° C., and yet still more preferably from about 80° C. to about 135° C. The heating time is preferably from 0.1 second to 120 seconds more preferably from 0.1 second to 60 seconds, and particularly preferably from 0.1 second to 30 seconds.

Heating methods in the development stage include methods of bringing the photographic materials into contact with heated blocks or heated plates, methods of bringing them into contact with hot plates, hot pressers, heat rolls, heat drums, halogen lamp heaters and infrared or far infrared lamp heaters, and methods of passing them through atmospheres of high temperatures. As methods for overlaying the heat developable photographic materials with the dye-fixing materials, methods described in JP-A-62-253159 and JP-A-61-147244, page 27 can be applied.

After the development, desilverization treatment can be conducted. The desilverization treatment comprises fixing treatment, and bleaching and fixing treatment. When the bleaching and fixing treatment is conducted, the bleaching treatment and the fixing treatment may be carried out separately or concurrently (bleaching-fixing treatment). Further, treatment in a two-tank continuous bleaching-fixing bath, the fixing treatment before the bleaching-fixing treatment and the bleaching treatment after the bleaching-fixing treatment can be arbitrarily conducted depending on the purpose.

In some cases, the photographic materials are preferably subjected to stabilization without desilverization after the development to stabilize silver salts or color images;

Bleaching agents for use in the bleaching solutions and the bleaching-fixing solutions include, for example, compounds of polyvalent metals such as iron (III), cobalt (III), chromium (IV) and copper (II), peroxides, quinones and nitro compounds. Typical examples of the compounds include iron chloride, ferricyanides, bichromates, organic complexes of iron (III) (for example, salts of the metals with ethylene-diaminetetraacetic acid, diethylenetriaminepentaacetic acid, cyclohexanediaminetetraacetic acid, 1,3-diaminopropanetetra-acetic acid, methyliminodiacetic acid or aminopolycarboxylic acids described in JP-A-4-365036, pages 5 to 17), persulfates, permanganates, bromates, hydrogen peroxide and compounds released therefrom (such as percarbonic acid and perboric acid) and nitrobenzene. Of these, iron (III) complexes with aminopolycarboxylic acids such as (ethylenediaminetetraaceto) iron (III) complex, (1,3-diaminopropanetetraaceto) iron (III) complex, etc., hydrogen peroxide and persulfates are preferred in view of rapid processing and the prevention of environmental pollution. The bleaching solutions and the bleaching-fixing solutions containing these iron (III) complexes with aminopolycarboxylic acids are used at a pH of 3 to 8, preferably 5 to 7. The bleaching solutions containing the persulfates or hydrogen peroxide are used at a pH of 4 to 11, preferably 5 to 10.

Bleaching accelerators can be added to the bleaching solutions, the bleaching-fixing solutions and preceding baths thereof as needed. Specific examples of the useful bleaching accelerators which can be used include mercapto group- or disulfide group-containing compounds described in U.S. Pat. No. 3,893,858, West German Patent 1,290,812, JP-A-53-95630 and *Research Disclosure,* No. 17129 (July, 1978), thiazolidine derivatives described in JP-A-50-140129, thiourea derivatives described in U.S. Pat. No. 3,706,561, iodides described in JP-A-58-16235, polyoxyethylene compounds described in West German Patent 2,748,430, polyamine compounds described in JP-B-45-9936 and bromide ions. Of these, the mercapto group- and disulfide group-containing compounds are preferred because of their high accelerating effect. These bleaching accelerators are particularly useful for desilverization of color photographic materials for shooting use.

As to accelerators for persulfate bleaching, complex salts of iron (III) with 2-pyridinecarboxylic acid or 2,6-pyridinecarboxylic acid described in JP-A-6-214365 (EP 0602600 A1) are effective. Further, as to accelerators for hydrogen peroxide bleaching, metal salts of organic acids described in JP-B-61-16067 and JP-B-61-19024 are effective.

Known additives can be used in the bleaching solutions or the bleaching-fixing solutions. Examples of such additives include rehalogenating agents such as ammonium bromide and ammonium chloride, pH buffers such as ammonium nitrate, acetic acid, boric acid, citric acid or salts thereof, tartaric acid or salts thereof, succinic acid or salts thereof and imidazole, and metal-corrosion inhibitors such as ammonium sulfate. In particular, organic acids are preferably added for preventing bleach stains. Preferred examples of the organic acids include compounds having an acid dissociation constant (pKa) of 2 to 7, specifically, acetic acid, succinic acid, citric acid and propionic acid.

Fixing agents for use in the fixing solutions or the bleaching-fixing solutions include thiosulfates, thiocyanates, thioureas, large quantities of iodides, nitrogen-containing heterocyclic compounds having sulfide groups described in JP-A-4-365037, pages 11 to 21, and JP-A-5-66540, pages 1088 to 1092, mesoionic compounds and thioether compounds. Of these, the thiosulfates are generally used, and ammonium thiosulfate is most widely used. It is also preferred that the thiosulfates are used in combination with thiocyanates, thioether compounds, thioureas or mesoionic compounds.

As preservatives for the fixing solutions or the bleaching-fixing solutions, sulfites, bisulfites, carbonyl bisulfite addition compounds or sulfinic compounds described in EP 294769 A are preferred. Further, various aminopolycarboxylic acids, organic phosphonic acids (for example, 1-hydroxyethylidene-1,1-diphosphonic acid, N,N,N',N'-ethylenediaminetetraphosphonic acid and 2-phosphonobutane-1,2,4-tricarboxylic acid) and sodium stannate are preferably added to the fixing solutions, the bleaching solutions or the bleaching-fixing solutions, for stabilizing the solutions.

The fixing solutions or the bleaching-fixing solutions can further contain various fluorescent brighteners, antifoaming agents, surfactants, polyvinyl pyrrolidone and methanol.

The treating temperature in the desilverization stage is from 20° C. to 50° C., and preferably from 30° C. to 45° C. The treating time is from 5 seconds to 2 minutes, and preferably from 5 seconds to 1 minute. Although the lower replenishment rate is preferred, it is from 15 ml to 600 ml, preferably from 25 ml to 200 ml, and more preferably from 35 ml to 100 ml, per square meter of photographic material. The photographic materials are also preferably processed with no replenishment, only replenishing the evaporated amount with water.

The color photographic materials of the invention are usually subjected to washing after the desilverization. When stabilization is conducted, the washing may be omitted. In such stabilization, all known methods described in JP-A-57-8543, JP-A-58-14834, JP-A-60-220345, JP-A-58-127926, JP-A-58-137837 and JP-A-58-140741 can be used. Further, washing-stabilization represented by the treatment of color photographic materials for shooting use may be carried out, in which stabilization baths containing dye stabilizers and surfactants are used as final baths.

Washing solutions and stabilizing solutions may contain water softeners such as sulfites, inorganic phosphoric acids, polyaminocarboxylic acids and organic aminophosphonic acids, metal salts such as Mg salts, Al salts and Bi salts, surfactants, hardeners, pH buffers, fluorescent brighteners and silver salt forming agents such as nitrogen-containing heterocyclic compounds.

The dye stabilizers of the stabilizing solutions include aldehydes such as formalin and glutaraldehyde, N-methylol compounds, hexamethylenetetramine and adducts of aldehydes and sulfurous acid.

The pH of the washing solutions or the stabilizing solutions is from 4 to 9, and preferably from 5 to 8. The treating temperature is from 15° C. to 45° C., and preferably from 25° C. to 40° C., and the treating time is from 5 seconds to 2 minutes, and preferably from 5 seconds to 40 seconds.

Overflowed solutions derived from the above-described washing and/or replenishment of the stabilizing solutions can be reused in other stages such as the desilverization stage.

Although the amount of the washing solution and/or stabilizing solutions can be widely established depending on various conditions, the replenishment rate is preferably from 15 ml to 360 ml, and more preferably from 25 ml to 120 ml, per square meter of photographic material. For reducing the replenishment rate, the use of a plurality of tanks and the multistage countercurrent system is preferred. In particular, 2 to 5 tanks are preferably used. When the amount of these solutions is reduced, bacteria propagate, and the resulting suspended matter adheres to the photographic materials. For preventing these disadvantages, disinfectants such as isothiazolone compounds described in JP-A-57-8542, thiapentazoles, chlorinated sodium isocyanurate, benzotriazole, and disinfectants described in Hiroshi Horiguchi, *Bokin Bobaizai no Kagaku* (*Chemistry of Bacteria Prevention and Fungus Prevention*), Sankyo Shuppan (1986), *Biseibutsu no Mekkin, Sakkin, Bobai Gijutsu* (*Sterilization, Pasteurization and Fungus Prevention Techniques of Microorganisms*), edited by Eisei Gijutsukai, Kogyo Gijutsukai (1982) and *Bokin Bobaizai Jiten* (*Dictionary of Disinfectants and Fungicides*), edited by Nippon Bokin Bobai Gakkai (1986) can be used. Further, a method of reducing Mg and Ca ions described in JP-A-62-288838 is also particularly preferably used.

In the invention, water obtained by treating overflowed solutions or tank solutions with reverse osmosis membranes can be used. For example, treatment by reverse osmosis is preferably carried out to water after the multistage countercurrent washing and/or the second stabilization tank. Specifically, in the case of two-tank constitution, water in the second tank is-treated with a reverse osmosis membrane, and permeated water is returned to the first tank (the tank from which water has been collected for reverse osmosis treatment) or a washing and/or stabilization tank positioned subsequently thereto. In the case of four-tank constitution, water in the third or fourth tank is treated and returned in the same manner as described above. A concentrated solution is returned to a tank upstream from the above-mentioned same tank, and further returned to a desilverization bath as one measure.

Materials of the reverse osmosis membranes which can be used include cellulose acetates, crosslinked polyamides, polyethers, polysulfones, polyacrylic acids and polyvinylene carbonates.

The liquid-transferring pressure in the use of these membranes is preferably from 2 $kg/cm^2$ to 10 $kg/cm^2$, and particularly preferably from 3 $kg/cm^2$ to 7 $kg/cm^2$.

In the invention, it is preferred that stirring is made as vigorously as possible. Specific methods for vigorous stirring include methods of allowing jet streams of processing solutions to collide against emulsion surfaces of the photographic materials as described in JP-A-62-183460 and JP-A-62-183461, methods of increasing the stirring efficiency by using rotating means described in JP-A-62-183461, methods of transferring the photographic materials while bringing wiper blades provided in solutions into contact with emulsion surfaces to make the emulsion surfaces turbulent, thereby improving the stirring effect, and methods of increasing the circulation flow rate of the whole processing solutions. Such stirring improving methods are useful in all of the developing solutions, the bleaching solutions, the bleaching-fixing solutions, the stabilizing solutions and the washing solutions. These methods are effective in terms of promotion of supply of active ingredients in the solutions to the photographic materials and diffusion of unnecessary ingredients of the photographic materials.

In the invention, excellent performance is exhibited, even though any solutions have any solution open rate [air contacting area ($cm^2$)/solution volume ($cm^3$) ]. However, the solution open rate is preferably from 0 $cm^{-1}$ to 0.1 $cm^{-1}$ in terms of stability of the solution components. In continuous processing, the solution open rate is practically preferably from 0.001 $cm^{-1}$ to 0.05 $cm^{-1}$, and more preferably from 0.002 $cm^{-1}$ to 0.03 $cm^{-1}$.

It is preferred that automatic processors used for the photographic materials of the invention have means for carrying the photographic materials, described in JP-A-60-191257, JP-A-60-191258 and JP-A-60-191259. Such carrying means can remarkably reduce the amount of the processing solutions brought from preceding baths into succeeding baths, and has the high effect of preventing the performance of the processing solutions from deteriorating. Such an effect effectively results in a reduction in processing time in each stage or a decrease in the replenishment rate of the processing solutions. Further, for shortening the processing time, it is preferred that the crossover time (aerial time) is shortened. For example, methods described in JP-A-4-86659, FIG. 4, 5 or 6, and JP-A-5-66540, FIG. 4 or 5 are preferred, in which the photographic materials are transferred between the respective processing stages with blades having the shielding effect.

When each processing solution is concentrated by evaporation in continuous processing, water is preferably added to correct the concentration.

The processing time of a certain stage in the invention means a time required from initiation of processing of the photographic materials in the stage till initiation of processing of the photographic materials in a subsequent stage. The actual processing time according to automatic processors is usually determined by the linear speed and the volume of processing baths. In the invention, however, the linear speed is from 500 mm/minute to 4,000 mm/minute as a measure. In particular, for small-sized automatic processors, it is preferably from 500 mm/minute to 2,500 mm/minute.

The processing time of all processing stages, that is to say, from the development stage to the drying stage, is preferably 360 seconds or less, more preferably 120 seconds or less, and particularly preferably from 30 seconds to 90 seconds. The term "processing time" as used herein means a time from the time when the photographic material is immersed in a developing solution to the time when it is taken out of a drying unit of a processor.

Further, the color-developing agents and couplers for use in the invention can be used in the same light-sensitive elements in combination with known dye-donating compounds such as dye developing agents and compounds releasing diffusible dyes by the redox reaction, described later. For example, a method can be used in which yellow and cyan images are formed by the color-developing agents and couplers for use in the invention, and magenta images are formed by other dye image forming compounds.

The dye image forming compounds which can be used in combination in the invention include combinations of known developing agents and couplers which can be reacted therewith. Systems utilizing the couplers, in which silver salts and oxidation products of the developing agents produced by the oxidation-reduction reaction of the developing agents are reacted with the couplers to form dyes, are described in many literatures. The couplers may be either 4-equivalent couplers or 2-equivalent couplers. Further, 2-equivalent couplers having nondiffusible groups as releasing groups and forming diffusible dyes by the reaction with the oxidation products of the developing agents are also preferred. Examples of the color-developing agents and the couplers are described in detail in T. H. James, *The theory of the Photographic Process,* the fourth edition, pages 291 to 334 and 354 to 361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474 and JP-A-60-66249.

Examples of the dye image forming compounds also include dye silver compounds in which organic silver salts are combined with dyes. Specific examples of the dye silver compounds described in *Research Disclosure,* May, 1978 (RD-16966), pages 54 to 58.

In addition, examples of the dye image forming compounds also include azo dyes for use in the heat developable silver dye bleaching process. Specific examples of the azo dyes and the bleaching process are described in U.S. Pat. No. 4,235,957 and *Research Disclosure,* April, 1976 (RD-14433), pages 30 to 32. Examples of the dye-donating substances also include leuco dyes described in U.S. Pat. Nos. 3,985,565 and 4,022,617.

Further, other examples of the dye image forming compounds include compounds having the function of releasing or diffusing diffusible dyes imagewise.

The compounds of this type can be represented by the following general formula [LI]:

$$(\text{Dye-X})^n\text{—Y} \qquad [\text{LI}]$$

wherein Dye represents a known dye group, a dye group temporarily shifted to a short wavelength, or a dye precursor group; X represents-only a bond or a bonding group; Y represents a group having the property of bringing about the difference in diffusibility of the compound represented by $(\text{Dye-X})^n$—Y corresponding to or reversely corresponding to a light-sensitive silver salt having a latent image imagewise, or releasing Dye to produce the difference in diffusibility between Dye released and $(\text{Dye-X})^n$—Y; n represents 1 or 2; and when n is 2, two Dye-X moieties may be the same or different.

Specific examples of the dye-donating substances represented by general formula [LI] include dye developing agents in which hydroquinone developing agents and dye components are connected to each other, which are described in U.S. Pat. Nos. 3,134,764, 3,362,819, 3,597,200, 3,544,545 and 3,482,972. Further, compounds releasing diffusible dyes by the intramolecular nucleophilic displacement reaction are described in JP-A-51-63618, and compounds releasing diffusible dyes by the intramolecular rearrangement reaction of isooxazolone rings are described in JP-A-49-111628. In all of these systems, the diffusible dyes are released or diffused at portions where no development has occurred, and the dyes are neither released nor diffused at portions where the development has occurred.

As another system, a system has also been contrived in which dye releasing compounds are converted to oxidation products having no dye releasing ability, allowed to coexist together with reducing agents and precursors thereof, and reduced by developing agents, the reducing agents remaining without being oxidized to release diffusible dyes. Specific examples of the dye image forming compounds for use therein are described in JP-A-53-110827, JP-A-54-130927, JP-A-56-164342 and JP-A-53-35533.

On the other hand, as substances releasing dyes at portions where the development has occurred, substances releasing diffusible dyes by the reaction of couplers having the diffusible dyes as releasing groups with oxidation products of developing agents are described in British Patent 1,330,524, JP-B-48-39165 and U.S. Pat. No. 3,443,940.

Further, the system using these color-developing agents presents the serious problem of contamination of images due to decomposed products by oxidation of the developing agents. Accordingly, for solving this problem, dye releasing compounds requiring no developing agents and having reducibility themselves have been contrived. Typical examples thereof include dye image forming compounds described, for example, in U.S. Pat. Nos. 3,928,312, 4,053,312, 4,055,428 and 4,336,322, JP-A-59-65839, JP-A-59-69839, JP-A-51-104343, Research Disclosure, No. 17465, U.S. Pat. Nos. 3,725,062, 3,728,113 and 3,443,939, JP-A-58-116537, JP-A-57-179840 and U.S. Pat. No. 4,500,626.

In the system of forming images by diffusion transfer of dyes using the photographic materials of the invention, the photographic materials are roughly classified into a form in which a light-sensitive element and an image receiving element (dye-fixing element) are separately formed on two supports, respectively, and a form in which they are formed on the same single support.

For the mutual relationship between the light-sensitive elements and the dye-fixing elements, the relationship with supports and the relationship with white reflection layers, the relationship described in JP-A-61-147244, pages 58 and 59, and U.S. Pat. No. 4,500,626, column 57, can also be applied to the photographic materials of the invention.

In the typical form of a film unit in which the light-sensitive element and an image receiving element (dye-fixing element) are formed on the same support, the image receiving element and the light-sensitive element are laminated on one transparent support, and it is unnecessary to separate the light-sensitive element from the image receiving element after completion of transferred images. More specifically, the image receiving element comprises at least one mordant layer. A preferred embodiment of the image receiving element is constituted by a combination of a blue-sensitive emulsion layer, a green-sensitive emulsion layer and an infrared-sensitive emulsion layer, a combination of a green-sensitive emulsion layer, a red-sensitive emulsion layer and an infrared-sensitive emulsion layer, or a combination of a blue-sensitive emulsion layer, a red-sensitive emulsion layer and an infrared-sensitive emulsion layer, and a combination of each of a yellow dye image forming compound (dye image forming compound containing the color-developing agent and coupler of the invention), a magenta dye image forming compound (dye image forming compound containing the color-developing agent and coupler of the invention) and a cyan dye image forming compound (dye image forming compound containing the color-developing agent and coupler of the invention) with each emulsion layer described above. The term "infrared-sensitive emulsion layer" as used herein means an emulsion layer having sensitivity to light of 700 nm or more, particularly 740 nm or more. Each of the light-sensitive emulsion layers may be divided and added to two or more layers as needed. A white reflection layer containing a solid pigment such as titanium oxide is provided between the mordant layer and the light-sensitive layer or the layer containing the dye image forming compound (dye image forming compound containing the color-developing agent and coupler of the invention) so that the transferred images can be appreciated through the transparent support. For making it possible to complete processing in daylight, a shading layer may be further provided between the white reflection layer and the light-sensitive layer. Further, for allowing the light-sensitive element to be separated all or partly from the image receiving element as desired, a separation layer may be formed in an appropriate portion (such embodiments are-described, for example, in JP-A-56-67840 and Canadian Patent No. 674,082).

Further, in another form in which separation is unnecessary, the above-described light-sensitive element is formed on a transparent support, a white reflection layer is formed thereon, and an image receiving layer is further laminated thereon. An embodiment in which an image receiving element, a white reflection layer, a separation layer and a light-sensitive element are laminated on the same support and the light-sensitive layer is intentionally separated from the image receiving layer is described in U.S. Pat. No. 3,730,718. On the other hand, a typical form in which a light-sensitive layer and an image receiving element are separately formed on two supports, respectively, are roughly divided into two types. One is a separation type and the other is a separation-unnecessary type. These types will be illustrated in detail below. In a preferred embodiment of the separation type film unit, a support has a light reflection layer on its back side, and at least one image receiving layer is formed thereon. Further, a light-sensitive element is formed on a support having a shading layer. Before termination of exposure, a coated surface of the light-sensitive layer does not face to a coated surface of a mordant layer. After termination of exposure (for example, during development processing), however, the coated surface of the light-sensitive layer is turned over and laid over the coated surface of the image receiving layer. After completion of transferred images on the mordant layer, the light-sensitive element is rapidly separated from the image receiving element.

Further, in a preferred embodiment of the separation-unnecessary type film unit, at least one mordant layer is formed on a transparent support, and a light sensitive element is formed on a support which is transparent or has a shading layer. A coated surface of the light-sensitive layer is laid over a coated surface of the mordant layer, facing each other.

The embodiments described above can be applied to either a system of development with alkali processing solutions or a heat development system. However, particularly in the former case, a pressure-rupturable container (treating element) containing an alkali processing solution may be further combined. Especially in the separation-unnecessary type film unit in which the image receiving element and the light-sensitive element are laminated on one support, this treating element is preferably arranged between the light-sensitive element and a cover sheet overlaid thereon. In the form in which the light-sensitive element and the image receiving element are separately formed on two supports, respectively, the treating element is preferably arranged between the light sensitive element and the image receiving element upon development processing at latest. The treating elements preferably contain shading agents (such as carbon black and dyes which vary in color according to the pH)

and/or white pigments (such as titanium oxide) depending on the form of the film unit. Further, in the film unit which is developed with an alkali processing solution, a neutralization timing mechanism comprising a neutralization layer and a neutralization timing layer in combination is preferably incorporated into a cover sheet, an image receiving element or a light-sensitive element.

As the mordants for use in the image receiving elements described above and dye-fixing elements described later, polymer mordants are preferred. The polymer mordants as used herein are polymers containing tertiary amino groups, polymers containing nitrogen-containing heterocyclic moieties and polymers containing quaternary cation groups.

Specific examples thereof are described in JP-A-61-147244, pages 98 to 100, and U.S. Pat. No. 4,500,626, pages 57 to 60.

The light-sensitive elements for use in the invention can have various additives known as ones for heat developable light-sensitive elements and layers other than light-sensitive layers, such as protective layers, intermediate layers, antihalation layers, separation layers for facilitating separation from dye-fixing elements and matte layers, as needed. The additives include plasticizers, matte agents, dyes for improvement in sharpness, antihalation dyes, surfactants, fluorescent brighteners, antislipping agents, antioxidants, antifading agents and diffusible dye trapping agents described in *Research Disclosure,* June, 1978, pages 9 to 15, and JP-A-61-88256.

In particular, the protective layers usually contain organic and inorganic matte agents. Further, the protective layers may contain mordants and ultraviolet absorbers. The protective layer and the intermediate layer may each be composed of two or more layers.

Further, the intermediate layers may contain reducing agents for preventing fading or color stains, ultraviolet absorbers and white pigments such as titanium dioxide. The white pigments may be added to not only the intermediate layers, but also the emulsion layers, for improving the sensitivity.

The dye-fixing elements can be provided with auxiliary layers such as protective layers, separation layers and anticurling layers. In particular, it is useful to provide the protective layers. One or more of the above-mentioned layers may contain hydrophilic heat solvents, plasticizers, antifading agents, ultraviolet absorbers, slipping agents, matte agents, antioxidants, dispersed vinyl compounds for increasing dimension stability, surfactants and fluorescent brighteners. In a system in which heat development and dye diffusion transfer are concurrently performed in the presence of a small amount of water, bases and/or base precursors described later are preferably contained in the dye-fixing elements in terms of enhanced storage stability of the light-sensitive elements. Specific examples of these additives are described in JP-A-61-88256, pages 101 to 120.

In the invention, image formation accelerating agents can be used in the light-sensitive elements and/or the dye-fixing elements. The image formation accelerating agents have the functions of accelerating the oxidation-reduction reaction of silver salt-oxidizing agents with reducing agents, accelerating reactions such as formation of dyes from the dye image forming compounds containing the color-developing agents and couplers of the invention, decomposition of the dyes and release of the diffusible dyes, and accelerating transfer of dyes from constituting layers of the light-sensitive elements to dye-fixing layers. They can be classified into bases or base precursors, nucleophilic compounds, high boiling organic solvents (oils), heat solvents, surfactants and compounds having the mutual interaction with silver or silver ions, according to physicochemical functions. However, these substances generally have combined functions, and usually have some of the above-mentioned accelerating effects in combination. Details thereof are described in JP-A-61-93451, pages 67 to 71.

There are various methods for generating the bases, and compounds for use in the methods are all useful as the base precursors. For example, there are a method of generating the bases by mixing slightly soluble metal compounds described in EP 210,660 A2 with compounds which can form complexes with metal ions constituting the slightly soluble metal compounds (hereinafter referred to as complex forming compounds), and a method of producing bases by electrolysis described in JP-A-61-232451.

In particular, the former method is effective. The slightly soluble metal compounds include carbonates, hydroxides and oxides of zinc, aluminum, calcium and barium. Further, the complex forming compounds are described in detail, for example, in A. E. Martell and R. M. Smith, *Critical Stability Constants,* vol. 4 and vol. 5, Plenum Press. Specific examples thereof include salts of aminocarboxylic acids, iminodiacetic acids, pyridinecarboxylic acids, aminophosphoric acids, carboxylic acids (mono, di, tri and tetracarboxylic acids, and compounds further having constituents such as phosphono, hydroxy, oxo, ester, amido, alkoxy, mercapto, alkylthio and phosphino), hydroxamic acids, polyacrylates and polyphosphoric acids, with alkali metals, guanidines, amidines and quaternary ammonium salts.

It is advantageous that the slightly soluble metal compounds and the complex forming compounds are separately added to the light-sensitive elements and the dye-fixing elements, respectively.

In the invention, various development stoppers can be used in the light-sensitive elements and/or the dye-fixing elements for always obtaining constant images against fluctuations in processing temperature and processing time on development.

The development stopper as used herein is a compound which, after normal development, rapidly neutralizes or reacts with a base to reduce the concentration of the base contained in a film, thereby stopping the development, or a compound which interacts with silver and a silver salt to inhibit the development. Specific examples thereof include acid precursors releasing acids by heating, electrophilic compounds which conduct the replacement reaction with coexisting bases by heating, nitrogen-containing heterocyclic compounds, mercapto compounds and precursors thereof (for example, compounds described in JP-A-60-108837, JP-A-60-192939, JP-A-60-230133 and JP-A-60-230134).

Further, compounds releasing mercapto compounds by heating are also useful, and examples thereof include compounds described in JP-A-61-67851, JP-A-61-147244, JP-A-61-124941, JP-A-61-185743, JP-A-61-182039, JP-A-61-185744, JP-A-61-184539, JP-A-61-188540 and JP-A-61-53632.

As binders for the light-sensitive elements and/or the dye-fixing elements, hydrophilic binders can be used. Typically, they include transparent or translucent hydrophilic binders, for example, natural compounds such as proteins (for example, gelatin and gelatin derivatives), cellulose derivatives and polysaccharides (for example, starch and gum arabic), and synthetic polymers such as water-soluble polyvinyl compounds (for example, polyvinylpyrrolidone and acrylamide polymers). Further, they are used in the latex form, and dispersed vinyl compounds increasing the dimension stability of the photographic materials can also be used. These binders can be used alone or in combination.

In the invention, the amount of the binders coated is preferably 20 g/m$^2$ or less, more preferably 10 g/m$^2$ or less, and most preferably 7 g/m$^2$ or less.

The ratio of the high boiling organic solvents dispersed in the binders together with hydrophobic compounds such as the color-developing agents and couplers of the invention to the binders is 1 cc or less, preferably 0.5 cc or less, and more preferably 0–3 cc or less, per gram of binder.

Constituting layers of the light-sensitive elements and/or couplers of the invention (photographic layers and dye-fixing layers) may contain inorganic or organic hardeners.

Specific examples of the hardeners may contain hardeners described in JP-A-61-147244, pages 94 and 95, and JP-A-59-157636, page 38. They may be used alone or in combination.

Further, for accelerating the movement of dyes, hydrophilic heat solvents which are solid at ordinary temperature and soluble at high temperatures can also be contained in the light-sensitive elements or the dye-fixing elements. The hydrophilic heat solvents may be contained in any of the light-sensitive elements and the dye-fixing elements or both. Furthermore, they may be contained in any of emulsion layers, intermediate layers, protective layers and dye-fixing layers. However, they are preferably contained in the dye-fixing layers and/or layers adjacent thereto. Examples of the hydrophilic heat solvents include urea derivatives, pyridine derivatives, amides, sulfonamides, imides, alcohols, oximes and other heterocyclic compounds. In addition, for accelerating the movement of dyes, high boiling organic solvents may be contained in the light-sensitive elements and/or the dye-fixing elements.

Supports for use in the light-sensitive elements and dye-fixing elements of the invention are ones which can endure processing temperatures. As the general supports, not only glass, paper, polymer films, metals and their analogues, but also supports described in JP-A-61-147244 can be used.

The light-sensitive elements and the dye-fixing elements may have conductive exothermic layers as heating means for the heat development or the dye transfer.

Transparent or opaque exothermic elements in this case can be produced by utilizing known techniques as resistance heating elements. There are a method of utilizing inorganic thin films showing semiconductivity as the resistance heating elements, and a method of utilizing organic thin films in which fine conductive particles are dispersed in binders. Materials which can be used in these methods are described in JP-A-61-29835.

In the invention, as coating methods of heat developable light-sensitive layers, protective layers, intermediate layers, undercoat layers, back layers, dye-fixing layers and other layers, methods described in U.S. Pat. No. 4,500,626 can be applied.

As light sources for image exposure for recording images on the light-sensitive elements, radiation including visible light can be used. In general, light sources used in ordinary color prints, for example, tungsten lamps, mercury lamps, halogen lamps such as iodine lamps, xenon lamps, laser beam sources, CRT light sources, light emitting diodes (LEDs) and light sources described in JP-A-61-147244, page 100, and U.S. Pat. No. 4,500,626, column 56, can be used.

In an image-forming method comprising a heating stage to which the invention is applied, for example, the heat development and the dye transfer may be conducted independently or concurrently. Further, they may be continuously conducted in the sense that the transfer is conducted subsequent to the development in one step.

For example, there are (1) a method of subjecting light-sensitive elements to image exposure and heating, then laying them over dye-fixing elements, and transferring fluxional dyes to the dye-fixing elements by heating as needed, and (2) a method of subjecting light-sensitive elements to image exposure, and laying them over dye-fixing elements, followed by heating. The methods of (1) and (2) described above can be carried out either substantially in the absence of water or in the presence of a slight amount of water.

For the heating temperature in the heat development stage, the development can be achieved at about 50° C. to about 250° C. However, the development is conducted preferably at about 70° C. to about 180° C., and more preferably at 75° C. to 150° C. When heating is performed in the presence of a slight amount of water, the upper limit of the heating temperature is the boiling point or less. When the transfer stage is conducted after termination of the heat development stage, for the heating temperature in the transfer stage, it is possible to conduct the transfer at a temperature ranging from the temperature applied in the heat development stage to room temperature. In particular, the temperature is more preferably 50° C. to about 10° C. lower than the temperature applied in the heat development stage.

In a preferred image-forming method in the invention, image exposure is conducted, or image exposure and heating in the presence of a slight amount of water and bases and/or base precursors are concurrently conducted, and diffusible dyes formed at portions corresponding to or reversely corresponding to silver images concurrently with development are transferred to dye-fixing layers. According to this method, the formation of the diffusible dyes and the releasing reaction proceed very rapidly, and the transfer of the diffusible dyes to the dye-fixing layers also proceeds rapidly, so that color images of high density are obtained for a short period of time.

The amount of water for use in this embodiment is as small as at least 0.1 time the weight of all coated films of the light-sensitive element and the dye-fixing layer, preferably from 0.1 time to the weight of solvent corresponding to the maximum swelled volume of all coated films (particularly, the amount obtained by the subtraction of the weight of all coated films from the weight of solvent corresponding to the maximum swelled volume of all coated films)

The state of films in swelling is unstable, and there is a fear of producing local bleeding depending on the conditions. For avoiding this, the amount of water is preferably an amount corresponding to the maximum swelled volume of all coated films of the light-sensitive element and the dye-fixing element or less. Specifically, the amount of water is from 1 g to 50 g, particularly from 2 g to 35 g, and more preferably from 3 g to 25 g, per square meter of the total of the light-sensitive element and the dye-fixing element.

The bases and/or base precursors for use in this embodiment can be contained either in the light-sensitive elements or in the dye-fixing elements. Further, they may be dissolved in water and supplied as solutions.

In the above-mentioned embodiment, it is preferred that a slightly soluble metal compound as the base precursor and a compound which can conduct the complex formation reaction with metal ions constituting the slightly soluble metal compound using water as a medium are added to an image-forming reaction system to increase the pH of the system by the reaction of these two compounds in heating.

The term "image-forming reaction system" as used herein means a region in which the image-forming reaction occurs.

Specific examples thereof include layers belonging to both elements of the light-sensitive element and the dye-fixing element. When two or more of such layers are present, the image-forming reaction region may be any of them.

It is necessary to add the slightly soluble metal compound and the complex forming compound to at least separate layers, respectively, for preventing them from reacting until development processing. For example, in a so-called monosheet material in which the light-sensitive element and the dye-fixing element are formed on the same support, it is preferred that both of the compounds described above are separately added to the elements, respectively, between which one or more layers are allowed to intervene. Further, in a preferred embodiment, the slightly soluble metal compound and the complex forming compound are separately added to layers formed on different supports, respectively. For example, it is preferred that the slightly soluble metal compound is added to the light-sensitive element and the complex forming compound is added to the dye-fixing element having another support different from that of the light-sensitive element. The complex forming compound may be dissolved in water which is allowed to coexist, thus supplying it as a solution. The complex forming compound is preferably added as a finely divided particle dispersion prepared by methods described in JP-A-56-17480 and JP-A-53-102733, and the mean particle size thereof is 50 $\mu$m or less, and particularly 5 $\mu$m or less. The slightly soluble metal compound may be added to any of the light-sensitive layer, the intermediate layer and the protective layer of the light-sensitive element. Further, it may be divided and added to two or more layers.

When the slightly soluble metal compound or the complex forming compound is added to the layer formed on the support, the amount thereof added depends on the compound species, the particle size of the slightly soluble metal compound and the rate of the complex formation reaction. However, it is suitably 50% by weight or less, and more preferably from 0.01% to 40% by weight, in terms of the weight of each coated film. Further, when the complex forming compound is dissolved in water and supplied as a solution, the concentration of the solution is preferably from 0.005 mol to 5 mol, and particularly preferably from 0.05 mol to 2 mol, per liter. Furthermore, in the invention, the content of the complex forming compound in the reaction system is preferably from 1/100 time to 100 times, and particularly preferably from 1/10 time to 20 times, in the molar ratio, based on the content of the slightly soluble compound.

As methods for giving water to the light-sensitive layers or the dye-fixing layers, there are, for example, methods described in JP-A-61-147244, page 101, line 9 to page 102, line 4.

Heating means for use in the development and/or transfer stage include means such as hot plates, irons and heat rolls described in JP-A-61-147244, page 102, line 14 to page 103, line 11. Further, layers of conductive materials such as graphite, carbon black and metals may be laid over the light-sensitive elements and/or the dye-fixing elements, and electric current may be allowed to flow through the conductive layers to directly heat the elements.

When the light-sensitive element and the dye-fixing element are placed, one over the other, and adhered to each other, the pressure conditions and methods for applying the pressure which can be applied are described in JP-A-61-147244, pages 103 and 104.

Any of various heat development apparatus can be used for processing the photographic elements of the invention. For example, apparatus described in JP-A-59-75247, JP-A-59-177547, JP-A-59-181353, JP-A-60-18951 and JP-A-U-62-25944 (the term "JP-A-U" as used herein means an "unexamined published Japanese utility model application") can be preferably used.

The present invention will be further illustrated in greater detail with reference to the following examples, but the invention should not be construed as being limited thereto.

EXAMPLE 1

Receiving element R101 having the constitution shown in Table 1 was prepared.

TABLE 1

CONSTITUTION OF RECEIVING ELEMENT R101

| Layer Number | Additive | Amount Coated(mg/m$^2$) |
|---|---|---|
| Sixth Layer | Water-Soluble Polymer (1) | 130 |
| | Water-Soluble Polymer (2) | 35 |
| | Water-Soluble Polymer (3) | 45 |
| | Potassium Nitrate | 20 |
| | Anionic Surfactant (1) | 6 |
| | Anionic Surfactant (2) | 6 |
| | Amphoteric Surfactant (1) | 50 |
| | Stain Inhibitor (1) | 7 |
| | Stain Inhibitor (2) | 12 |
| | Matte Agent (1) | 7 |
| Fifth Layer | Gelatin | 250 |
| | Water-Soluble Polymer (1) | 25 |
| | Anionic Surfactant (3) | 9 |
| | Hardener (1) | 185 |
| Fourth Layer | Mordant (1) | 1850 |
| | Water-Soluble Polymer (2) | 260 |
| | Water-Soluble Polymer (4) | 1380 |
| | Latex Dispersion (1) | 600 |
| | Anionic Surfactant (3) | 25 |
| | Nonionic Surfactant (1) | 18 |
| | Guanidine Picolinate | 2550 |
| | Sodium Quinolinate | 350 |
| Third Layer | Gelatin | 370 |
| | Mordant (1) | 300 |
| | Anionic Surfactant (3) | 12 |
| Second Layer | Gelatin | 700 |
| | Mordant (1) | 290 |
| | Water-Soluble Polymer (1) | 55 |
| | Water-Soluble Polymer (2) | 330 |
| | Anionic Surfactant (3) | 30 |
| | Anionic Surfactant (4) | 7 |
| | High Boiling Organic Solvent (1) | 700 |
| | Fluorescent Brightener (1) | 30 |
| | Stain Inhibitor (3) | 32 |
| | Guanidine Pidolinate | 360 |
| | Potassium Quinolinate | 45 |
| First Layer | Gelatin | 280 |
| | Water-Soluble Polymer (1) | 12 |
| | Anionic Surfactant (1) | 14 |
| | Sodium Metaborate | 35 |
| | Hardener (1) | 185 |

Support (1) Paper Support Laminated with Polyethylene (thickness: 215 $\mu$m)
The amount of the latex dispersion coated is the amount of latex solid matter coated.

CONSTITUTION OF SUPPORT

| Layer Name | Composition | Film Thickness($\mu$m) |
|---|---|---|
| Surface Undercoat Layer | Gelatin | 0.1 |
| Surface FE | Low Density Polyethylene | |

TABLE 1-continued

| | | |
|---|---|---|
| Layer | (density: 0.923): 90.2 parts<br>Surface-Treated Titanium Oxide: 9.8 parts<br>Ultramarine: 0.001 part | 36.0 |
| Pulp Layer | Woodfree Paper (LBKP/NBSP = 6/4, density: 1.053) | 152.0 |
| Back Face PE Layer (Matte) | High Density Polyethylene (density: 0.955) | 27.0 |
| Back Face Undercoat Layer | Styrene/Acrylate Copolymer | |
| | Colloidal Silica | 0.1 |
| | Polysodium Styrenesulfonate | 215.2 |

Anionic Surfactant (1)

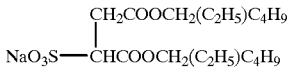

Anionic Surfactant (2)

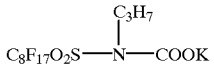

Anionic Surfactant (3)

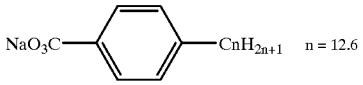

Anionic Surfactant (4)

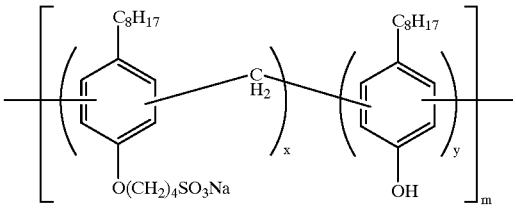

X:y=4:6 m=6.8

Nonionic Surfactant (1)

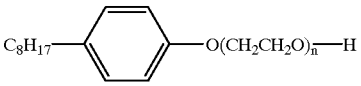

Amphoteric Surfactant (1)

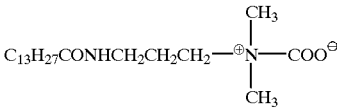

Fluorescent Brightener (1)

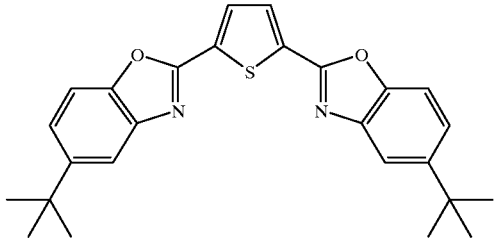

Mordant (1)

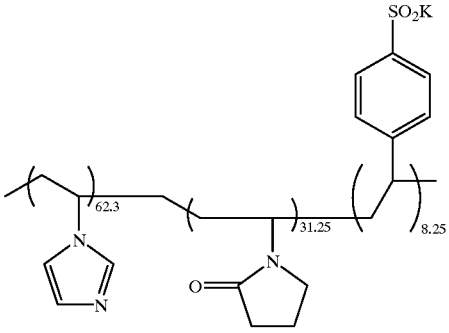

High Boiling Organic Solvent (1)

$C_{28}H_{46.9}Cl_{7.1}$ (Empara 40 (manufactured by Ajinomoto Co., Inc.))

Stain Inhibitor (1)

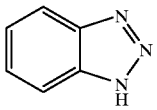

Stain Inhibitor (2)

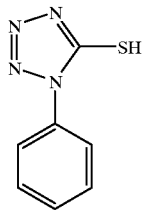

Stain Inhibitor (3)

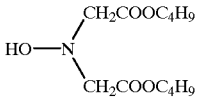

Water-Soluble Polymer (1)

Sumikagel L-5H (manufactured by Sumitomo Chemical Co, Ltd.)

Water-Soluble Polymer (2)

Dextran (molecular weight: 70,000)

Water-Soluble Polymer (3)

Kappa-carrageenan (manufactured by Taito Co., Ltd.)

Water-Soluble Polymer (4)

MP Polymer MP-438 (manufactured by Kuraray Co., Ltd.)

Latex Dispersion (1)

LX-438 (manufactured by Nippon Zeon Co., Ltd.)

Matte Agent (1)

SYLOID 79 (manufactured by Fuji Davison Chemical Co., Ltd.)

Hardener (1)

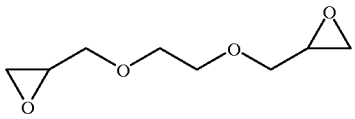

A method for preparing a light-sensitive element is described below.

First, methods for preparing light-sensitive silver halide emulsions are described.

Light-Sensitive Silver Halide Emulsion (1) (for Red-Sensitive Emulsion Layer)

Solution (I) having composition shown in Table 3 was added to a well-stirred aqueous solution having composition shown in Table 2 at the same flow rate for 9 minutes. From 10 minutes before addition of solution (I), solution (II) was added at the same flow rate for 9 minutes and 10 seconds. After 36 minutes, solution (III) having composition shown in Table 3 was added at the same flow rate for 24 minutes, and solution (IV) was added concurrently with addition of solution of (III) at the same flow rate for 25 minutes.

After washing and salt removal (conducted using sedimenting agent a at pH 4.0) by a conventional method, 880 g of lime-treated ossein gelatin was added to adjust the pH to 6.0. Then, 12.8 g of a decomposed product of ribonucleic acid and 32 mg of trimethylthiourea were added, followed by optimum chemical sensitization at 60° C. for 71 minutes. Thereafter, 2.6 g of 4-hydroxy-6-methyl-1,3,3a,7-tetraazainedene, 3.2 g of dye (a), 5.1 g of KBr and 2.6 g of a stabilizer described later were in turn added, followed by cooling. Thus, 28.1 kg of a monodisperse cubic silver chlorobromide emulsion having a mean grain size of 0.35 μm was obtained.

TABLE 2

| Composition | |
|---|---|
| $H_2O$ | 26300 cc |
| Lime-Treated Gelatin | 800 g |
| KBr | 12 g |
| NaCl | 80 g |
| Compound (a) | 1.2 g |
| Temperature 53° C. | |

TABLE 3

| | Solution (I) | Solution (II) | Solution (III) | Solution (IV) |
|---|---|---|---|---|
| $AgNO_3$ | 1200 g | — | 2800 g | — |
| KBr | — | 546 g | — | 1766 g |
| NaCl | — | 144 g | — | 96 g |
| $K_2IrC_6$ | — | 3.6 mg | — | |
| Total Amount | Water to make 6.5 liter | Water to make 6.5 liter | Water to make 6.5 liter | Water to make 6.5 liter |

Compound (a)

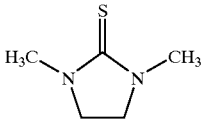

Dye (a)

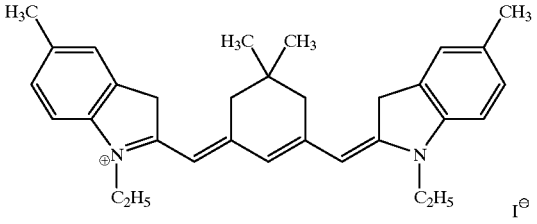

Light-Sensitive Silver Halide Emulsion (2) (for Green-Sensitive Emulsion Layer)

Solution (I) and solution (II) each having composition shown in Table 5 were concurrently added to a well-stirred aqueous solution having composition shown in Table 4 at the same flow rate for 9 minutes. After 5 minutes, solution (III) and solution (IV) each having composition shown in Table 5 were further concurrently added thereto at the same flow rate for 32 minutes. After termination of addition of solutions (III) and (IV), 60 ml of a solution of sensitizing dyes in methanol (containing 360 mg of dye (b-1) and 73.4 mg of dye (b-2)) was added.

After washing and salt removal (conducted using sedimenting agent a at pH 4.0) by a conventional method, 22 g of lime-treated ossein gelatin was added to adjust the pH and the pAg to 6.0 and 7.6, respectively. Then, 1.8 mg of sodium thiosulfate and 180 mg of 4-hydroxy-6-methyl-1,3,3a,7-tetraazainedene were added, followed by optimum chemical sensitization at 60° C. Thereafter, 90 mg of antifoggant (1) was added, followed by cooling. Thus, 635 g of a monodisperse cubic silver chlorobromide emulsion having a mean grain size of 0.30 μm was obtained.

TABLE 4

| Composition | |
|---|---|
| $H_2O$ | 600 cc |
| Lime-Treated Gelatin | 20 g |
| KBr | 0.3 g |
| NaCl | 2 g |
| Compound (a) | 0.03 g |
| Sulfuric Acid (1N) | 16 cc |
| Temperature 46° C. | |

TABLE 5

| | Solution (I) | Solution (II) | Solution (III) | Solution (IV) |
|---|---|---|---|---|
| $AgNO_3$ | 10 g | — | 90 g | — |
| KBr | — | 3.50 g | — | 57.1 g |
| NaCl | — | 1.72 g | — | 3.13 g |
| $K_2IrCl_6$ | — | — | — | 0.03 mg |
| Total Amount | Water to make 126 ml | Water to make 131 ml | Water to make 280 ml | Water to make 289 ml |

Dye (b-1)

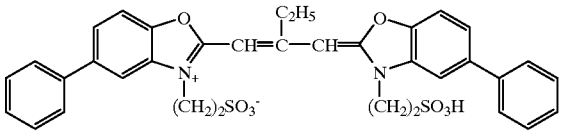

Dye (b-2)

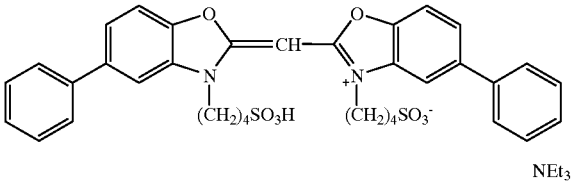

Sedimenting Agent a

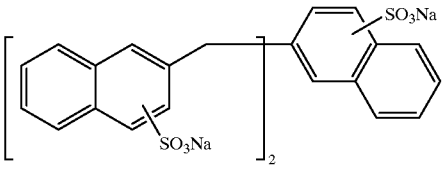

Antifoggant (1)

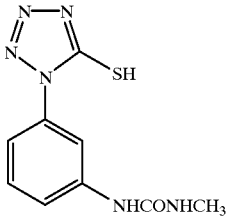

Light-Sensitive Silver Halide Emulsion (3) (for Blue-Sensitive Emulsion Layer)

Solution (II) having composition shown in Table 7 was added to a well-stirred aqueous solution having composition shown in Table 6, and 10 seconds after from the addition, solution (I) having composition shown in Table 7 was added thereto. Both solution (I) and (II) were added for 30 minutes. Further, 2 minutes after addition of solution (I), solution (V) was added, and 5 minutes after addition of solution (II), solution (IV) was added for 28 minutes. After 10 seconds, solution (III) was added for 27 minutes and 50 seconds.

After washing and salt removal (conducted using sedimenting agent b at pH 3.9) by a conventional method, 1230 g lime-treated ossein gelatin and 2.8 mg of compound (b) were added to adjust the pH and the pAg to 6.1 and 8.4, respectively. Then, 24.9 mg of sodium thiosulfate was added, followed by optimum chemical sensitization at 60° C. Thereafter, .13.1 g of dye (c) and 118 ml of compound (c) were in turn added, followed by cooling. Silver halide grains of an emulsion thus obtained were potato-like grains. The mean grain size thereof was 0.53 $\mu$m, and the yield was 30,700 g.

TABLE 6

| Composition | |
|---|---|
| $H_2O$ | 29200 cc |
| Lime-Treated Gelatin | 1582 g |
| KBr | 127 g |
| Compound (a) | 0.66 g |
| Sulfuric Acid (1N) | 16 cc |
| Temperature 72° C. | |

TABLE 7

| | Solution (I) | Solution (II) | Solution (III) | Solution (IV) | Solution (V) |
|---|---|---|---|---|---|
| $AgNO_3$ | 939 g | — | 3461 g | — | — |
| KBr | — | 572 g | — | 2464 g | — |
| KI | — | — | — | — | 22 g |
| Total Amount | Water to make 6690 ml | Water to nake 6680 ml | Water to make 9700 ml | Water to make 9740 ml | Water to make 4400 ml |

Sedimenting Agent b

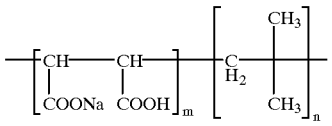

m+n=1

Dye (c)

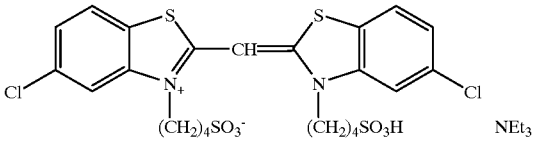

Compound (b)

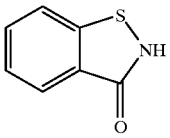

Compound (c)

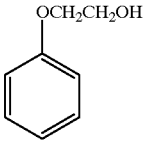

Preparation methods of gelatin dispersions of hydrophobic additives are described below.

Gelatin dispersions of yellow, magenta and cyan couplers and developing agents were each prepared according to formulations shown in Table 8. That is to say, the respective oil phase components were dissolved by heating at about 70° C. to form a homogeneous solution, and the aqueous phase components heated at about 60° C. were added to this solution. After mixing by stirring, the resulting product was dispersed in a homogenizer at 10,000 rpm for 10 minutes. Water was added thereto, followed by stirring to obtain a homogeneous dispersion.

TABLE 8

| | Composition of Dispersion | | |
|---|---|---|---|
| | Yellow | Magenta | Cyan |
| Oil Phase | | | |
| Cyan Coupler (1) | — | — | 7.0 g |
| Magenta Coupler (1) | — | 7.0 g | — |
| Yellow Coupler (1) | 7.0 g | — | — |
| Developing Agent (1) | — | — | 5.6 g |
| Developing Agent (2) | — | 5.6 g | — |
| Developing Agent (3) | 5.6 g | — | — |
| Auxiliary Developing Agent (1) | 0.51 g | 0.51 g | 0.51 g |
| Antifoggant (5) | 0.25 g | — | — |
| Antifoggant (2) | — | 0.25 g | 0.25 g |
| High Boiling Solvent (4) | 7.4 g | 4.4 g | 7.4 g |
| Ethyl Acetate | 15 cc | 15 cc | 15 cc |
| Aqueous Phase | | | |
| Lime-Treated Gelatin | 10.0 g | 10.0 g | 10.0 g |
| Calcium Nitrate | 0.1 g | 0.1 g | 0.1 g |
| Surfactant (1) | 0.7 g | 0.7 g | 0.7 g |
| Water | 110 cc | 110 cc | 110 cc |
| Water Addition | 110 cc | 110 cc | 110 cc |
| Preservative (1) | 0.04 g | 0.04 g | 0.04 g |

A gelatin dispersion of antifoggant (4) and reducing agent (3) was prepared according to a formulation shown in Table 9. That is to say, the respective oil phase components were dissolved by heating at about 60° C. to form a homogeneous solution, and the aqueous phase components heated at about 60° C. were added to this solution. After mixing by stirring, the resulting product was dispersed in a homogenizer at 10,000 rpm for 10 minutes to obtain a homogeneous dispersion.

TABLE 9

| | Composition of Dispersion |
|---|---|
| Oil Phase | |
| Antifoggan (4) | 0.16 g |
| Reducing Agent (1) | 1.3 g |
| High Boiling Solvent (2) | 2.3 g |
| High Boiling Solvent (5) | 0.2 g |
| Surfactant (1) | 0.5 g |
| Surfactant (4) | 0.5 g |
| Ethyl Acetate | 10.0 ml |
| Aqueous Phase | |
| Acid-Treated Gelatin | 10.0 g |
| Preservative (1) | 0.004 g |
| Calcium Nitrate | 0.1 g |
| Water | 35.0 ml |
| Water Addition | 104.4 ml |

A dispersion of polymer latex (a) was prepared according to a formulation shown in Table 10. That is to say, anionic surfactant (6) was added to a mixture of polymer latex (a), surfactant (5) and water with stirring for 10 minutes to obtain a homogeneous dispersion. Further, dilution with water and concentration were repeated to the resulting dispersion, using an ultrafiltration module (ACV-3050 manufactured by Asahi Chemical Industry Co., Ltd.), so as to reduce the salt concentration of the dispersion to 1/9.

TABLE 10

| | Composition of Dispersion |
|---|---|
| Aqueous Solution of Polymer Latex (a) (solid content: 13%) | 108 ml |
| Surfactant (5) | 20 g |
| Surfactant (6) | 600 ml |
| Water | 1232 ml |

A gelatin dispersion of zinc hydroxide was prepared as shown in Table 11. That is to say, the respective components were dissolved by mixing, followed by dispersion in a mill using glass beads having a mean particle size of 0.75 mm for 30 minutes. The glass beads were further removed by separation to obtain a homogeneous dispersion.

TABLE 11

| | Composition of Dispersion |
|---|---|
| Zinc Hydroxide | 15.9 g |
| Carboxymethyl Cellulose | 0.7 g |
| Polysodiuin Acrylate | 0.07 g |
| Lime-Treated Gelatin | 4.2 g |
| Water | 100 ml |
| Preservative (2) | 0.4 g |

Then, a preparation method of a gelatin dispersion of a matte agent to be added to a protective layer is described. A solution of PMMA in methylene chloride was added to gelatin together with a small amount of surfactant to obtain a homogeneous dispersion having a mean particle size of 4.3 $\mu$m.

Using the above, light-sensitive element 101 shown in Table 12 was obtained.

TABLE 12

MAIN MATERIAL CONSTITUTION OF LIGHT-SENSITIVE ELEMENT 101

| Layer No. | Layer Name | Additive | Amount Added ($mg/m^2$) |
|---|---|---|---|
| 7th Layer | Protective Layer | Acid-Treated Gelatin | 387 |
| | | Matte Agent (PMMA Resin) | 17 |
| | | Surfactant (2) | 6 |
| | | Surfactant (3) | 20 |
| | | Dispersion of Polymer Latex (a) | 10 |
| 6th Layer | Inter-mediate Layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 5 |
| | | Zinc Hydroxide | 558 |
| | | Calcium Nitrate | 6 |
| 5th Layer | Blue-Sensitive Layer | Lime-Treated Gelatin | 587 |
| | | Light-Sensitive Silver Halide Emulsion (3) | 399 |
| | | Yellow Coupler (1) | 410 |
| | | Developing Agent (3) | 328 |
| | | Antifoggant (5) | 15 |
| | | High Boiling Solvent (4) | 433 |
| | | Surfactant (1) | 12 |
| | | Water-Soluble Polymer (1) | 40 |
| | | Auxiliary Developing Agent (1) | 30 |
| 4th Layer | Inter-mediate layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 4 |
| | | Zinc Hydroxide | 341 |
| | | Calcium Nitrate | 8 |
| 3rd Layer | Green-Sensitive Layer | Lime-Treated Gelatin | 452 |
| | | Light-Sensitive Silver Halide Emulsion (2) | 234 |
| | | Magenta coupler (1) | 420 |
| | | Developing Agent (2) | 336 |
| | | Antifoggant (2) | 15 |
| | | High Boiling Solvent (4) | 444 |
| | | Surfactant (1) | 12 |
| | | Water-Soluble Polymer (1) | 10 |
| | | Auxiliary Developing Agent (1) | 30 |
| 2nd Layer | Inter-mediate layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (1) | 10 |
| | | Calcium Nitrate | 6 |
| 1st Layer | Red-Sensitive Layer | Lime-Treated Gelatin | 673 |
| | | Light-Sensitive Silver Halide Emulsion (1) | 160 |
| | | Cyan Coupler (1) | 390 |
| | | Developing Agent (1) | 312 |
| | | Antifoggant (2) | 14 |
| | | High Boiling Solvent (4) | 412 |
| | | Surfactant (1) | 11 |
| | | Water-Soluble Polymer (2) | 25 |
| | | Hardener (1) | 45 |
| | | Auxiliary Developing Agent (1) | 30 |

Support (a support in which a 20 μm-thick PET film was vapor-deposited with aluminum and further surface under-coated with gelatin)

Antifoggant (5)

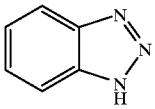

Antifoggant (2)

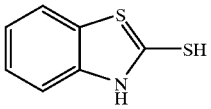

High Boiling Organic Solvent (4)

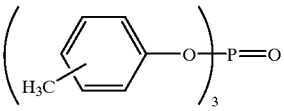

Preservative (1)

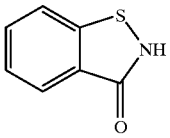

Surfactant (1)

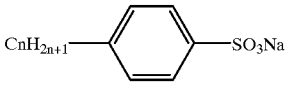

n=12.6

Antifoggant (4)

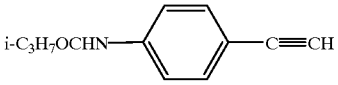

Surfactant (4)

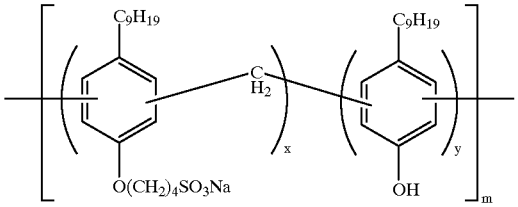

X:y=4:6 m=6.8

High Boiling Organic Solvent (2)

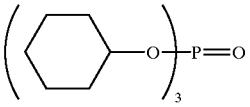

High Boiling Organic Solvent (5)
$C_{28}H_{46.9}Cl_{7.1}$ (Empara 40 (manufactured by Ajinomoto Co., Inc.))

Reducing Agent (1)

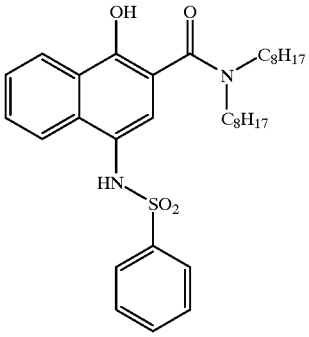

Polymer Latex (a)

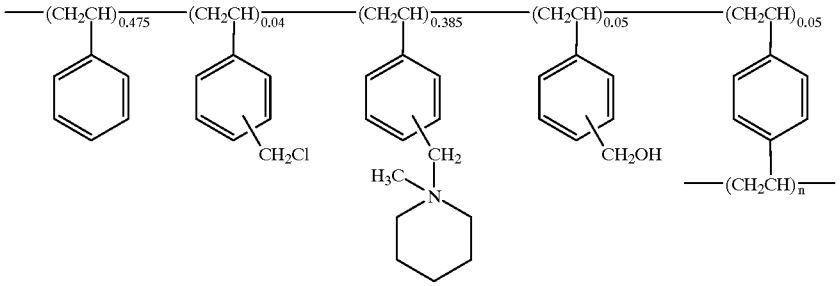

Surfactant (5)

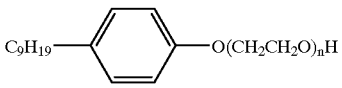

n=50

Surfactant (6)

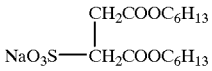

Preservative (2)

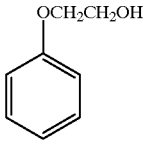

Surfactant (2)

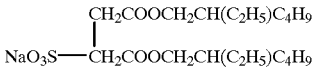

Surfactant (3)

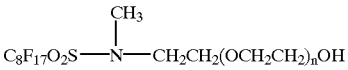

Water-Soluble Polymer (1)

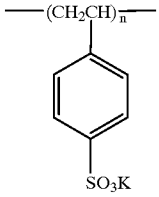

0.1 N NaCl, 30°C
intrinsic viscosity: 1.6
molecular weight: 1,000,000

Water-Soluble Polymer (2)

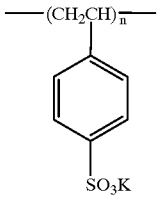

0.1 N NaCl, 30°C
intrinsic viscosity: 0.8
molecular weight: 1,000,000

Hardener (1)

$CH_2{=}CHSO_2CH_2SO_2CH{=}CH_2$

Auxiliary Developing Agent (1)

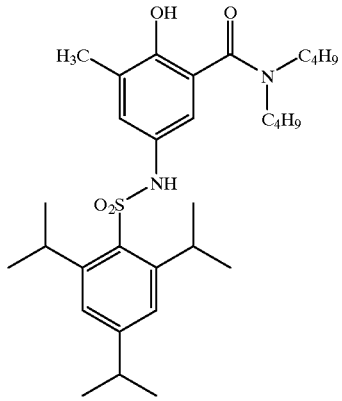

Developing Agent (1)
(Compound (49) described in JP-A-9-152705)

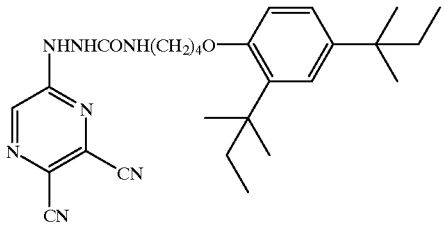

Developing Agent (2)
(Compound (36) described in JP-A-9-152705)

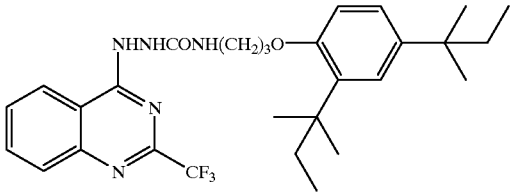

Developing Agent (3)
(Compound (64) described in JP-A-9-152705)

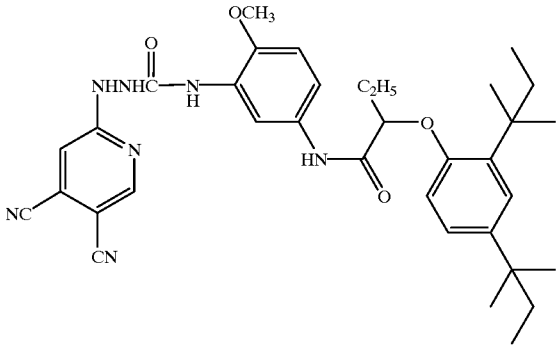

Yellow Coupler (1)

(Compound (C-17) described in JP-A-9-152705)

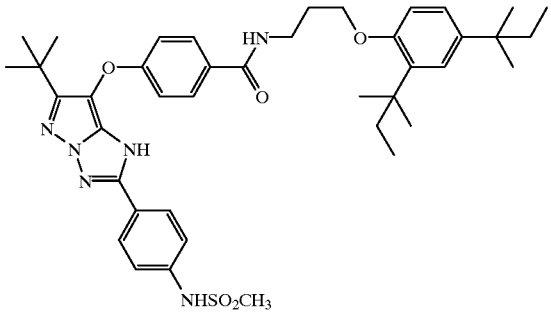

Magenta Coupler (1)
(Compound (C-43) described in JP-A-9-152705)

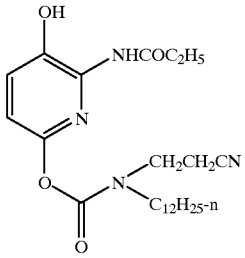

Cyan Coupler (1)
(Compound (C-37) described in JP-A-9-152705)

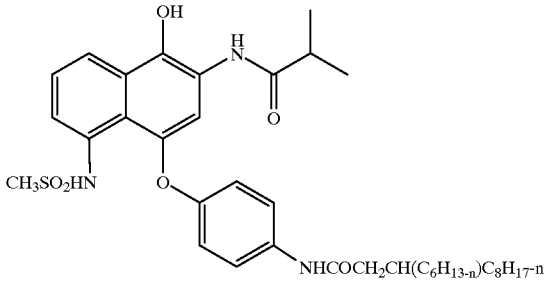

Then, light-sensitive elements 102 to 108 were prepared in the same manner as with light-sensitive element 101, with the exception that the developing agent and the yellow coupler used in the fifth layer of the above-mentioned element 101 were substituted by the developing agents and the yellow couplers of the invention represented by general formulas (1) and (2), respectively, in equimolar amounts.

Then, the above-mentioned light-sensitive elements were processed with a PICTROSTAT 200 processor (manufactured by Fuji Photo Film Co. Ltd.) at 80° C. for 17 seconds to perform image output.

Images obtained from light-sensitive elements 102 to 108 were sharp color images, and when the compounds of the invention were used, the images were excellent in sharpness.

The maximum yellow density and the minimum yellow density of these resulting yellow images were measured with an X-rite 304 reflection densitometer manufactured by X-rite Co. Results thereof are shown in Table 13.

As apparent from the table, the use of the compounds of the invention can provide good color generation even for a short development time. Further, the resulting images were stable under the conditions of light, heat and humidity.

TABLE 13

| Light-Sensitive Element | Color-developing Agent of Yellow Color Development | Coupler for Yellow Color Development | Maximum Density | Minimum Density | Remark |
|---|---|---|---|---|---|
| 101 | Developing Agent (3) | Yellow Coupler (1) | 1.01 | 0.20 | Comparison |
| 102 | D-(66) | C-5 | 2.01 | 0.21 | Invention |
| 103 | D-(68) | C-24 | 1.61 | 0.19 | Invention |
| 104 | D-(69) | C-8 | 1.59 | 0.20 | Invention |
| 105 | D-(70) | C-5 | 2.21 | 0.21 | Invention |
| 106 | D-(64) | C-34 | 1.66 | 0.20 | Invention |
| 107 | D-(13) | C-38 | 1.74 | 0.21 | Invention |
| 108 | D-(36) | C-6 | 1.65 | 0.20 | Invention |

EXAMPLE 2

Light-sensitive element 201 was prepared by the following method.

First, methods for preparing light-sensitive silver halide emulsions are described.

Light-Sensitive Silver Halide Emulsion (1) (for Fifth Layer (680-nm Light-Sensitive Layer))

Solution (I) and solution (II) having composition shown in Table 15 were concurrently added dropwise to a well-stirred aqueous solution having composition shown in Table 14 for 13 minutes. After 10 minutes, solution (III) and solution (IV) having composition shown in Table 15 were added for 33 minutes.

TABLE 14

| Composition | |
|---|---|
| $H_2O$ | 620 cc |
| Lime-Treated Gelatin | 20 g |
| KBr | 0.3 g |
| NaCl | 2 g |
| Solvent for Silver Halide (1) | 0.03 g |
| Sulfuric Acid (1N) | 16 cc |
| Temperature 45° C. | |

TABLE 15

| | Solution (I) | Solution (II) | Solution (III) | Solution (IV) |
|---|---|---|---|---|
| $AgNO_3$ | 30 g | — | 70 g | — |
| KBr | — | 13.7 g | — | 44.2 g |
| NaCl | — | 3.62 g | — | 2.4 g |
| $K_2IrCl_6$ | — | — | — | 0.039 mg |
| Total Amount | Water to make 126 ml | Water to make 132 ml | Water to make 254 ml | Water to make 252 ml |

Solvent for Silver Halide (1)

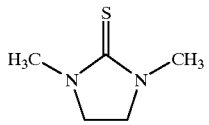

Sensitizing Dye (1)

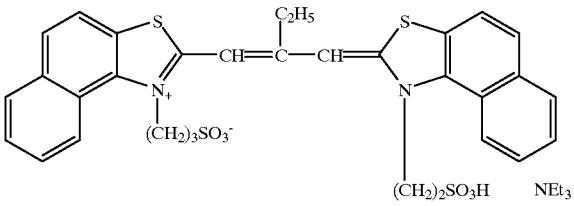

From 13 minutes after initiation of addition of solution (III), 150 cc of an aqueous solution containing 0.35% of sensitizing dye (1) was further added for 27 minutes.

After washing and salt removal (conducted using sedimenting agent a at pH 4.1) by a conventional method, 22 g of lime-treated ossein gelatin was added to adjust the pH and the pAg to 6.0 and 7.9, respectively, followed by chemical sensitization at 60° C. Compounds used in the chemical sensitization were as shown in Table 16. Thus, 630 g of a monodisperse cubic silver chlorobromide emulsion having a mean grain size of 0.20 μm and a coefficient of variation of 10.2% was obtained.

Sedimenting Agent a

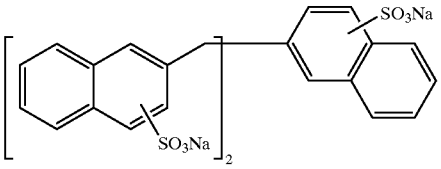

TABLE 16

| Chemicals Used in Chemical Sensitization | Amount Added |
|---|---|
| 4-Hydroxy-6-methyl-1,3,3a,7-tetraazainedene | 0.36 g |
| Sodium Thiosulfate | 6.75 mg |
| Antifoggant (1) | 0.11 g |
| Preservative (1) | 0.07 g |
| Preservative (2) | 3.31 g |

Antifoggant (1)

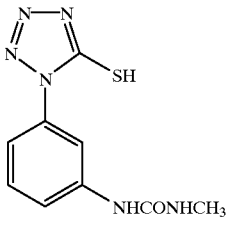

Preservative (1)

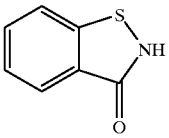

-continued

Preservative (2)

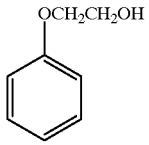

Light-Sensitive Silver Halide Emulsion (2) (for Third Layer (750-nm Light-Sensitive Layer))

Solution (I) and solution (II) having composition shown in Table 18 were concurrently added to a well-stirred aqueous solution having composition shown in Table 17 for 18 minutes. After 10 minutes, solution (III) and solution (IV) having composition shown in Table 18 were concurrently added for 24 minutes.

TABLE 17

| Composition | |
|---|---|
| $H_2O$ | 620 cc |
| Lime-Treated Gelatin | 20 g |
| KBr | 0.3 g |
| NaCl | 2 g |
| Solvent for Silver Halide (1) | 0.03 g |
| Sulfuric Acid (1N) | 16 cc |
| Temperature 45° C. | |

TABLE 18

| | Solution (I) | Solution (II) | Solution (III) | Solution (IV) |
|---|---|---|---|---|
| $AgNO_3$ | 30 0 g | — | 70.0 g | — |
| KBr | — | 13.7 g | — | 44.2 q |
| NaCl | — | 3.62 g | — | 2.4 g |
| $K_4[Fe(CN)_6]$ $H_2O$ | — | — | — | 0.07 g |
| $K_2IrCl_6$ | — | — | — | 0.04 mg |
| Total Amount | Water to make 188 ml | Water to make 188 ml | Water to make 250 ml | Water to make 250 ml |

After washing and salt removal (conducted using sedimenting agent b at pH 3.93) by a conventional method, 22 g of lime-treated ossein gelatin subjected to decalcification treatment (having a calcium content of 150 ppm or less) was added and redispersion was carried out at 40° C. Then, 0.39 g of 4-hydroxy-6-methyl-1,3,3a,7-tetraazainedene was added to adjust the pH and the pAg to 6.9 and 7.8, respectively. Then, chemical sensitization was conducted at 70° C. using chemicals shown in Table 19. Further, sensitizing dye (2) was added as a methanol solution (solution having composition shown in Table 20) at the end of the chemical sensitization. Furthermore, after the chemical sensitization, the temperature was lowered to 40° C., and 200 g of a gelatin dispersion of stabilizer (1) described later was added. The resulting mixture was sufficiently stirred, followed by storing. Thus, 938 g of a monodisperse cubic silver chlorobromide emulsion having a mean grain size of 0.25 μm and a coefficient of variation of 12.6% was obtained. The emulsion for a 750 nm light-sensitive layer was an emulsion having J-band type spectral sensitivity.

TABLE 19

| Chemicals Used in Chemical Sensitization | Amount Added |
|---|---|
| 4-Hydroxy-6-methyl-1,3,3a,7-tetraazainedene | 0.39 g |
| Triethylthiourea | 3.3 mg |
| Decomposed Product of Nucleic Acid | 0.39 g |
| NaCl | 0.15 g |
| KI | 0.12 g |
| Antifoggant (2) | 0.10 g |
| Preservative (1) | 0.07 g |

TABLE 20

| Composition of Dye Solution | Amount Added |
|---|---|
| Sensitizing Dye (2) | 0.19 g |
| Methanol | 18.7 cc |

Sedimenting Agent b

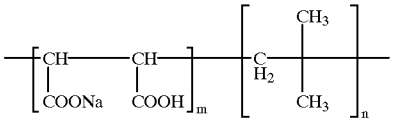

m+n=1

Stabilizer (1)

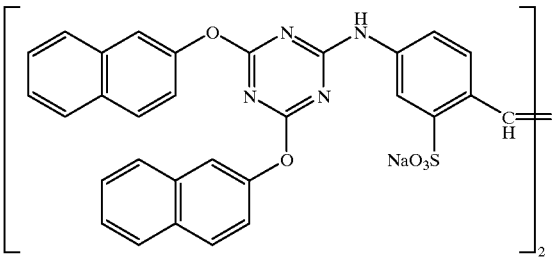

Sensitizing Dye (2)

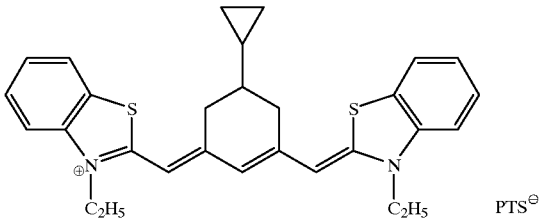

Antifoggant (2)

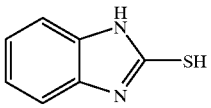

Light-Sensitive Silver Halide Emulsion (3) (for Fourth Layer (810-nm Light-Sensitive Layer))

Solution (I) and solution (II) having composition shown in Table 22 were concurrently added to a well-stirred aqueous solution having composition shown in Table 21 for 13 minutes. After 10 minutes, solution (III) and solution (IV) having composition shown in Table 22 were added for 24 minutes.

TABLE 21

| Composition | |
|---|---|
| $H_2O$ | 620 cc |
| Lime-Treated Gelatin | 20 g |
| KBr | 0.3 g |
| NaCl | 2 g |
| Solvent for Silver Halide (1) | 0.03 g |
| Sulfuric Acid (1N) | 16 cc |
| Temperature 50° C. | |

TABLE 22

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.02 mg |
| Total Amount | Water to make 180 ml | Water to make 181 ml | Water to make 242 ml | Water to make 250 ml |

After washing and salt removal (conducted using sedimenting agent a at pH 3.8) by a conventional method, 22 g of lime-treated ossein gelatin was added to adjust the pH and the pAg to 7.4 and 7.8, respectively, followed by chemical sensitization. Compounds used in the chemical sensitization were as shown in Table 23. Further, sensitizing dye (3) was added as a methanol solution (similarly to sensitizing dye (2) shown in Table 20) at the end of the chemical sensitization. Thus, 680 g of a monodisperse cubic silver chlorobromide emulsion having a mean grain size of 0.32 μm and a coefficient of variation of 9.7% was obtained. The emulsion for a 750 nm light-sensitive layer was an emulsion having J-band type spectral sensitivity.

TABLE 23

| Chemicals Used in Chemical Sensitization | Amount Added |
|---|---|
| 4-Hydroxy-6-methyl-1,3,3a,7-tetraazainedene | 0.38 g |
| Triethylthiourea | 3.1 mg |
| Antifoggant (2) | 0.19 g |
| Preservative (1) | 0.07 g |
| Preservative (2) | 3.13 g |

Sensitizing Dye (3)

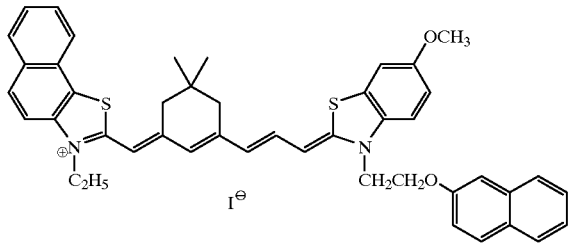

A preparation method of a gelatin dispersion of colloidal silver is described below.

A solution having composition shown in Table 25 was added to a well-stirred aqueous solution having composition shown in Table 24 for 24 minutes. Then, after washing with sedimenting agent a, 43 g of lime-treated ossein gelatin was added to adjust the pH to 6.3. Thus, 512 g of a dispersion containing 2% of silver having a mean grain size of 0.02 μm and 6.8% of gelatin was obtained.

TABLE 24

| Composition | |
|---|---|
| $H_2O$ | 620 cc |
| Dextrin | 16 g |
| NaOH (5N) | 41 cc |
| Temperature 30° C. | |

TABLE 25

| Composition | |
|---|---|
| $H_2O$ | 135 cc |
| $AgNO_3$ | 17 g |

Preparation methods of gelatin dispersions of hydrophobic additives are described below.

Gelatin dispersions of yellow, magenta and cyan couplers and developing agents were each prepared according to formulations shown in Table 26. That is to say, the respective oil phase components were dissolved by heating at about 70° C. to form a homogeneous solution, and the aqueous phase components heated at about 60° C. were added to this solution. After mixing by stirring, the resulting product was dispersed in a homogenizer at 10,000 rpm for 10 minutes. Water was added thereto, followed by stirring to obtain a homogeneous dispersion.

TABLE 26

| | Composition of Dispersion | | |
|---|---|---|---|
| | Yellow | Magenta | Cyan |
| Oil Phase | | | |
| Cyan Coupler (2) | — | — | 7.0 g |
| Magenta Coupler (2) | — | 7.0 g | — |
| Yellow Coupler (2) | 7.0 g | — | — |
| Developing Agent (4) | — | — | 5.6 g |
| Developing Agent (4) | — | 5.6 g | — |
| Developing Agent (4) | 5.6 g | — | — |
| Auxiliary Developing Agent (1) | 0.51 g | 0.51 g | 0.51 g |
| Antifoggant (5) | 0.25 g | — | — |
| Antifoggant (2) | — | 0.25 g | 0.25 g |
| High Boiling Solvent (4) | 7.4 g | 4.4 g | 7.4 g |
| Dye (a) | 1.1 g | — | — |
| Ethyl Acetate | 15 cc | 15 cc | 15 cc |
| Aqueous Phase | | | |
| Lime-Treated Gelatin | 10.0 g | 10.0 g | 10.0 g |
| Calcium Nitrate | 0.1 g | 0.1 g | 0.1 g |
| Surfactant (1) | 0.2 g | 0.2 g | 0.2 g |
| Water | 110 cc | 110 cc | 110 cc |
| Water Addition | 110 cc | 110 cc | 110 cc |
| Preservative (1) | 0.04 g | 0.04 g | 0.04 g |

A gelatin dispersion of antifoggant (4) and reducing agent (3) was prepared according to a formulation shown in Table 27. That is to say, the respective oil phase components were dissolved by heating at about 60° C. to form a homogeneous solution, and the aqueous phase components heated at about 60° C. were added to this solution. After mixing by stirring, the resulting product was dispersed in a homogenizer at 10,000 rpm for 10 minutes to obtain a homogeneous dispersion.

TABLE 27

| | Composition of Dispersion |
|---|---|
| Oil Phase | |
| Antifoggant (4) | 0.16 g |
| Reducing Agent (1) | 1.3 g |
| High Boiling Solvent (2) | 2.3 g |
| High Boiling Solvent (5) | 0.2 g |
| Surfactant (1) | 0.5 g |
| Surfactant (4) | 0.5 g |
| Ethyl Acetate | 10.0 ml |
| Acid-Treated Gelatin | 10.0 g |
| Aqueous Phase | |
| Preservative (1) | 0.004 g |
| Calcium Nitrate | 0.1 g |
| Water | 35.0 ml |
| Water Addition | 104.4 ml |

A gelatin dispersion of reducing agent (2) was prepared according to a formulation shown in Table 28. That is to say, the respective oil phase components were dissolved by heating at about 60° C. to form a homogeneous solution, and the aqueous phase components heated at about 60° C. were added to this solution. After mixing by stirring, the resulting product was dispersed in a homogenizer at 10,000 rpm for 10 minutes to obtain a homogeneous dispersion. Further, ethyl acetate was removed from the resulting dispersion using an apparatus for removing organic solvents under reduced pressure.

TABLE 28

| | Composition of Dispersion |
|---|---|
| Oil Phase | |
| Reducing Agent (2) | 7.5 g |
| High Boiling Solvent (1) | 4.7 g |
| Surfactant (1) | 1.9 g |
| Ethyl Acetate | 14.4 ml |
| Acid-Treated Gelatin | 10.0 g |
| Aqueous Phase | |
| Preservative (1) | 0.02 g |
| Gentamicin | 0.04 g |
| Sodium Hydrogensulfite | 0.1 g |
| Water | 136.7 ml |

A dispersion of polymer latex (a) was prepared according to a formulation shown in Table 29. That is to say, anionic surfactant (6) was added to a mixture of polymer latex (a), surfactant (5) and water in amounts shown in Table 29 with stirring for 10 minutes to obtain a homogeneous dispersion. Further, dilution with water and concentration were repeated to the resulting dispersion, using an ultrafiltration module (ACV-3050 manufactured by Asahi Chemical Industry Co., Ltd.), so as to reduce the salt concentration of the dispersion to 1/9.

TABLE 29

| | Composition of Dispersion |
|---|---|
| Aqueous Solution of Polymer Latex (a) (solid content: 13%) | 108 ml |
| Surfactant (5) | 20 g |
| Surfactant (6) | 600 ml |
| Water | 1232 ml |

A gelatin dispersion of stabilizer (1) was prepared according to a formulation shown in Table 30. That is to say, the oil phase components were dissolved at room temperature to form a homogeneous solution, and the aqueous phase components heated at about 40° C. were added to this solution. After mixing by stirring, the resulting product was dispersed in a homogenizer at 10,000 rpm for 10 minutes. Water was added thereto to obtain a homogeneous dispersion.

TABLE 30

| | Composition of Dispersion |
|---|---|
| Oil Phase | |
| Stabilizer (1) | 4.0 g |
| Sodium Hydroxide | 0.3 g |
| Methanol | 62.8 g |
| Preservative (2) | 0.8 g |
| Aqueous Phase | |
| Decalcified Gelatin (Ca content: 100 ppm or less) | 10.0 g |

TABLE 30-continued

| | Composition of Dispersion |
|---|---|
| Preservative (1) | 0.04 g |
| Water | 320 ml |

A gelatin dispersion of zinc hydroxide was prepared as shown in Table 31. That is to say, the respective components were dissolved by mixing, followed by dispersion in a mill using glass beads having a mean particle size of 0.75 mm for 30 minutes. The glass beads were further removed by separation to obtain a homogeneous dispersion.

TABLE 31

| | Composition of Dispersion |
|---|---|
| Zinc Hydroxide | 15.9 g |
| Carboxymethyl Cellulose | 0.7 g |
| Polysodium Acrylate | 0.07 g |
| Lime-Treated Gelatin | 4.2 g |
| Water | 100 ml |
| Preservative (2) | 0.4 g |

Then, a preparation method of a gelatin dispersion of a matte agent to be added to a protective layer is described. A solution of PMMA in methylene chloride was added to gelatin together with a small amount of surfactant to obtain a homogeneous dispersion having a mean particle size of 4.3 $\mu$m.

Using the above, light-sensitive element 201 shown in Table 32 was obtained.

TABLE 32

MAIN MATERIAL CONSTITUTION OF LIGHT-SENSITIVE ELEMENT 101

| Layer No. | Layer Name | Additive | Amount Added (mg/m$^2$) |
|---|---|---|---|
| 7th Layer | Protective Layer | Acid-Treated Gelatin | 442 |
| | | Reducing Agent (2) | 47 |
| | | High Boiling Solvent (1) | 30 |
| | | Colloidal Silver Grains | 2 |
| | | Matte Agent (PMMA Resin) | 17 |
| | | Surfactant (1) | 16 |
| | | Surfactant (2) | 9 |
| | | Surfactant (3) | 2 |
| 6th Layer | Intermediate Layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Dispersion of Polymer Latex (a) | 5 |
| | | Water-Soluble Polymer (1) | 4 |
| | | Calcium Nitrate | 6 |
| 5th Layer | Red-Sensitive Layer | Lime-Treated Gelatin | 452 |
| | | Light-Sensitive Silver Halide Emulsion (1) | 301 |
| | | Magenta Coupler (2) | 420 |
| | | Developing Agent (4) | 336 |
| | | Antifoggant (2) | 15 |
| | | High Boiling Solvent (4) | 444 |

TABLE 32-continued

MAIN MATERIAL CONSTITUTION OF LIGHT-SENSITIVE ELEMENT 101

| Layer No. | Layer Name | Additive | Amount Added (mg/m$^2$) |
|---|---|---|---|
| | | Surfactant (1) | 12 |
| | | Water-Soluble Polymer (1) | 10 |
| | | Auxiliary Developing Agent (1) | 30 |
| 4th Layer | Intermediate Layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (2) | 21 |
| | | Surfactant (4) | 21 |
| | | Dispersion of Polymer Latex (a) | 5 |
| | | Water-Soluble Polymer (1) | 4 |
| | | Calcium Nitrate | 6 |
| 3rd Layer | Second Infrared-Sensitive Layer | Lime-Treated Gelatin | 373 |
| | | Light-Sensitive Silver Halide Emulsion (2) | 106 |
| | | Cyan Coupler (2) | 390 |
| | | Developing Agent (4) | 312 |
| | | Antifoggant (2) | 14 |
| | | High Boiling Solvent (4) | 412 |
| | | Surfactant (1) | 11 |
| | | Water-Soluble Polymer (1) | 11 |
| | | Auxiliary Developing Agent (1) | 30 |
| 2nd Layer | Intermediate Layer | Lime-Treated Gelatin | 862 |
| | | Antifoggant (4) | 7 |
| | | Reducing Agent (1) | 57 |
| | | High Boiling Solvent (2) | 101 |
| | | High Boiling Solvent (5) | 9 |
| | | Surfactant (1) | 21 |
| | | Surfactant (4) | 21 |
| | | Water-Soluble Polymer (2) | 25 |
| | | Zinc Hydroxide | 750 |
| | | Calcium Nitrate | 6 |
| 1st Layer | First Infrared-Sensitive Layer | Lime-Treated Gelatin | 587 |
| | | Light-Sensitive Silver Halide Emulsion (3) | 311 |
| | | Yellow Coupler (2) | 410 |
| | | Developing Agent (4) | 328 |
| | | Antifoggant (5) | 15 |
| | | High Boiling Solvent (4) | 433 |
| | | Surfactant (1) | 12 |
| | | Water-Soluble Polymer (2) | 40 |
| | | Hardener (1) | 45 |
| | | Auxiliary Developing Agent (1) | 30 |

Support (a support in which a 20 $\mu$m-thick PET film was vapor-deposited with aluminum and further surface under-coated with gelatin)

Dye (a)

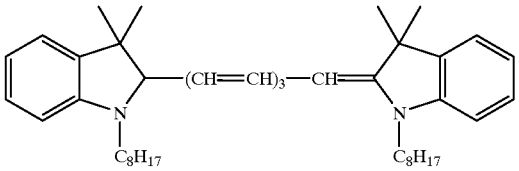

-continued

Antifoggant (4)

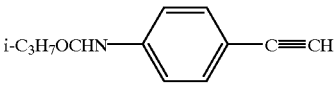

Antifoggant (5)

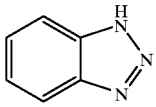

-continued

Reducing Agent (1)

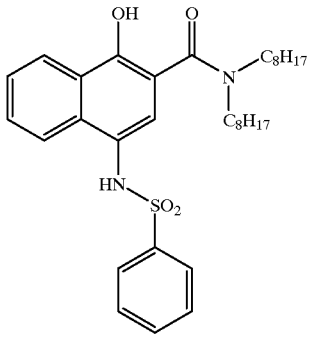

Reducing Agent (2)

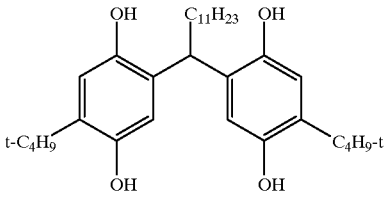

Water-Soluble Polymer (1)

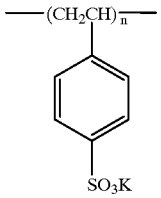

0.1 N NaCl, 30°C
intrinsic viscosity: 1.6
molecular weight: 1,000,000

Water-Soluble Polymer (2)

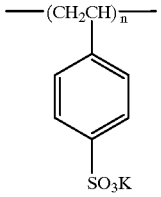

0.1 N NaCl, 30°C
intrinsic viscosity: 0.8
molecular weight: 1,000,000

Auxiliary Developing Agent (1)

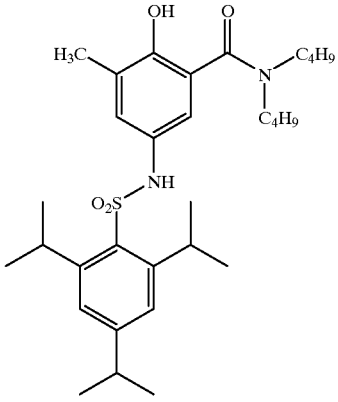

-continued

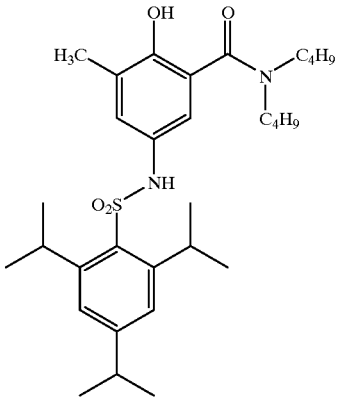

Surfactant (1)

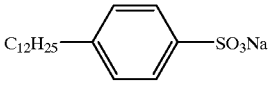

Surfactant (2)

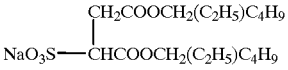

Surfactant (3)

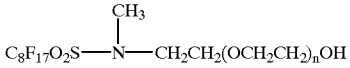

Surfactant (4)

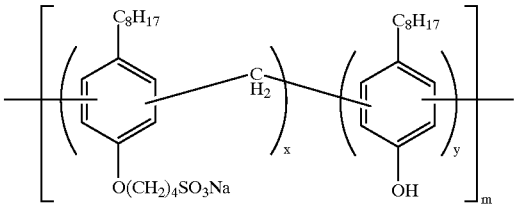

X:y=4:6 m=6.8

Surfactant (5)

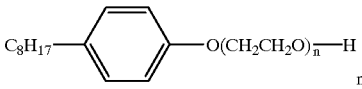

n=8.5

Surfactant (6)

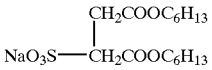

High Boiling Organic Solvent (1)

$(OH_2CHC\ (C_2H_5)\ C_4H_9)_3—P{=}O$

High Boiling Organic Solvent (2)

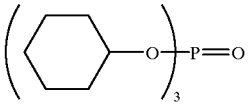

High Boiling Organic Solvent (4)

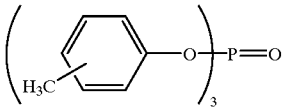

High Boiling Organic Solvent (5)

$C_{28}H_{46.9}Cl_{7.1}$ (Empara 40 (manufactured by Ajinomoto Co., Inc.))

Hardener (1)

$CH_2{=}CHSO_2CH_2SO_2CH{=}CH_2$

Polymer Latex (a)

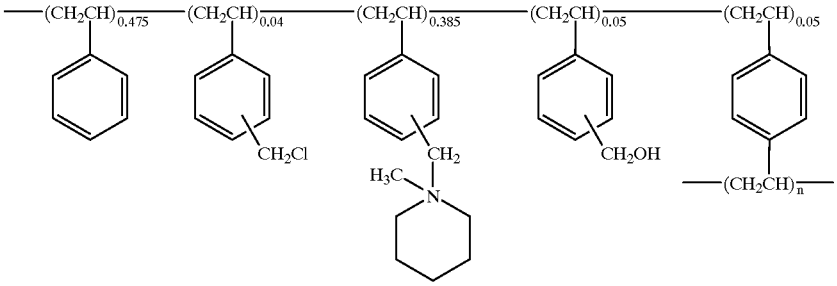

Developing Agent (4)

(Compound (56) described in JP-A-9-152705)

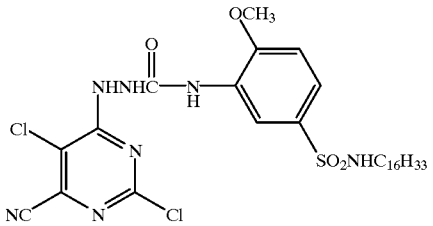

Yellow Coupler (2)

(Compound (C-14) described in JP-A-9-152705)

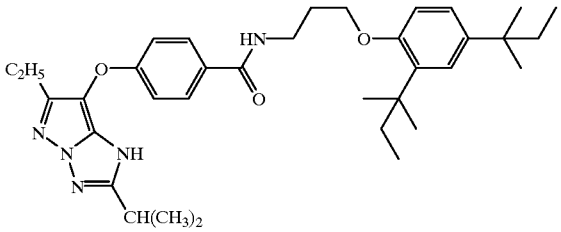

Magenta Coupler (2)

(Compound (C-38) described in JP-A-9-152705)

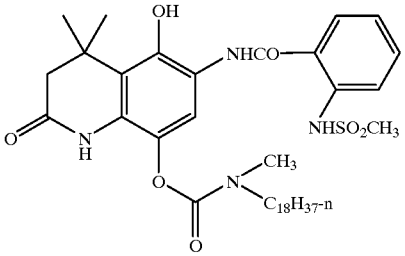

Cyan Coupler (2)

(Compound (C-45) described in JP-A-9-152705)

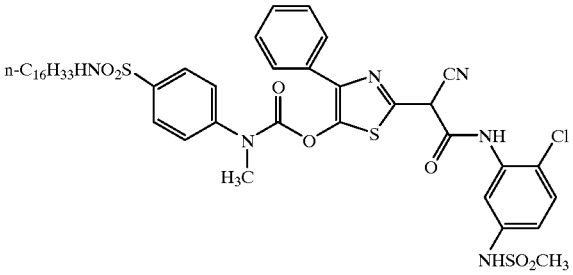

Then, light-sensitive elements 202 to 208 were prepared in the same manner as with light-sensitive element 201, with the exception that the developing agent and the yellow coupler used in the first layer of the above-mentioned element 201 were substituted by the developing agents and the yellow couplers of the invention represented by general formulas (1) and (2), respectively, in equimolar amounts.

Then, the above-mentioned light-sensitive elements were processed with a PG-3000 processor (manufactured by Fuji Photo Film Co. Ltd.) at 80° C. for 30 seconds to perform image output.

Images obtained from light-sensitive elements 202 to 208 were sharp color images, and when the compounds of the invention were used, the images were excellent in sharpness.

The maximum yellow density and the minimum yellow density of these resulting yellow images were measured with an X-rite 304 reflection densitometer manufactured by X-rite Co. Results thereof are shown in Table 33.

As apparent from the table, the use of the compounds of the invention can provide good color generation even for a short development time. Further, the resulting images were stable under the conditions of light, heat and humidity.

TABLE 33

| Light-Sensitive Element | Color-developing Agent for Yellow Color Development | Coupler for Yellow Color Development | Maximum Density | Minimum Density | Remark |
|---|---|---|---|---|---|
| 201 | Developing Agent (4) | Yellow Coupler (2) | 1.14 | 0.20 | Comparison |
| 202 | D-(66) | C-5 | 2.21 | 0.21 | Invention |
| 203 | D-(68) | C-11 | 2.27 | 0.19 | Invention |
| 204 | D-(69) | C-12 | 2.11 | 0.21 | Invention |
| 205 | D-(70) | C-14 | 2.04 | 0.18 | Invention |
| 206 | D-(64) | C-34 | 1.60 | 0.19 | Invention |
| 207 | D-(13) | C-38 | 1.71 | 0.20 | Invention |
| 208 | D-(36) | C-41 | 1.45 | 0.22 | Invention |

EXAMPLE 3

In the method described in JP-A-9-152702, Example 1, the developing agent (exemplified compound D-(66) and each of the yellow couplers (exemplified compounds C-13, C-15, C-19, C-30, C-31 and C-45) of the invention were used in place of compound D-(7) and ExY. As a result, good images were obtained.

EXAMPLE 4

In the method described in JP-A-9-152702, Example 3, the developing agent (exemplified compound D-(66) and each of the yellow couplers (exemplified compounds C-5, C-6, C-18, C-24, C-26 C-34, C-35, C-38, C-39 and C-40) of the invention were used in place of compound D-(6) and ExY2. As a result, good images were obtained.

According to the invention, good color generation can be obtained even for a short development time, and the resulting images are stable under the conditions of light, heat and humidity.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having provided thereon at least one hydrophilic colloidal layer containing at least one color-developing agent represented by general formula (1) and at least one coupler represented by general formula (2):

(1)

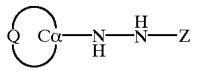

wherein Cα represents a carbon atom, Z represents a carbamoyl group, an acyl group, an alkoxycarbonyl group or an aryloxycarbonyl group, and Q represents an atomic group forming an unsaturated ring together with Cα.

(2)

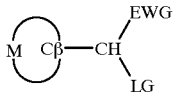

wherein Cβ represents a carbon atom, EWG represents a cyano group, a carbamoyl group or an alkoxycarbonyl group, LG represents a group which is released by a coupling reaction with an oxidation product of a developing agent, and M represents an atomic group forming a 5-membered aromatic heterocycle together with Cβ.

2. The silver halide color photographic material according to claim 1, wherein Z in general formula (1) is a carbamoyl group, and said carbamoyl group has at least one hydrogen atom bonded to the nitrogen atom thereof.

3. The silver halide color photographic material according to claim 1, wherein LG in general formula (2) is an arylthio group.

4. The silver halide color photographic material according to claim 1, wherein EWG in general formula (2) is a cyano group.

5. An image-forming method comprising developing a silver halide color photographic material according to claim 1.

6. The image-forming method according to claim 5, wherein development is heat development.

7. The image-forming method according to claim 5, wherein said development is carried out under alkali generation caused by a slightly soluble metal salt and a completing agent for said metal salt.

8. The image-forming method according to claim 5, wherein said development is carried out by developing an alkali treatment solution.

* * * * *